US012773606B2

(12) United States Patent
Johnson et al.

(10) Patent No.: US 12,773,606 B2
(45) Date of Patent: Oct. 27, 2026

(54) METALWOOD GOLF CLUB FITTING SYSTEM AND METHOD

(71) Applicant: Acushnet Company, Fairhaven, MA (US)

(72) Inventors: Gregory D. Johnson, Valley Center, CA (US); Brett C. Porath, Carlsbad, CA (US)

(73) Assignee: ACUSHNET COMPANY, Fairhaven, MA (US)

( * ) Notice: Subject to any disclaimer, the term of this patent is extended or adjusted under 35 U.S.C. 154(b) by 840 days.

(21) Appl. No.: 18/147,425

(22) Filed: Dec. 28, 2022

(65) Prior Publication Data

US 2023/0256312 A1 Aug. 17, 2023

Related U.S. Application Data

(63) Continuation-in-part of application No. 17/566,553, filed on Dec. 30, 2021, now Pat. No. 12,053,682.

(51) Int. Cl.

| | |
|---|---|
| ***A63B 60/46*** | (2015.01) |
| ***A63B 53/04*** | (2015.01) |
| ***A63B 71/06*** | (2006.01) |

(52) U.S. Cl.

CPC ..... *A63B 60/46* (2015.10); *A63B 53/047* (2013.01); *A63B 71/0619* (2013.01); *A63B 2220/803* (2013.01); *A63B 2225/02* (2013.01)

(58) Field of Classification Search

CPC ... A63B 60/46; A63B 53/047; A63B 71/0619; A63B 2220/803; A63B 2225/02;

(Continued)

(56) References Cited

U.S. PATENT DOCUMENTS 5,441,256 A 8/1995 Hackman
5,478,073 A 12/1995 Hackman (Continued)

OTHER PUBLICATIONS

Office Action issued in EP Application 23219435.7 issued May 12, 2025.

(Continued)

*Primary Examiner* — Nini F Legesse
(74) *Attorney, Agent, or Firm* — Womble Bond Dickinson (US) LLP

(57) ABSTRACT

A system for generating a fitting recommendation for a golf club, the system including: a launch monitor including one or more sensors configured to capture ball flight characteristics; and a computing device communicatively coupled to the launch monitor, the computing device including: a processor, and memory storing instructions that, when executed by the processor, cause the system to perform operations including: receiving, by the computing device, player input data; receiving, by the computing device from the launch monitor, first ball flight characteristics for a first golf shot; generating, based on both the player input data and the first ball flight characteristics, a first computed distance and a first computed accuracy; and generating, based on the first computed distance and the first computed accuracy, the fitting recommendation including at least one of a golf club head model, a loft, a shaft weight, or a shaft length.

20 Claims, 35 Drawing Sheets

(58) Field of Classification Search
CPC ..... A63B 69/3605; G06Q 30/0281; G06Q 30/0621; G06Q 30/0623; G06Q 30/0631; G09B 19/0038
USPC ..... 473/221, 223, 407, 409
See application file for complete search history.

(56) References Cited

U.S. PATENT DOCUMENTS

| | | | | |
|---|---|---|---|---|
| 6,083,123 | A * | 7/2000 | Wood | A63B 69/3605 473/409 |
| 6,375,579 | B1 | 4/2002 | Hart | |
| 6,514,081 | B1 | 2/2003 | Mengoli | |
| 7,153,215 | B2 * | 12/2006 | Peterson | A63B 53/0466 473/409 |
| 7,273,427 | B2 | 9/2007 | Inoue et al. | |
| 7,578,175 | B2 | 8/2009 | Ban | |
| 7,967,695 | B2 * | 6/2011 | Voges | A63B 24/0021 473/223 |
| 8,257,191 | B2 | 9/2012 | Stites et al. | |
| 8,414,411 | B2 | 4/2013 | Stites et al. | |
| 8,512,162 | B2 * | 8/2013 | Kim | G09B 19/0038 473/407 |
| 8,784,228 | B2 | 7/2014 | Morin et al. | |
| 8,982,216 | B2 | 3/2015 | Ishii et al. | |
| 9,489,494 | B2 | 11/2016 | Ripp et al. | |
| 9,514,379 | B2 | 12/2016 | Park et al. | |
| 9,675,862 | B2 * | 6/2017 | Solheim | A63B 24/0003 |
| 9,744,422 | B2 | 8/2017 | Ripp et al. | |
| 9,827,464 | B2 * | 11/2017 | Swartz | A63B 24/0021 |
| 10,071,299 | B2 | 9/2018 | Ripp et al. | |
| 10,213,645 | B1 | 2/2019 | Wu et al. | |
| 10,409,363 | B1 | 9/2019 | Kudrika | |
| 10,493,340 | B1 * | 12/2019 | Golden | A63B 60/46 |
| 10,543,415 | B2 | 1/2020 | Ripp et al. | |
| 10,806,979 | B2 | 10/2020 | Kimizuka et al. | |
| 11,007,413 | B2 | 5/2021 | Golden et al. | |
| 12,064,674 | B2 * | 8/2024 | Golden | A63B 60/46 |
| 2002/0123386 | A1 | 9/2002 | Perlmutter | |
| 2003/0008731 | A1 | 1/2003 | Anderson et al. | |
| 2003/0216191 | A1 | 11/2003 | Wright et al. | |
| 2004/0048685 | A1 | 3/2004 | Tsunoda | |
| 2005/0277483 | A1 * | 12/2005 | Peterson | A63B 60/42 473/282 |
| 2006/0052173 | A1 | 3/2006 | Telford | |
| 2008/0115582 | A1 | 5/2008 | Sato et al. | |
| 2009/0088276 | A1 * | 4/2009 | Solheim | A63B 24/0021 473/409 |
| 2009/0131190 | A1 | 5/2009 | Kimber | |
| 2009/0326688 | A1 * | 12/2009 | Thomas | A63B 69/362 473/409 |
| 2010/0216563 | A1 | 8/2010 | Stites et al. | |
| 2011/0230273 | A1 | 9/2011 | Niegowski | |
| 2011/0230985 | A1 | 9/2011 | Niegowski et al. | |
| 2012/0050529 | A1 | 3/2012 | Bentley | |
| 2012/0277015 | A1 | 11/2012 | Boyd et al. | |
| 2012/0277035 | A1 | 11/2012 | Ueda et al. | |
| 2012/0316004 | A1 | 12/2012 | Shibuya | |
| 2013/0165251 | A1 | 6/2013 | Jorgensen | |
| 2014/0045604 | A1 | 2/2014 | Brunski et al. | |
| 2014/0200091 | A1 * | 7/2014 | Swartz | A63B 71/0619 473/221 |
| 2014/0260636 | A1 | 9/2014 | Kammerer et al. | |
| 2014/0357427 | A1 | 12/2014 | Ishikawa et al. | |
| 2014/0378238 | A1 | 12/2014 | Voges et al. | |
| 2015/0105172 | A1 | 4/2015 | Thurman et al. | |
| 2015/0105183 | A1 | 4/2015 | Kamino | |
| 2015/0367222 | A1 | 12/2015 | Ripp et al. | |
| 2016/0184632 | A1 | 6/2016 | Ueda et al. | |
| 2016/0292509 | A1 | 10/2016 | Kaps et al. | |
| 2016/0332049 | A1 | 11/2016 | Stites et al. | |
| 2017/0274256 | A1 * | 9/2017 | Brekke | A63B 60/42 |
| 2017/0291064 | A1 | 10/2017 | Onuki et al. | |
| 2017/0340936 | A1 | 11/2017 | Hanamitsu et al. | |
| 2018/0272186 | A1 | 9/2018 | Goel et al. | |
| 2019/0143175 | A1 | 5/2019 | Voges et al. | |
| 2019/0192950 | A1 | 6/2019 | Tuxen | |
| 2020/0398138 | A1 | 12/2020 | Hendrix et al. | |
| 2021/0069548 | A1 | 3/2021 | Beach et al. | |
| 2022/0105416 | A1 | 4/2022 | Arand | |
| 2023/0211216 | A1 | 7/2023 | Johnson et al. | |
| 2024/0033599 | A1 | 2/2024 | Johnson et al. | |
| 2025/0128131 | A1 | 4/2025 | Johnson et al. | |

OTHER PUBLICATIONS

What Vokey Wedges?—Vokey Design Wedge—Team Tileist, https://www.titleist.com.sg/teamtitleist/team-titleist/f/vokey-design-wedges/46297/what-vokey-wedges, Nov. 2, 2019 (Year: 2019).

Titleist Vokey SM6 Wedges Review, https://www.youtube.com/watch?v=jR9BjUpZIYs, Feb. 24, 2016 (Year: 2016).

European Search Report for EP Application No. 24 20 6636.3 dated Feb. 5, 2025 (10 pages).

European Search Report for EP Application No. 23 21 9435, dated May 8, 2024 (17 pages).

European search report issued in related European Application No. 22214145.9, May 23, 2023, 12 pages.

Wedge Selector Tool | Find the Best Wedges for You | Vokey SM8—Vokey.Com, URL:https://web.archive.org/web/20210615070959/https://www.vokey.com/tools/wedge-selector-tool.aspx, Jun. 15, 2021 [retrieved on May 11, 2023], 1 page.

What Vokey Wedges?—Vokey Design Wedges—Team Titleist, URL:https://www.titleist.com.sg/teamtitleist/team-titleist/f/vokey-design-wedges/46297/what-vokey-wedges, Nov. 2, 2019 [retrieved on May 12, 2023], 3 pages.

Extended European Search Report received for European Patent Application No. 25212964.8, mailed on Apr. 22, 2026, 9 pages.

Holmes, Brian W. , "Putting: How a Golf Ball and Hole Interact", American Journal of Physics, vol. 59, No. 2, doi: https://doi.org/10.1119/1.16592, Feb. 1, 1991, pp. 129-136.

* cited by examiner

METALWOOD GOLF CLUB FITTING SYSTEM AND METHOD

CROSS-REFERENCE TO RELATED APPLICATIONS

This application is a continuation-in-part of U.S. patent application Ser. No. 17/566,553, filed Dec. 30, 2021, which is hereby incorporated by reference in its entirety. To the extent appropriate, the present application claims priority to the above-referenced application.

BACKGROUND

A golf club includes a shaft and a golf club head at an end of the shaft. The shaft and the golf club head of a metalwood golf club can have various features, such as shaft weight, shaft length, golf club head model, and loft, which, if appropriately fit, may improve or enhance a golfer's game. However, a typical golfer requires assistance to make this selection, and the current fitting process for metalwoods is generally in an outdoor setting, and there has not been a great way to conduct metalwood fitting in an indoor setting, such as a golf equipment store.

It is with respect to these and other general considerations that the aspects disclosed herein have been made. Also, although relatively specific problems may be discussed, it should be understood that the examples should not be limited to solving the specific problems identified in the background or elsewhere in this disclosure.

SUMMARY

Examples of the present disclosure describe a system and a method for generating a fitting recommendation for a golf club.

According to an aspect, the technology relates to a system for generating a fitting recommendation for a metalwood golf club, the system including: a launch monitor including one or more sensors configured to capture ball flight characteristics; and a computing device communicatively coupled to the launch monitor, the computing device including: a processor, and memory storing instructions that, when executed by the processor, cause the system to perform operations including: receiving, by the computing device, player input data; receiving, by the computing device from the launch monitor, first ball flight characteristics for a first golf shot; generating, based on both the player input data and the first ball flight characteristics, a first computed distance and a first computed accuracy; and generating, based on the first computed distance and the first computed accuracy, the fitting recommendation including at least one of a golf club head model, a loft, a shaft weight, or a shaft length.

In some examples, the player input data includes at least one of player's handicap, player's average golf ball distance, player's golf ball accuracy from tee, player's golf ball trajectory, player's swing tempo, player's preferred golf club head model, player's preference between maximizing golf ball carry distance or golf ball total distance, or player's preference between maximizing golf ball accuracy or maximizing golf ball distance. In some other examples, the system further includes a display, wherein the operations further include: displaying, on the display, a first user interface including input fields; receiving, as input into the input fields of the data-input user interface, the player input data; receiving, by the computing device from the launch monitor and for each golf club of a plurality of golf clubs, ball flight characteristics for each golf shot of one or more golf shots taken with the golf club, wherein the ball flight characteristics include golf ball total distance and golf ball lateral distance; generating, for each golf club of the plurality of golf clubs and based on the ball flight characteristics for each golf shot of the one or more golf shots taken with the golf club, a computed distance and a computed accuracy; ranking a plurality of potential fitting recommendations respectively corresponding to the plurality of golf clubs, and displaying, via the display and on a fitting recommendation representation in a second user interface, the plurality of potential fitting recommendations according to their rankings; ranking the computed distances respectively corresponding to the plurality of golf clubs, ranking the computed accuracies respectively corresponding to the plurality of golf clubs, displaying, via the display and on a distance-accuracy representation in the second user interface, the computed distances respectively corresponding to the plurality of golf clubs based on their rankings, and displaying, via the display and on the distance-accuracy representation in the second user interface, the computed accuracies based on their rankings; displaying, via the display, on a golf shot graphical representation in the second user interface, and for each golf club of the plurality of golf clubs, the golf ball total distance and the golf ball lateral position for each golf shot of the one or more golf shots taken with the golf club; and representing, on a pitch count user interface via the display, a number of golf shots that have been taken. In some other examples, the operations further include receiving, by the computing device from the launch monitor, ball flight characteristics for each of a plurality of golf shots taken with a first golf club including a first golf club head, wherein the plurality of golf shots include the first golf shot, the generating the first computed distance is based on both the player input data and the ball flight characteristics for each of the plurality of golf shots, and the ball flight characteristics for each of the plurality of golf shots includes a lateral golf ball position and at least one of a golf ball total distance or a golf ball carry distance. In some other examples, the operations further include receiving, by the computing device from the launch monitor, ball flight characteristics for each of a plurality of golf shots taken with a first golf club including a first golf club head, wherein the plurality of golf shots include the first golf shot, the generating the first computed accuracy is based on both the player input data and the ball flight characteristics for each of the plurality of golf shots, and the ball flight characteristics for each of the plurality of golf shots includes a lateral golf ball position and at least one of a golf ball total distance or a golf ball carry distance. In some other examples, the first golf shot is taken with a first golf club including a first golf club head, wherein the operations further include: receiving, by the computing device from the launch monitor, second ball flight characteristics for a second golf shot taken with a second golf club including a second golf club head; and generating a second computed distance based on both the player input data and the second ball flight characteristics, and a second computed accuracy based on both the player input data and the second ball flight characteristics, wherein the generating the fitting recommendation is based on the first computed distance, the first computed accuracy, the second computed distance, and the second computed accuracy, and wherein the fitting recommendation includes: a golf club head model of the first golf club head and a golf club head loft of the first golf club head; or a golf club head model of the second golf club head and a golf club head loft of the second golf club head. In some other examples, the first golf club includes a first shaft, and the second golf club includes the first shaft. In some other examples, the first golf shot is taken with a first golf club including a first shaft, wherein the operations further include: receiving, by the computing device from the launch monitor, second ball flight characteristics for a second golf shot taken with a second golf club including a second shaft; and generating a second computed distance based on the second ball flight characteristics, and a second computed accuracy based on both the player input data and the second ball flight characteristics, and wherein the generating the fitting recommendation is based on the first computed distance, the first computed accuracy, the second computed distance, and the second computed accuracy, and wherein the fitting recommendation includes: a golf club head model of the first golf club head and a golf club head loft of the first golf club head; or a golf club head model of the second golf club head and a golf club head loft of the second golf club head. In some other examples, the first golf club includes a first golf club head, and the second golf club includes the first golf club head. In some other examples, the computing device is configured to generate a first plurality of potential golf clubs and to filter the first plurality of potential golf clubs by an inventory database to provide a second plurality of potential golf clubs, the computing device is configured to receive selection of a golf club from among the second plurality of potential golf clubs, the computing device is configured to associate the ball flight characteristics for the first golf shot with the golf club selected from among the second plurality of potential golf clubs, and the fitting recommendation includes at least one of a golf club head model, a loft, a shaft weight, or a shaft length of the golf club selected from among the second plurality of potential golf clubs.

According to an aspect, the technology relates to a computer-implemented method for generating a golf club head fitting recommendation for a golf club, the method including: receiving, by a computing device, player input data; receiving, by the computing device from a launch monitor communicatively coupled to the computing device, ball flight characteristics for each of a plurality of golf shots with a first golf club including a first golf club head; and generating, based on the player input data and the ball flight characteristics for each of the plurality of golf shots with the first golf club, the golf club head fitting recommendation including a golf club head model and a loft.

In some examples, the player input data includes at least one of player's handicap, player's average golf ball distance, player's golf ball accuracy from tee, player's golf ball trajectory, player's swing tempo, player's preferred golf club head model, player's preference between maximizing golf ball carry distance or golf ball total distance, player's preference between maximizing golf ball accuracy or maximizing golf ball distance. In some other examples, the method further includes receiving, by the computer device from the launch monitor, ball flight characteristics for each of a plurality of golf shots with a second golf club including a second golf club head, wherein the generating the golf club head fitting recommendation is based on the player input data, the ball flight characteristics for each of the plurality of golf shots with the first golf club, and the ball flight characteristics for each of the plurality of golf shots with the second golf club. In some other examples, the first golf club head has a first golf club head model, a first loft, a first hosel setting, wherein the method further includes: receiving, by the computer device from the launch monitor, ball flight characteristics for each of a plurality of golf shots with a second golf club including a second golf club head having a second golf club head model, a second loft, and a second set hosel setting, wherein at least one of the second golf club head model, the second loft, or the second hosel setting is different, respectively, from the first golf club head model, the first loft, or the first hosel setting; and generating, based on the player input data, the ball flight characteristics for each of the plurality of golf shots with the first golf club, and the ball flight characteristics for each of the plurality of golf shots with the second golf club, a fine tuned head recommendation including a golf club head model, a loft, and a hosel setting. In some other examples, the method further includes: generating, based on the player input data and the ball flight characteristics for each of the plurality of golf shots with the first golf club, a first computed distance and a first computed accuracy; and generating, based on the player input data and the ball flight characteristics for each of the plurality of golf shots with the second golf club, a second computed distance and a second computed accuracy, wherein the generating the fine tuned head recommendation occurs after the golf club head fitting recommendation is generated, and is based on the first computed distance, the first computed accuracy, the second computed distance, and the second computed accuracy.

According to an aspect, the technology relates to a computer-implemented method for generating a shaft fitting recommendation for a golf club, the method including: receiving, by a computing device, player input data; receiving, by the computing device from a launch monitor communicatively coupled to the computing device, ball flight characteristics for each of a plurality of golf shots with a first golf club including a first golf club shaft; and generating, based on the player input data and the ball flight characteristics for each of the plurality of golf shots with the first golf club, the shaft fitting recommendation including a shaft length and a shaft weight.

In some examples, the player input data includes at least one of player's handicap, player's average golf ball distance, player's golf ball accuracy from tee, player's golf ball trajectory, player's swing tempo, player's preferred golf club head model, player's preference between maximizing golf ball carry distance or golf ball total distance, player's preference between maximizing golf ball accuracy or maximizing golf ball distance. In some examples, the method further includes receiving, by the computer device from the launch monitor, ball flight characteristics for each of a plurality of golf shots with a second golf club including a second golf club shaft, wherein the generating the shaft fitting recommendation is based on the player input data, the ball flight characteristics for each of the plurality of golf shots with the first golf club, and the ball flight characteristics for each of the plurality of golf shots with the second golf club. In some other examples, the method further includes: generating, based on the player input data and the plurality of golf shots with the first golf club shaft, a first computed distance and a first computed accuracy; and generating, based on the player input data and the plurality of golf shots with the second golf club shaft, a second computed distance and a second computed accuracy, wherein the generating the shaft fitting recommendation is based on the first computed distance, the first computed accuracy, the second computed distance, and the second computed accuracy. In some other examples, the method further includes: receiving, by the computer device from the launch monitor, ball flight characteristics for each of a plurality of golf shots with a golf club including the first golf club shaft and a first golf club head; and generating, based on the player input data and the ball flight characteristics for each of the plurality of golf shots with the golf club including the first golf club shaft and the first golf club head, a golf club head recommendation including a golf club head model and a loft, wherein the generating the golf club head recommendation occurs after the generating the shaft fitting recommendation.

BRIEF DESCRIPTION OF THE DRAWINGS

Non-limiting and non-exhaustive examples are described with reference to the following figures.

DETAILED DESCRIPTION

The present disclosure is directed to a system and method of fitting golf clubs. In some examples, the systems and methods herein are for fitting wedge type iron golf clubs having lofts within the range of 46° to 64°, examples of which are shown in FIGS. 1-4 and discussed with reference to Table 1 below.

Figure 1:
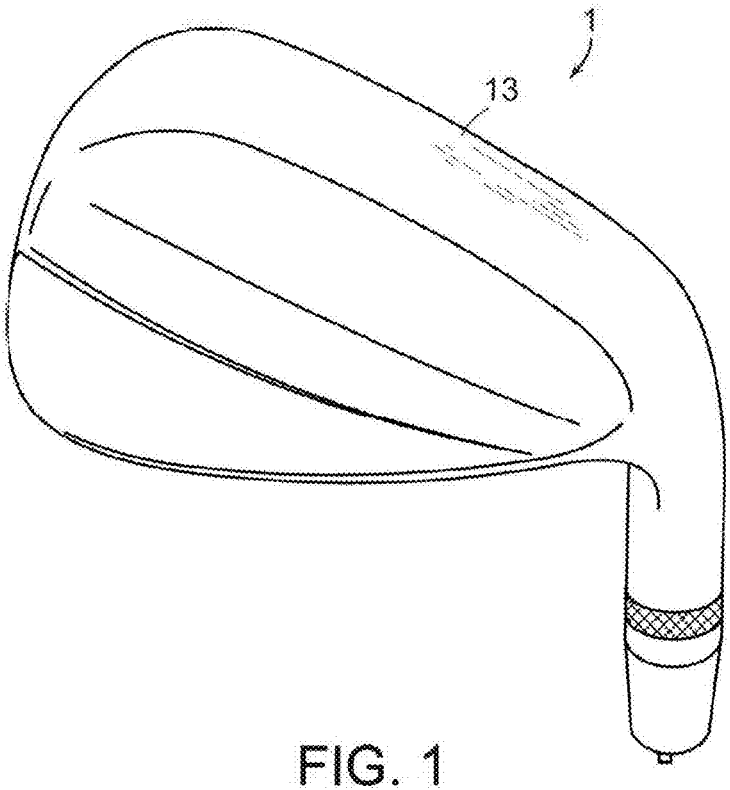
FIG. 1 depicts a gap wedge golf club head.
Figure 2:
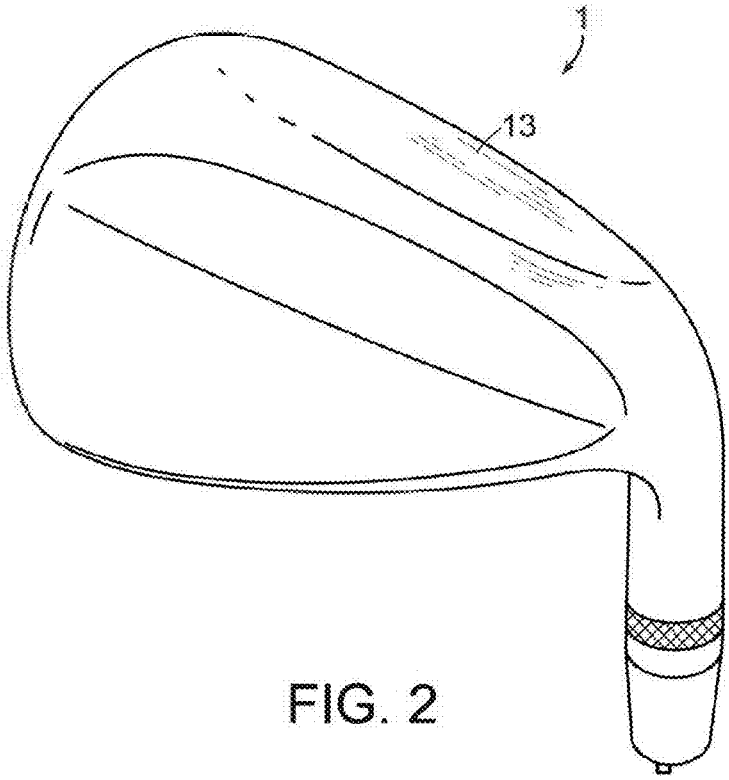
FIG. 2 depicts a sand wedge golf club head.
Figure 3:
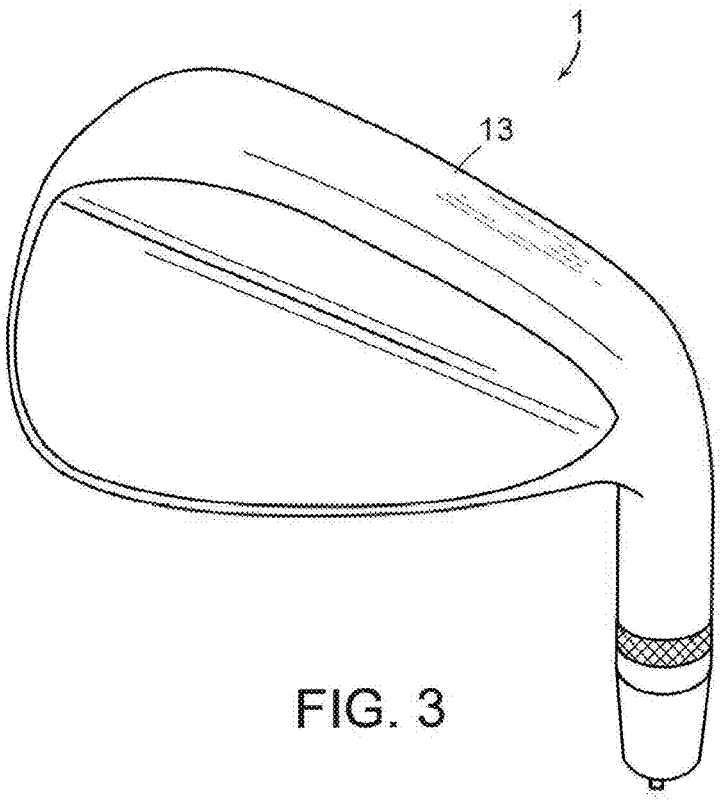
FIG. 3 depicts a sand wedge golf club head.
Figure 4:
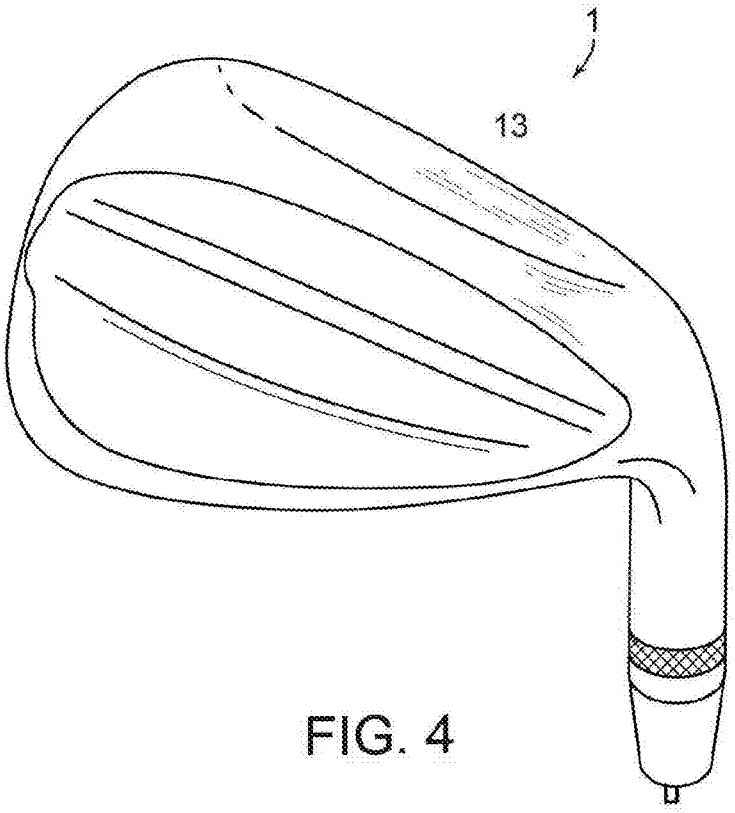
FIG. 4 depicts a lob wedge golf club head.

FIG. 1 depicts a gap wedge golf club head 1 having a 50 degree loft and a sole 13 having an 8 degree bounce and an F-grind. FIG. 2 depicts a sand wedge golf club head 1 having a 54 degree loft and a sole 13 having an 8 degree bounce and an M-grind. FIG. 3 depicts a sand wedge golf club head 1 having a 56 degree loft and a sole 13 having a 10 degree bounce and an S-grind. FIG. 4 depicts a lob wedge golf club head 1 having a 58 degree loft and a sole 13 having a 12 degree bounce and a D-grind.

Figure 5:
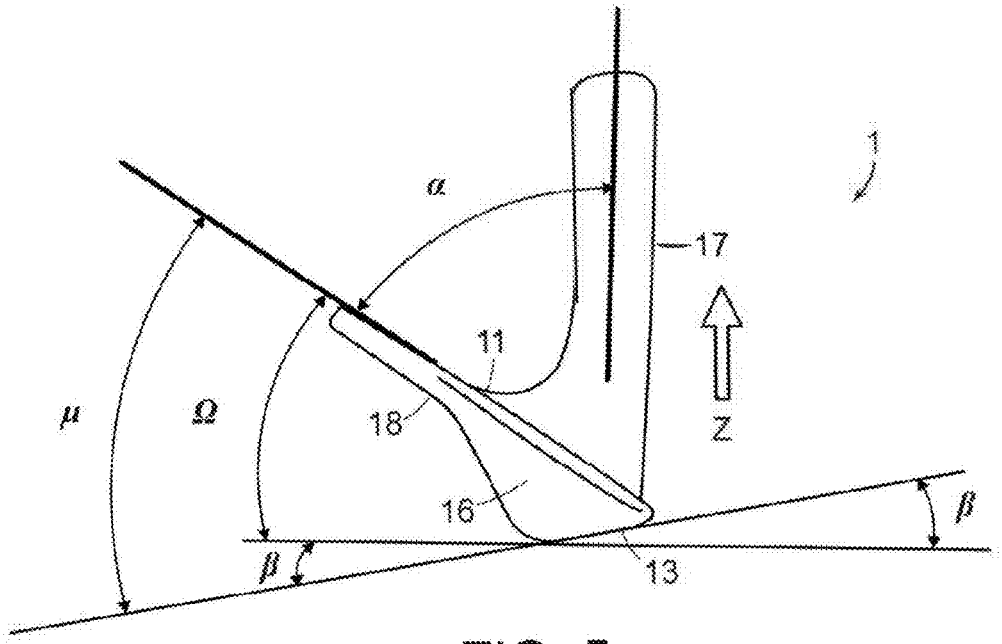
FIG. 5 depicts a view of an iron type golf club head 1 in a toe-to-heel direction with the golf club head 1 in a standard address position.
Figure 6:
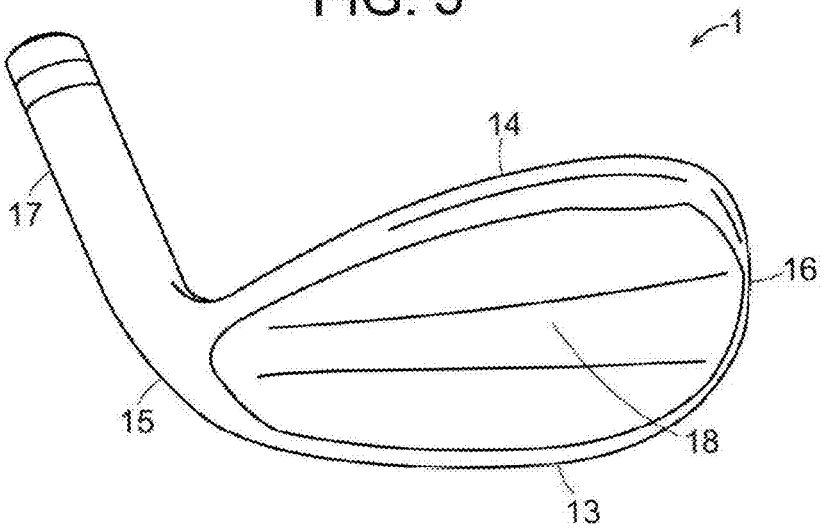
FIG. 6 depicts a back view of the golf club head 1 of FIG. 5.
Figure 7:
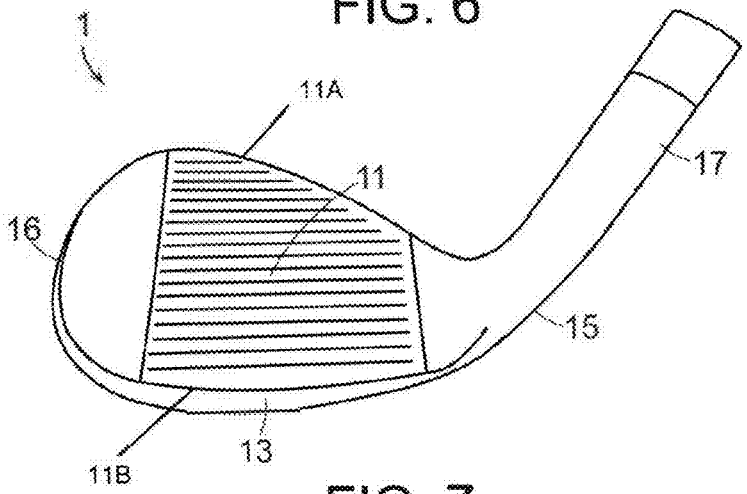
FIG. 7 depicts a forward view of the golf club head 1 of FIG. 5.

FIG. 5 depicts a view of an iron type golf club head 1 in a toe-to-heel direction with the golf club head 1 in a standard address position. FIG. 6 depicts a back view of the golf club head 1 of FIG. 5. FIG. 7 depicts a forward view of the golf club head 1 of FIG. 5. Referring to FIGS. 5-7, the golf club head 1 includes a body having a striking face 11 on a forward portion of the body, a back surface 18 opposite to the strike face 11, a heel side 15, and a toe side 16 opposite to the heel side 15. Each of the striking face 11 and the back surface 18 are at least partially coupled between the heel side 15 and the toe side 16. A hosel 17 is disposed at the heel end 15 of the body and is configured to couple to a golf club shaft (not shown).

The striking face 11 of the golf club head 1 is configured for striking a golf ball. Grooves are machined into the striking face 11 and extend along a toe-heel direction. The grooves may be radiused at a toe side of the grooves and at a heel side of the grooves. A round cutter or a saw cutter, may be used to form the grooves such that the toe and heel sides of the grooves are radiused about an axis of rotation that is perpendicular to a longitudinal axis of the groove. Having radiused groove sides facilitates removal of dirt, grass, sand, and other materials that typically become embedded within the grooves of a golf club during normal use by eliminating corners that can trap these materials. Details about grooves and groove manufacture can be found in more detail in U.S. Pat. No. 7,758,449 to Gilbert, et al., the entire content of which is hereby incorporated by reference. Any definitions, terminology, or characterizations of the present disclosure used herein shall take precedence over any conflicting information provided in any material incorporated by reference.

The striking face 11 has an upper topline edge 11A and a lower leading edge 11B opposite to the upper topline edge 11A. The upper topline edge 11A and the lower leading edge 11B are each coupled between the heel side 15 and the toe side 16. The body includes a top portion 14 coupled between the upper topline edge 11A of the striking face 11 and the back surface 18. The body further includes a sole 13 extending from the lower leading edge 11B of the striking face 11 to the back surface 18. The top portion 14 and the sole 13 are each coupled between the heel side 15 and the toe side 16 of the body. The sole 13 may have one of a plurality of combinations of bounce angle and type of grind. The bounce angle may be between about −5 degrees to about 20 degrees. Examples of some available combinations for a wedge type golf club head are set forth in Table 1.

TABLE 1

| Wedge Type | Loft (α) | Bounce Angle (β) | Sole Configuration |
|---|---|---|---|
| Pitching | 46 | 10 | F |
| Pitching | 48 | 10 | F |
| Gap | 50 | 8 | F |
| Gap | 50 | 12 | F |
| Gap | 52 | 8 | F |
| Gap | 52 | 12 | F |
| Sand | 54 | 8 | M |
| Sand | 54 | 10 | S |
| Sand | 54 | 14 | F |
| Sand | 56 | 8 | M |
| Sand | 56 | 10 | S |
| Sand | 56 | 14 | F |
| Lob | 58 | 4 | L |
| Lob | 58 | 8 | M |
| Lob | 58 | 10 | S |
| Lob | 58 | 12 | D |
| Lob | 58 | 14 | K |
| Lob | 60 | 4 | L |
| Lob | 60 | 8 | M |
| Lob | 60 | 10 | S |
| Lob | 60 | 12 | D |
| Lob | 60 | 14 | K |
| Lob | 62 | 8 | M |

A loft a of a wedge, as shown in FIG. 5, generally determines a launch angle of a golf ball when hit with the wedge, and thus, at least partially determines a distance the golf ball will travel after being hit. For example, a wedge having a loft of 46 degrees will hit the golf ball with a lower launch angle than a wedge having a 60 degree loft. A full shot with a wedge having a loft of 46 degrees will also typically go further than with a wedge having a 60 degree loft.

Golfers may use a plurality of wedges for their golf game. Pitching and gap wedges are often used for full shots into a green and more of a bump-and-run type pitch shot around the green. Sand wedges are typically more versatile and used to hit the ball out of sand traps as well as for higher loft shots around the green. Lob wedges are generally used for shorter shots where the player requires a shot with very little run after the ball lands on the green.

Because wedges generally have multiple purposes and players use them differently, there are many options for wedges, including a configuration (or grind type) of the sole. For example, an F-grind sole configuration, as shown in FIG. 1, is a relatively planar sole having a small camber radius from front-to-back and from heel-to-toe. The F-grind sole is an all-purpose grind that is particularly suited for full shots and shots hit with a square face. The F-grind is generally preferred by players that desire a traditional wedge sole.

An M-grind sole configuration, as shown in FIG. 2, has a relatively planar front portion surface that is crescent-shaped with large relief surface across the back, heel and toe portions of the sole. The M-grind is generally better for players with a shallower, more sweeping swing that play shots from a variety of clubface positions.

An S-grind sole configuration, as shown in FIG. 3, has a small camber radius from front-to-back and from heel-to-toe with some relief surface across the back portion of the sole. The S-grind sole is generally best for square faced shots like the F-grind, but has more versatility than the F-grind.

A D-grind sole configuration, as shown in FIG. 4, has a relatively planar front portion surface that is crescent-shaped and a large bounce angle with large relief surface across the back, heel and toe portions of the sole. The D-grind is generally preferred by players that have a steeper delivery to the ball because of the wedge's higher bounce. The D-grind is similar to the M-grind in that they have a crescent-shaped front portion of the sole, but the D-grind offers more bounce in the forward portion.

A K-grind sole configuration is a high bounce wedge sole with a large camber radius from front-to-back and from heel-to-toe. The sole configuration is particularly useful for bunker shots. The K-grind is a wide, full sole wedge with enhanced camber to make it forgiving from a variety of sand and turf conditions.

An L-grind sole configuration features a narrow crescent shape front portion with steep relief surfaces along the back and at the heel and toe, allowing for maximum greenside versatility. The sole configuration is ideal for firm conditions and designed for skilled players who frequently open or close the clubface to create different types of shots around the green.

A bounce angle β is the angle the sole creates with a planar ground surface when the hosel is in the vertical plane, a standard address position, as shown in FIG. 5. The bounce angle β can also be measured by measuring a Face-to-Sole angle μ and subtracting the Face-to-Ground angle Ω (which is equivalent to 90°-α) when the wedge is in the standard address position. Some wedges have a sole defined by a cambered surface from front-to-back. With these soles, the bounce angle β can be determined from the tangent line of the curved surface half way between the leading edge and the trailing edge.

Figure 8:
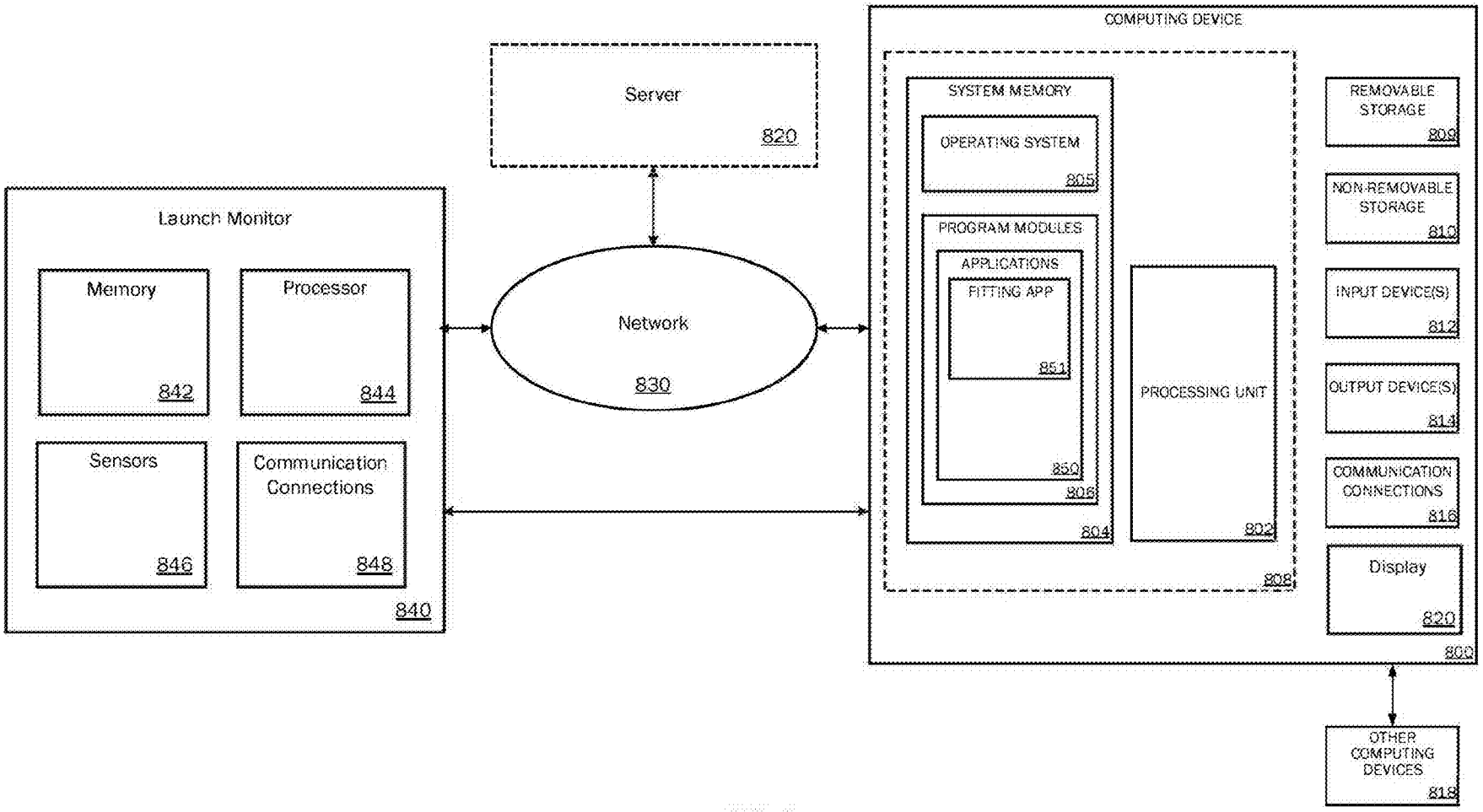
FIG. 8 depicts a block diagram illustrating components of a system for generating a fitting recommendation for a golf club according to an example

FIG. 8 depicts a block diagram illustrating components (e.g., hardware and software) of a system used to generate a fitting recommendation for a golf club according to an example. The system includes a computing device 800 communicatively coupled to a launch monitor 840. The launch monitor 840 may be communicatively coupled to the computing device 800 via a network 830, a wired connection, or a wireless connection, such as a Bluetooth connection. In some embodiments, the launch monitor 840 and the computing device 800 may be integrated as a single device. The launch monitor 840 and/or the computing device 800 may be communicatively coupled to a server 820, for example, via the network 830.

The launch monitor 840 may be used to measure swing analytics and/or ball flight characteristics of a golf club shot and to communicate the measurements to the computing device 800. The launch monitor 840 includes at least one sensor 846 configured to measure the swing analytics and/or ball flight characteristics. For instance, the sensor(s) 846 may include optical sensors that optically track the golf club as it is being swung by the golfer. Radar components may also be utilized as sensors 846 to track at least one of the golf club during the swing or the golf ball flight after it is struck by the golf club. The swing analytics for the golf club may include at least attack angle and/or shaft lean. The ball flight characteristics may include at least golf ball total distance (e.g., golf ball longitudinal distance along the length of the fairway), carry distance, golf ball lateral distance (e.g., golf ball distance from a center line along the width of the fairway), golf ball speed (e.g., golf ball speed after impact with the golf club), golf ball launch angle, golf ball smash factor, and/or spin of a golf ball.

The launch monitor 840 also includes a memory 842, processor 844, and communication connections 848. The processor 844 is configured to control operations of the launch monitor 840. The memory 842 is configured to store, for example, measurements taken by the at least one sensor 846 and software used by the processor 844 to control the operations of the launch monitor 840. For instance, the memory 842 may store operations that when executed by the processor 844 cause the launch monitor 840 to perform the operations described herein. The communication connections 848 are configured to communicate with the network 830 and/or the computing device 800 in any manner described herein. Accordingly, the launch monitor 840 is configured to measure swing analytics and/or ball flight characteristics of a golf club shot using the at least one sensor 846, store the measurements in the memory 842, and communicate the measurements to the computing device 800 by the communication connections 848.

The computing device 800 may be any computing device suitable to be used in a system for generating a fitting recommendation for a golf club as described herein. In some examples, the computing device 800 is a desktop computer, a portable computer, a mobile phone, a tablet, etc.

In a basic configuration, the computing device 800 may include at least one processing unit 802 (e.g., processor) and a system memory 804. Depending on the configuration and type of computing device, the system memory 804 may include, but is not limited to, volatile storage (e.g., random access memory), non-volatile storage (e.g., read-only memory), flash memory, or any combination of such memories. The system memory 804 may include an operating system 805 and one or more program modules 806 suitable for running software applications 850 such as fitting recommendation applications 851. The fitting recommendation application 851 may include instructions that, when executed by the processing unit 802, cause the system to perform operations described herein for generating a fitting recommendation for a golf club. The operating system 805, for example, may be suitable for controlling the operation of the computing device 800. Furthermore, aspects of the invention may be practiced in conjunction with a graphics library, other operating systems, or any other application program and is not limited to any particular application or system. This basic configuration is illustrated in FIG. 8 by those components within a dashed line 808. The computing device 800 may have additional features or functionality. For example, the computing device 800 may also include additional data storage devices (removable and/or non-removable) such as, for example, magnetic disks, optical disks, or tape. Such additional storage is illustrated in FIG. 8 by a removable storage device 809 and a non-removable storage device 810.

As stated above, a number of program modules and data files may be stored in the system memory 804. While executing on the processing unit 802, the program modules 806 may perform processes including, but not limited to, one or more of the stages or operations of the methods described herein. Other program modules that may be used in accordance with examples of the present invention and may include applications such as electronic mail and contacts applications, word processing applications, spreadsheet applications, database applications, slide presentation applications, drawing or computer-aided application programs, etc.

Furthermore, examples of the invention may be practiced in an electrical circuit comprising discrete electronic elements, packaged or integrated electronic chips containing logic gates, a circuit utilizing a microprocessor, or on a single chip containing electronic elements or microprocessors. For example, examples of the invention may be practiced via a system-on-a-chip (SOC) where each or many of the components illustrated in FIG. 8 may be integrated onto a single integrated circuit. Such an SOC device may include one or more processing units, graphics units, communications units, system virtualization units and various application functionality all of which are integrated (or "burned") onto the chip substrate as a single integrated circuit. Examples of the present disclosure may also be practiced using other technologies capable of performing logical operations such as, for example, AND, OR, and NOT, including but not limited to mechanical, optical, fluidic, and quantum technologies. In addition, aspects of the invention may be practiced within a computer or in any other circuits or systems.

The computing device 800 may also have one or more input device(s) 812 such as a keyboard, a mouse, a pen, a sound input device, a touch input device, etc. The computing device 800 includes a display 820 and may also include other output device(s) 814 such as speakers, a printer, etc. The aforementioned devices are examples and others may be used. The computing device 800 may include one or more communication connections 816 allowing communications with other computing devices 818 and/or with the launch monitor 840. For example, the computing device 800 and launch monitor 840 may communicate with each other via the communication connections 816 of the computing device 800 and the communication connections 848 of the launch monitor. Examples of suitable communication connections 816 and 848 include, but are not limited to, RF transmitter, receiver, and/or transceiver circuitry; universal serial bus (USB), parallel, and/or serial ports.

The term computer readable media as used herein may include computer storage media. Computer storage media may include volatile and nonvolatile, removable and non-removable media implemented in any method or technology for storage of information, such as computer readable instructions, data structures, or program modules. The system memory 804, the removable storage device 809, and the non-removable storage device 810 are all computer storage media examples (i.e., memory storage.) Computer storage media may include RAM, ROM, electrically erasable programmable read-only memory (EEPROM), flash memory or other memory technology, CD-ROM, digital versatile disks (DVD) or other optical storage, magnetic cassettes, magnetic tape, magnetic disk storage or other magnetic storage devices, or any other article of manufacture which can be used to store information and which can be accessed by the computing device 800. Any such computer storage media may be part of the computing device 800. Computer storage media does not include a carrier wave or other propagated data signal.

Communication media may be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media.

Methods for generating a fitting recommendation will now be described with reference to FIGS. 8-16B. The methods may be implemented or performed by the system illustrated and described with reference to FIG. 8. The systems and methods described herein for generating a fitting recommendation may be used indoors or outdoors.

Figure 9:
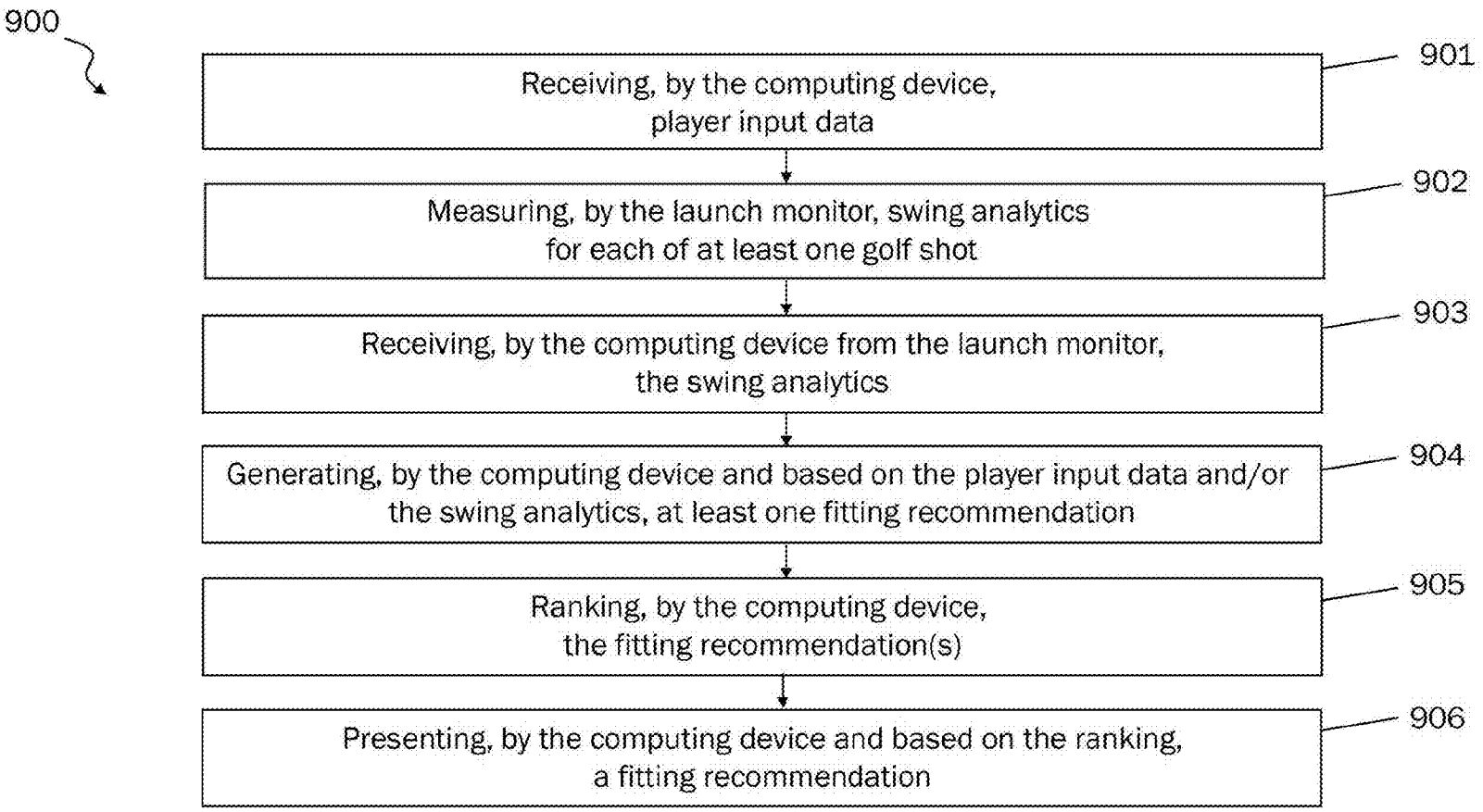
FIG. 9 depicts an example method for generating a fitting recommendation for a golf club.

FIG. 9 depicts operations of a computer-implemented method 900 for generating a fitting recommendation for a golf club according to an example. The fitting recommendation may include a bounce and/or a grind for the golf club and may be generated by the computing device 800 based on a combination of player input data and swing analytics of one or more golf club shots measured by the launch monitor 840 and received by the computing device 800.

At operation 901, player input data is received. For instance, the player input data may be received by the computing device 800. The player input data may include information such as the loft of a player's pitching wedge, what the highest loft the player would like to play at, what the player's handicap is, what the player's confidence is in hitting out of the bunker, what the conditions are of a golf course (e.g., softness or firmness, a grass type, etc. at a golf course that the player intends to play at), and/or what the conditions are of bunkers (e.g., sand softness of firmness, sand type, etc. of the bunkers in the golf course that the player intends to play at). The player input data is not limited to combinations of the above-listed items of information, and other items of information may also be included in the player input data with or without the above-described items of information. The swing analytics may include at least attack angle and/or shaft lean (e.g., only attack angle, only shaft lean, or attack angle and shaft lean), but the present disclosure is not limited thereto.

At operation 902, when at least one golf shot is hit, swing analytics for each of the at least one golf shot are measured by the launch monitor 840. The golf shots are hit by a player and may be hit with a plurality of different golf clubs having the same or different lofts. The golf shots may be of the same or different shot types, such as a full swing shot, a pitch, a partial swing shot (e.g., a shot between a full swing shot and a pitch), a chip, a greenside shot (e.g., an about 20 yard pitch shot), a bunker shot, and/or an open-face shot.

At operation 903, the measured swing analytics are received. For instance, the measured swing analytics may be received by the computing device 800 from the launch monitor 840.

At operation 904, at least one fitting recommendation is generated based on the received swing analytics and/or the player input data. The fitting recommendation(s) may be generated by the computing device 800. Each fitting recommendation may include a bounce and/or grind of a golf club having a particular loft. For example, the computing device 800 may generate, for a golf club having a 56 degree loft, a first fitting recommendation including a 10 degree bounce and an S-grind sole, a second fitting recommendation having an 8 degree bounce and an M-grind sole, and a third fitting recommendation including a 12 degree bounce and a D-grind sole.

At operation 905, the computing device 800 ranks, based on the player input data and/or the swing analytics, the fitting recommendation(s), generated in operation 904, from most recommended to least recommended. For example, of the first to third fitting recommendations for the 56 degree loft described above, the computing device 800 may rank the first recommendation as the most recommended, the third recommendation as the least recommended, and the second recommendation between the first and third fitting recommendations.

At operation 906, a fitting recommendation is presented. For instance, the computing device 800 may present the fitting recommendation on the display 820. The presented fitting recommendation may be based on the ranking performed in operation 904. For example, among the first to third fitting recommendations for the 56 degree loft described above, the computing device 800 may provide as its ultimate fitting recommendation the first fitting recommendation, which it ranked as the most recommended. In other examples, more than one fitting recommendation may be presented, and the fitting recommendations may be presented in their ranked order.

The method 900 described with reference to FIG. 9 is a non-limiting example, and the present disclosure is not limited thereto. For example, although operation 901 is described as occurring before operation 902, the present disclosure is not limited thereto, and the chronological order of these operations may be reversed in some examples. That is, the at least one golf shot may be hit, and the launch monitor 840 may measure swing analytics of the at least one golf shot, prior to receiving the player input data. Also, although operations 904 and 905 are described as separate operations in the example of FIG. 9, these operations may occur concurrently or simultaneously, for example, as a single operation.

Figure 10:
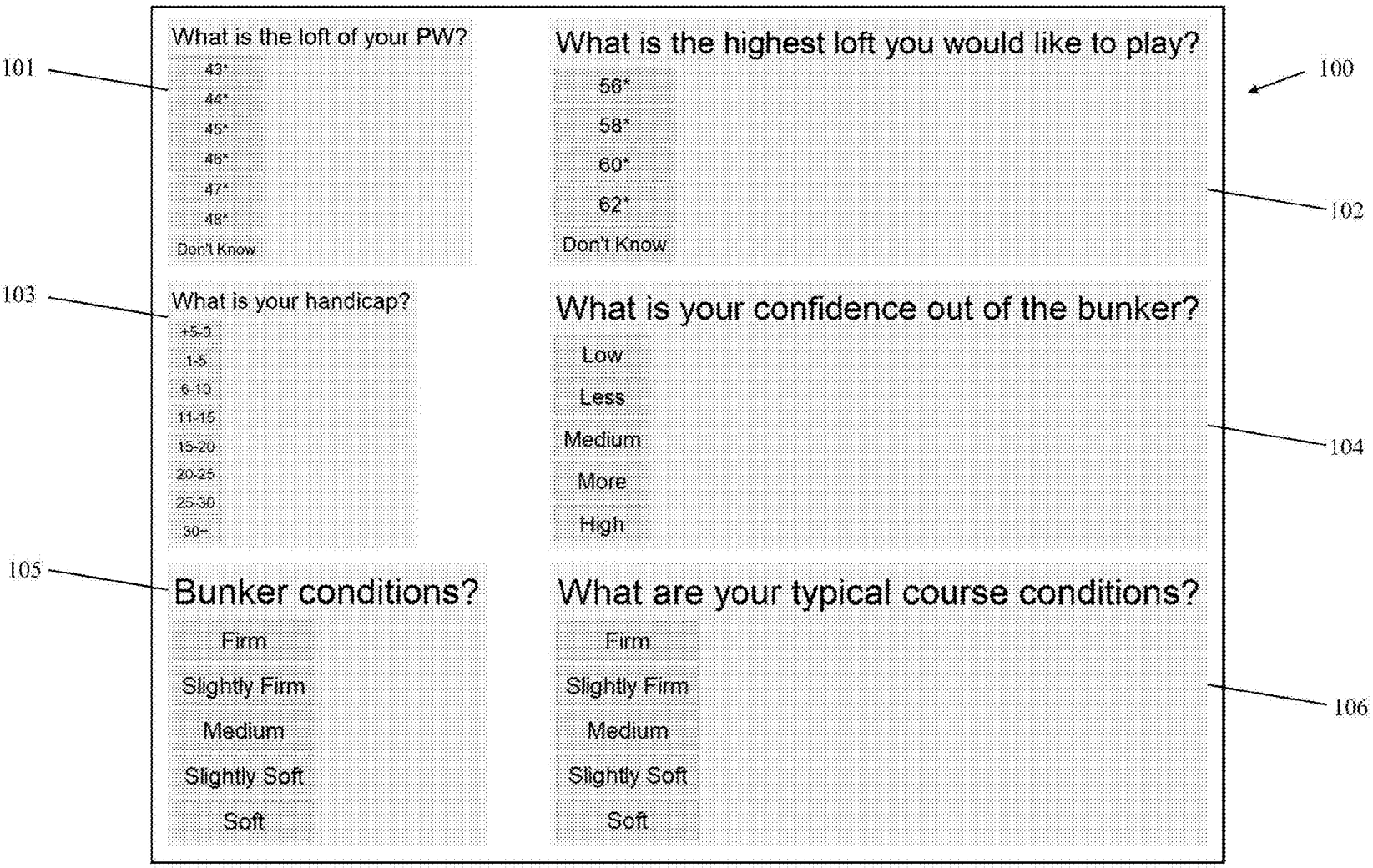
FIG. 10 depicts a first user interface according to an example.
Figure 11:
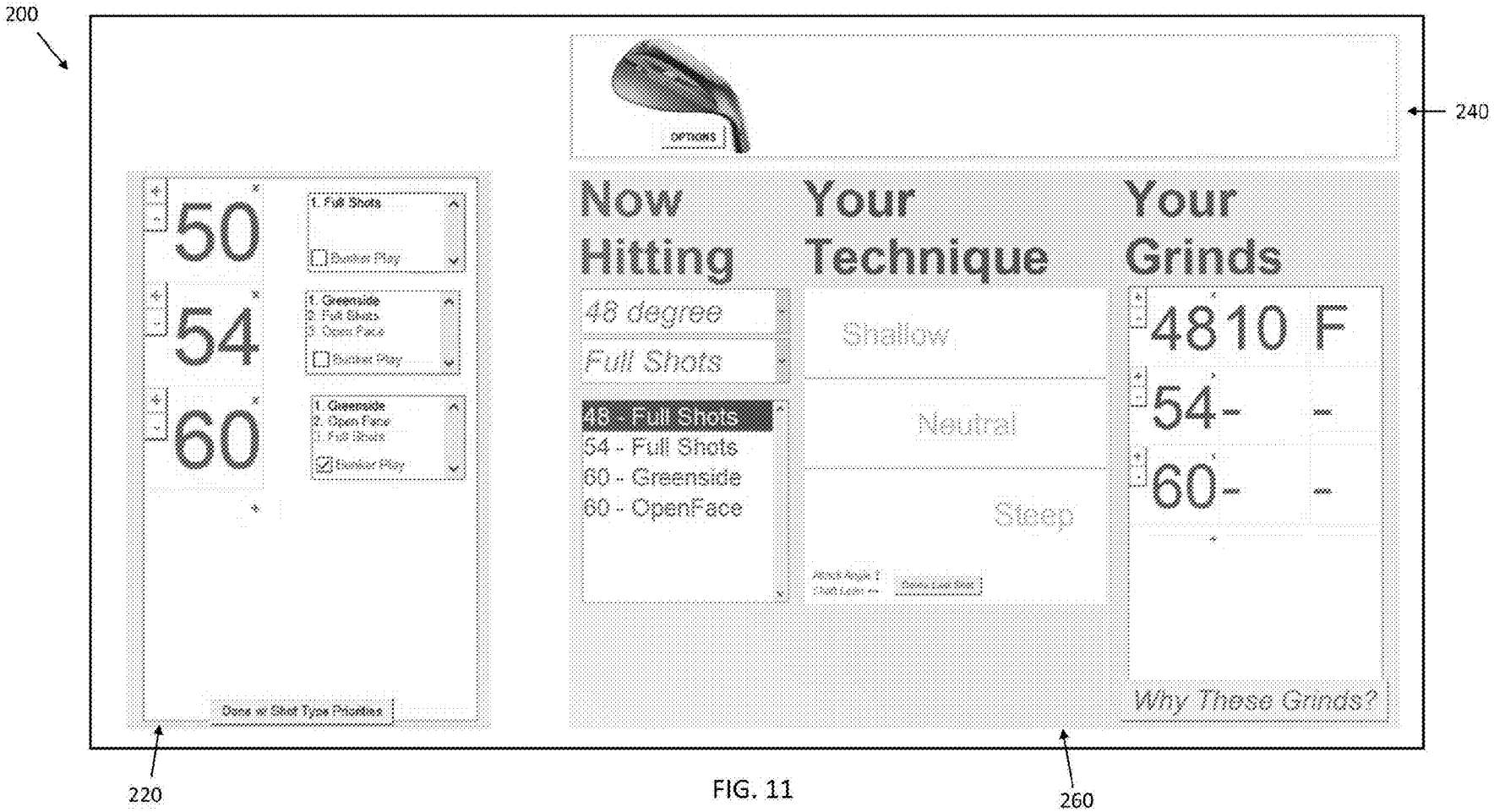
FIG. 11 depicts a second user interface according to an example.
Figure 12:
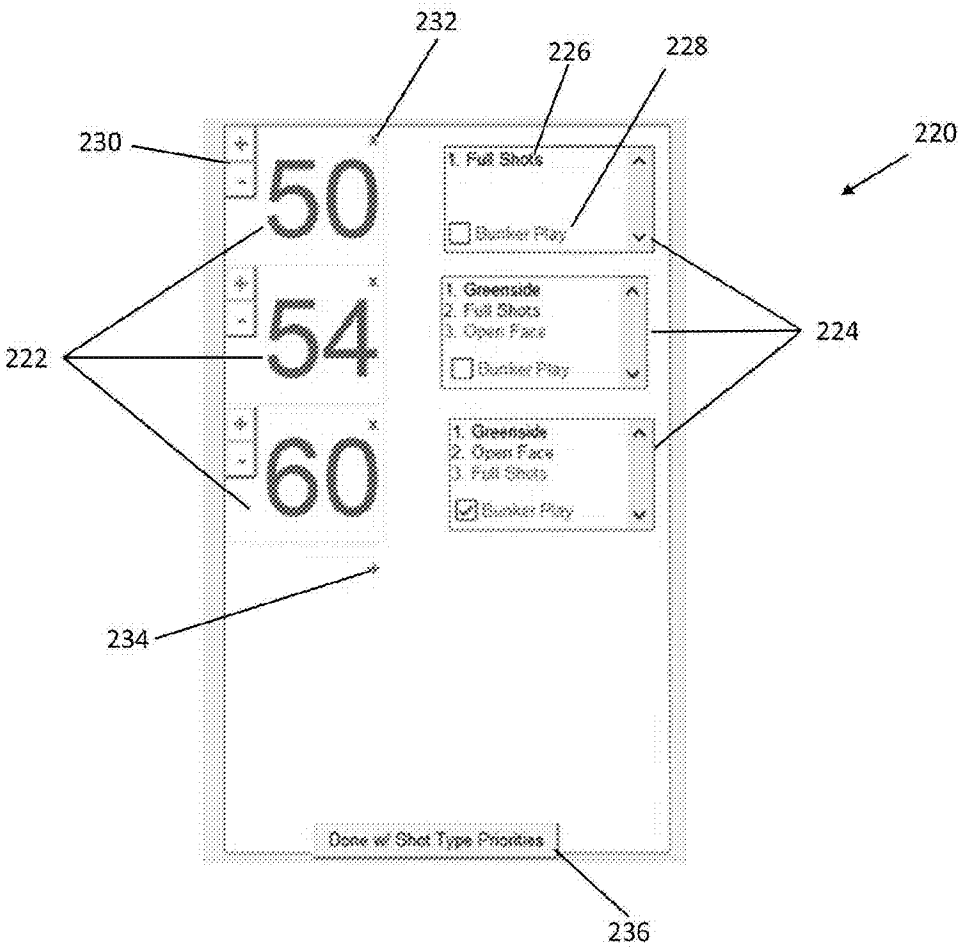
FIG. 12 depicts a golf shot prompt of the second user interface of FIG. 11.
Figure 14:
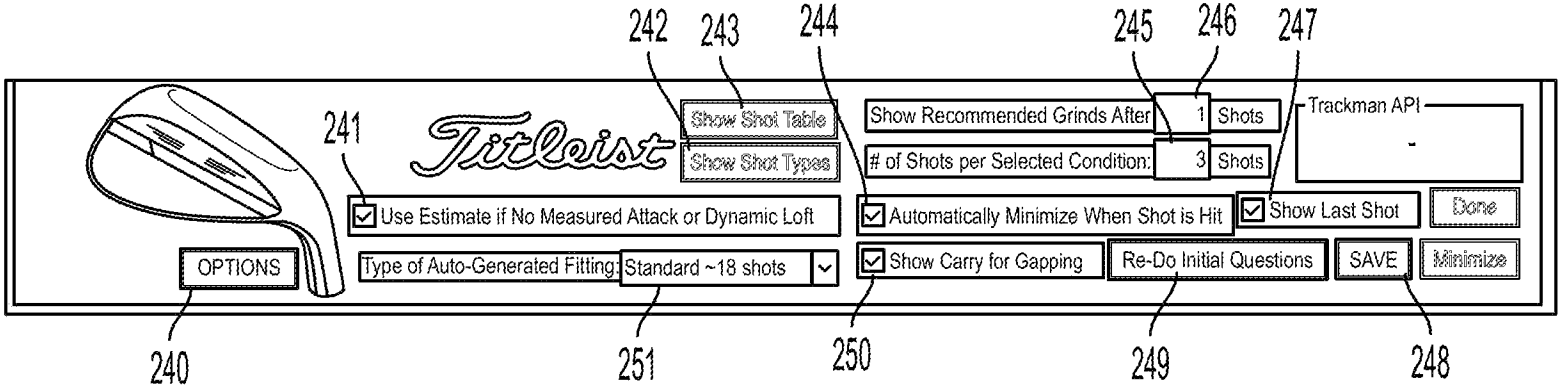
FIG. 14 depicts a top portion of the golf shot analysis segment of FIGS. 13A-13E when a plurality of options are displayed.
Figure 15:
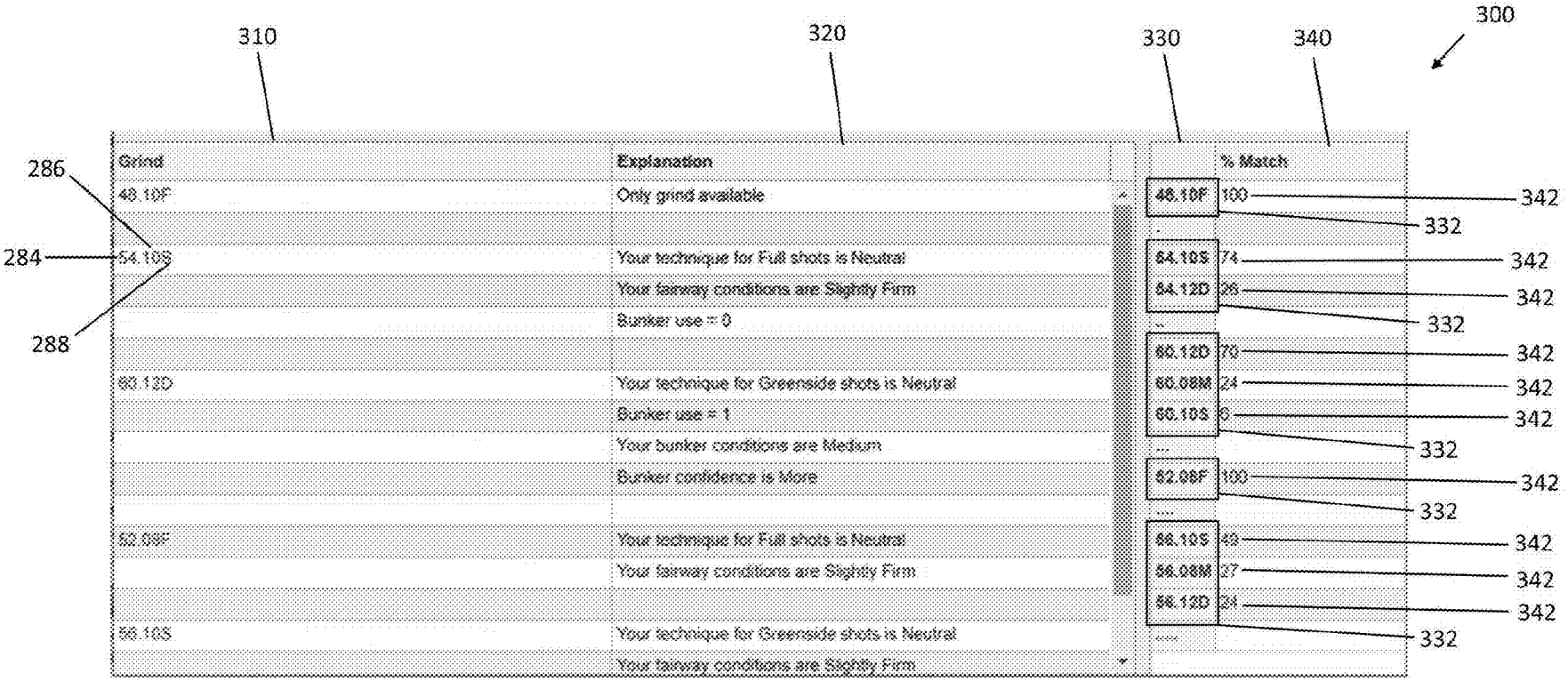
FIG. 15 depicts a third user interface according to an example.

Additional details about fitting recommendations according to examples of the present disclosure will be described with reference to the first, second, and third user interfaces illustrated and described with reference to FIGS. 10-15. FIG. 10 depicts a first user interface according to an example. FIG. 11 depicts a second user interface according to an example. FIG. 12 depicts a golf shot prompt of the second user interface of FIG. 11. FIGS. 13A-13E depict a golf shot analysis segment of the second user interface of FIG. 11 at different stages of hitting golf shots. FIG. 14 depicts a top portion of the golf shot analysis segment of FIGS. 13A-13E when a plurality of options are displayed. FIG. 15 depicts a third user interface according to an example. As described herein, controllable features of the first, second, and third user interfaces 100, 200, and 300, may be controlled by any suitable means, such as input devices including a keyboard, a mouse, a pen, a sound input device, and/or a touch input device (e.g., touchscreen), etc. The controllable features of the first, second, and third user interfaces 100, 200, and 300 may be controlled, for example, by a golfer or a professional fitter using the system to obtain a fitting recommendation for the golfer.

Referring to FIG. 10, first user interface 100 may be used to receive, by the computing device 800, player input data. The first user interface 100 may include one or more input fields, and the computing device 800 is configured to receive the player input data as input into the one or more input fields of the first user interface 100. The input fields include a first input field 101 for receiving information about a player's pitching wedge loft, a second input field 102 for receiving information about a highest loft that the player would like to play, a third input field 103 for receiving the player's handicap, a fourth input field 104 for receiving information about the player's confidence in hitting out of a bunker, a fifth input field 105 for receiving information about bunker conditions in one or more course (e.g., typical bunker conditions) that the player intends to play, and a sixth input field 106 for receiving information about conditions for one or more courses or fairways (e.g., typical course conditions) that the player intends to play.

Each of the input fields 101-106 may include different selectable values for the user to provide the player input data, as shown in the example first user interface 100 of FIG. 10. For instance, for the first input field 101, a selection of any of the 43, 44, 45, 46, 47, 48, or "Don't Know" selectable options results in the corresponding player input data being received and stored by the system. In other examples, the input fields 101-106 may include an input box that can receive freeform text or numbers to provide the player input data.

In some examples, the first user interface 100 is configured so that the input fields of the first user interface 100 are all displayed simultaneously on the display 820. In other examples, the first user interface 100 is configured so that the input fields of the first user interface 100 are sequentially displayed. For example, the first user interface 100 may be configured so that the first input field 101 is displayed and, after input is received into the first input field 101, the second input field 102 is displayed and, after input is received into the second input field 102, the third input field 103 is displayed, etc.

In some examples, the first user interface 100 is configured to allow selection of one or more of the input fields to be displayed on the display 820. For example, the first user interface 100 may display a plurality of selectable tabs corresponding to the input fields of the first user interface 100, and the first user interface 100 may be configured, upon the computing device 800 receiving selection of one of the selectable tabs, to display the input field corresponding to the selected tab. Accordingly, a person entering the player input data may select and enter input into the input fields of the first user interface 100 in any desired order, and the person may be able to return to an input field that previously received input and input new information into that input field.

Referring to FIG. 11, the second user interface 200 includes a golf shot prompt 220 and a golf shot analysis segment 260. The second user interface 200 may be displayed while at least one golf shot is hit and swing analytics thereof are measured by the launch monitor 840.

Referring to FIG. 12, the golf shot prompt 220 allows for the golf shots that are to be hit to be defined. The golf shot prompt 220 includes one or more lofts 222 for different golf clubs to be hit and a corresponding shot type control menu 224 for each of the lofts 222. The lofts 222 may define which lofts are to be used when hitting the golf shots. Each of the shot type control menus 224 includes a list of one or more shot types 226 and a selectable bunker play option 228.

The shot types 226 included in each of the shot type control menus 224 may identify what type the golf shots may be used when hitting golf shots with the corresponding loft 222. In some examples, shot type control menu 224 is configured to be controlled to add or delete shot types 226, or to rearrange a priority of the shot types 226. The shot types 226 may be prioritized, for example, according to a player's most preferred to least preferred type of shot used with the corresponding loft 222. The bunker play option 228 is selectable to indicate that the corresponding loft may be, or is intended to be, used for bunker shots. Upon receiving a selection of the bunker play option 228 by the computing device 800, the bunker play option 228 may display a checked box. Upon receiving a deselection of the bunker play option 228 by the computing device 800, the bunker play option 228 may display an unchecked box.

A corresponding loft control 230 is included in the golf shot prompt 220 for each of the lofts 222 and is configured to be controllable or changeable to adjust the value of the corresponding loft 222. For example, the loft control 230 may include two selectable elements: one labeled with a "+" symbol and configured to increase the displayed loft 222 upon the computing device 800 receiving a selection of the + element, and another one labeled with a "–" symbol and configured to decrease the displayed loft 222 upon the computing device 800 receiving a selection of the – element.

The golf shot prompt 220 is configured to be controllable or adjustable to remove or add lofts 222. For example, the golf shot prompt 220 includes a selectable removal button 232 for each of the displayed lofts 222 configured, upon the computing device 800 receiving a selection of the removal button 232, to remove the corresponding loft 222. The golf shot prompt 220 also includes a selectable addition button 234 configured, upon the computing device 800 receiving a selection of the addition button 234, to add a golf club with a new loft 222.

Accordingly, the golf shot prompt 220 may be configured so that the number of lofts 222, the value of each of the lofts 222, and the corresponding shot types 226 are controllable or adjustable. However, the golf shot prompt 220 may also be configured to provide an initial recommendation of the lofts 222 and of the corresponding shot types 226. In some examples, the golf shot prompt 220 may provide a standard or default recommendation of lofts 222 and corresponding shot types 226 based on, for example, hierarchical data stored into the computing device 800 or obtained from the server 820. In some other examples, the golf shot prompt 220 may provide a recommendation of the lofts 222 and corresponding shot types 226 based on the player input data. For example, the recommendation may be based on the data input into the first input field 101 (i.e., the loft of the player's pitching wedge) and the second input field 102 (i.e., the highest loft that the player would like to play with). As a non-limiting example, if the data input into the first input field 101 is a pitching wedge loft of 48, and the data input into the second input field 102 is a highest loft of 60, the golf shot prompt 220 may provide an initial gapping recommendation for the lofts 222 of 48, 52, 56, and 60. In some examples, the golf shot prompt 220 is not configured to provide an initial recommendation, but rather initially provides no lofts 222 and allows for addition of lofts through user interaction with the golf shot prompt 220.

The golf shot prompt 220 includes a selectable conclusion button 236, which is labeled "Done w/ Shot Type Priorities" in the example shown in FIG. 12. The conclusion button 236 is configured, upon the computing device 800 receiving selection of the conclusion button 236, to cause the golf shot analysis segment 260 to be displayed. The golf shot prompt 220 may then either cease to be displayed or may continue to be displayed.

Figure 13A:
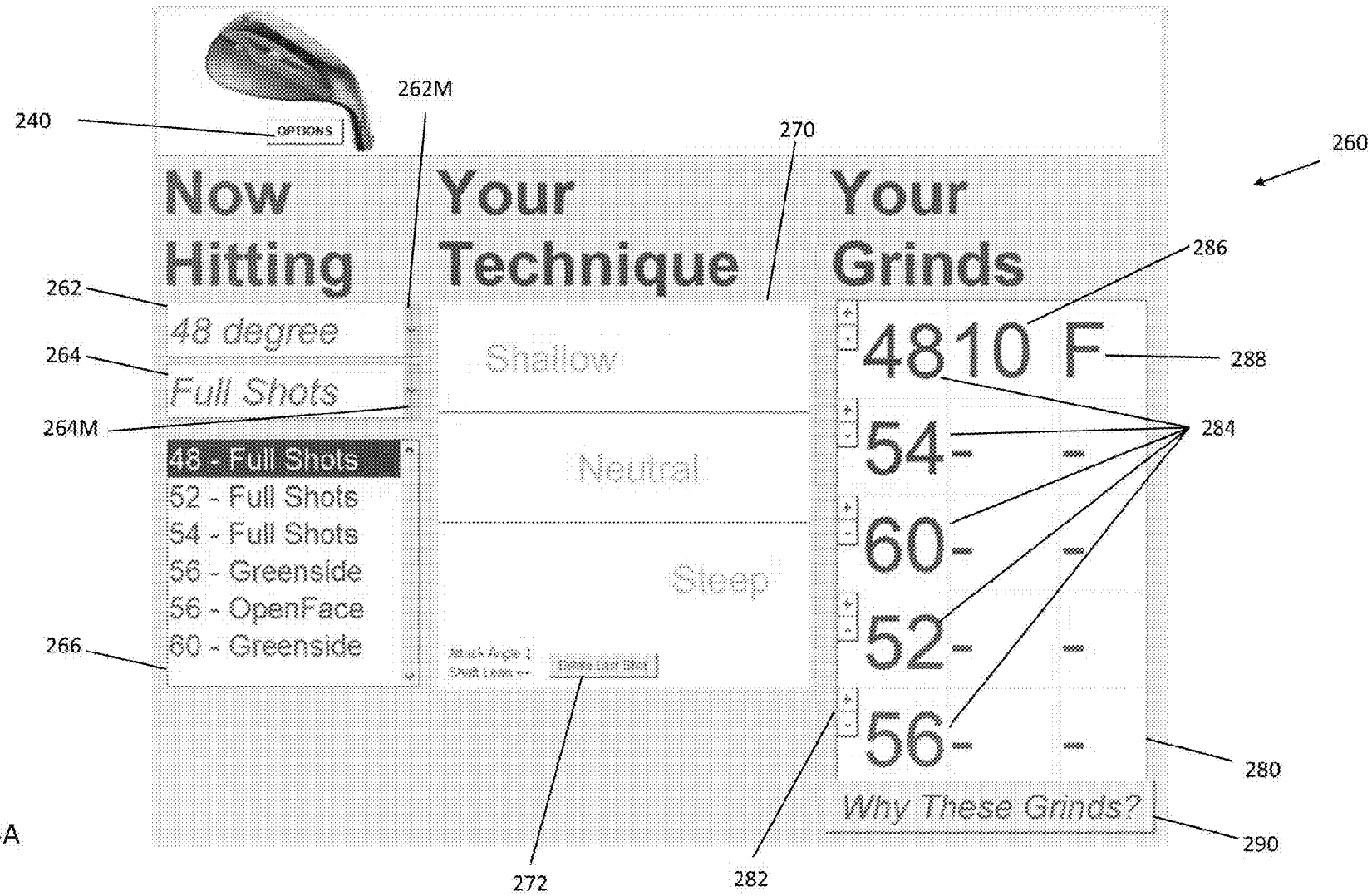
FIGS. 13A-13E depict a golf shot analysis segment of the second user interface of FIG. 11 at different stages of hitting golf shots.

FIG. 13A depicts the golf shot analysis segment 260 before any golf shots have been hit, and FIGS. 13B-13E depict the golf shot analysis segment 260 after one or more golf shots have been hit. Referring to FIGS. 13A-13E, the golf shot analysis segment 260 includes a current golf shot loft indicator 262, a current shot type indicator 264, a graphical technique representation 270, and a fitting recommendation representation 280. The current golf shot loft indicator 262 represents the loft of the next golf club that is to be used to hit a current golf shot. The current shot type indicator 264 represents the shot type that the current golf shot is to be hit by the golfer. Accordingly, the golfer can see which club the golfer should be hitting and the type of golf shot that the golfer should be hitting. The graphical technique representation 270 represents swing analytics of golf shots received by the computing device 800. The fitting recommendation representation represents a fitting recommendation for one or more golf clubs generated by the computing device 800.

The current golf shot loft indicator 262 may have a selectable pull down bar 262M configured, upon the computing device receiving selection of the pull down bar 262M, to cause a loft selection menu to be displayed. The loft selection menu may display one or more selectable lofts that, upon the computing device 800 receiving a selection of one of the lofts, will define the value of the current golf shot loft indicator 262 as the selected loft. However, examples of the present disclosure are not limited thereto, and the current golf shot loft indicator 262 may be controllable in other ways to allow the value of the current golf shot loft indicator 262 to be defined. Similarly, the current shot type indicator 264 may have a selectable pull down bar 264M configured, upon the computing device 800 receiving a selection of the pull down bar 264M, to cause a shot type selection menu to be displayed, such as a drop-down menu below the current shot type indicator 264. The shot type selection menu may display one or more selectable shot types that, upon the computing device 800 receiving selection of one of the shot types, will define the current shot type indicator 264 as the selected shot type. However, examples of the present disclosure are not limited thereto, and the current shot type indicator 264 may be controllable in other ways to allow the value of the current shot type indicator 264 to be defined. Because the launch monitor 840 may not be configured to determine what loft and shot type the golf shot being measured has, it may be important for the computing device 800 to correctly identify what loft and shot type are currently being used. For example, the computing device 800 may base its fitting recommendation not only on the swing analytics of a golf shot, but also on the loft and shot type of the golf shot. Accordingly, the computing device 800 may generate an inaccurate fitting recommendation when the loft and/or shot type of a golf shot is not correctly identified.

The golf shot analysis segment 260 includes a golf shot selection menu 266 including one or more combinations of a loft and a corresponding shot type. In FIGS. 13A-13E, the golf shot selection menu 266 includes six lofts-48, 52, 54, 56, 56, and 60 degrees from top to bottom—and six corresponding shot types—full shots, full shots, full shots, greenside, open face, and greenside from top to bottom. Each combination of loft and shot type in the golf shot selection menu 266 is selectable such that, upon the computing device 800 receiving selection of the combination, the current golf shot loft indicator 262 and the current shot type indicator 264 are respectively defined to be the loft and shot type of the selected combination. Accordingly, the golf shot selection menu 266 may provide a convenient way for a user of the computing device 800 to define the current golf shot loft indicator 262 and the current shot type indicator 264. Thus, when the swing analytics and/or ball flight data is received for the particular swing, the computing device 800 is aware of the golf club being used and the swing type being made, which allows for correlation of the swing analytics and/or ball flight data with the correct golf club and swing type.

In some examples, the combinations displayed in the golf shot selection menu 266 may correspond to the lofts 222 and corresponding shot types 226 of the golf shot prompt 220. In some other examples, the golf shot selection menu 266 may provide a standard or default recommendation of combinations of lofts and corresponding shot types based on, for example, hierarchical data stored in the computing device 800. In some examples, the golf shot selection UI element or menu 266 is configured to be adjustable to add combinations, remove combinations, and/or adjust the loft and/or shot type of the combinations. For example, the second user interface 200 may include a selectable golf shot prompt element configured to, upon the computing device 800 receiving selection thereof, to display the golf shot prompt 220 to allow the golf shot prompt 220 to be updated and, thereby, allow the golf shot selection menu 266 to also be updated.

In some examples, the swing analytics of golf shots measured by the launch monitor 840 include at least: (1) attack angle and (2) shaft lean, and the graphical technique representation 270 is a graph having a first axis representing attack angle and a second axis representing shaft lean. However, examples of the present disclosure are not limited thereto. For example, the swing analytics of the golf shots measured by the launch monitor 840 may include only attack angle or only shaft lean, and the graphical technique representation 270 may respectively graphically represent only attack angle or only shaft lean in any suitable manner (e.g., numerically, via a bar diagram, via a one-dimensional graph, etc.) Attack angle is the vertical direction of the club head's geometric center movement at maximum compression of the golf ball. Attack angle is measured relative to the horizon. Shaft lean is a measure of how far forward (e.g., towards the target) or backward the shaft of the golf club leans at maximum compression of the golf ball. The shaft lean is measured from vertical and may be measured as angle between the shaft and the vertical angle. A forward shaft lean has a positive angle value and the backward shaft lean has a negative angle value. Additional or alternative types of swing analytics may also be used with the present technology, such as dynamic loft or other types of measurements of the golf club as it is being swung. Dynamic loft is the amount of loft on the club face at impact and is measured relative to the horizon at maximum compression of the golf ball. Additional discussion of swing analytics examples is provided below with reference to FIGS. 17-20.

As shown in the example of FIG. 13A, in the graph of the graphical technique representation 270, the first axis representing the attack angle is a vertical axis and the second axis representing the shaft lean is a horizontal axis. The graphical technique representation 270 may be illustrated as divided into sections or bands characterizing the swing analytics of the golf shots. For example, as shown in FIG. 13A, the graphical technique representation 270 is divided into an upper region characterizing swing analytics falling in this region as "shallow", a middle region characterizing swing analytics falling in this region as "neutral", and a lower region characterizing swing analytics falling in this region as "steep". In some examples, the computing device 800 may generate its fitting recommendation based in part on the characterization of the swing analytics. While the graphical technique representation 270 is shown as a graph in this example, other visual representations for representing two or more swing analytics may be used.

As shown in FIGS. 13B-13E, as swing analytics for one or more golf shots are measured by the launch monitor 840 and received by the computing device 800, one or more shot indicators 274 are displayed on the graphical technique representation 270 to represent the swing analytics of corresponding group of shots. For example, each of the shot indicators 274 may represent the technique of golf shots of a same shot type. In some examples, each of the shot indicators 274 may represent the technique of golf shots of a same loft. In some other examples, each of the shot indicators 274 represents the technique of golf shots of both the same shot type and the same loft. In some examples, a single shot indicator 274 may be used to represent the swing analytics of all golf shots.

The shot indicator 274 may include any suitable graphic, image, symbol, etc. For example, the shot indicators 274 may include geometric shapes, such as circles, squares, etc. In some examples, the shot indicator 274 may include text, for example, to indicate what group of golf shots the shot indicator 274 corresponds to, how many golf shots are in the corresponding group of golf shots, etc. A size of the shot indicator 274 may represent how many golf shots are in the corresponding group of golf shots. For example, as golf shots of the corresponding group are hit, the size of the shot indicator 274 may decrease, and thus, the size (e.g., smallness) of the shot indicator 274 may correspond to how many golf shots of the corresponding group have been hit.

A position of each of the shot indicators 274 (e.g., a position of a center of the shot indicators 274) in the graphical technique representation 270 may represent a statistical value of the swing analytics of the golf shots of the corresponding group of golf shots, such as an average value or medium value. Each of the shot indicators 274 may be updated after swing analytics of each golf shot of the corresponding group of golf shots are received by the computing device 800.

Figure 13B:
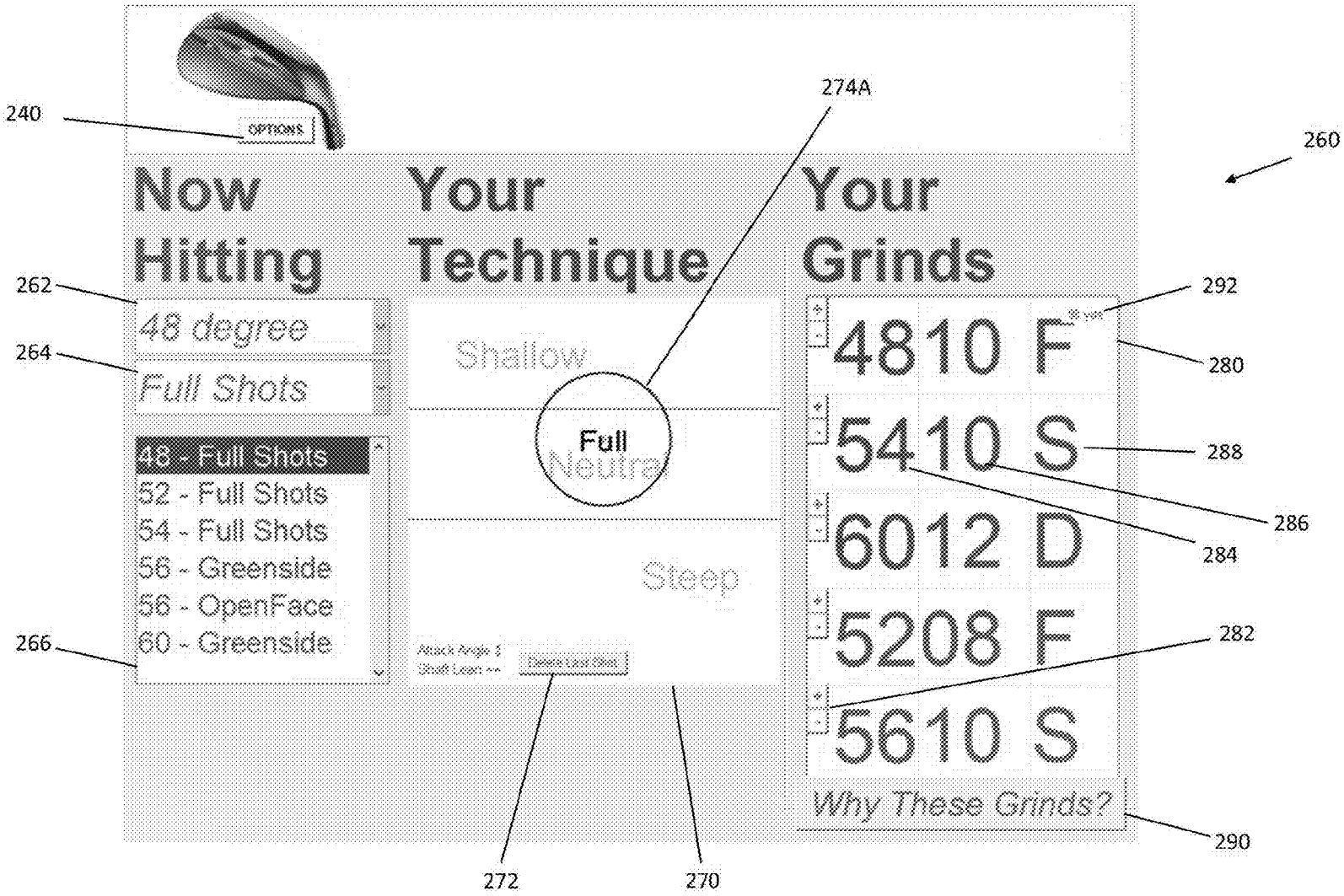

FIG. 13B depicts the golf shot analysis segment 260 after a first golf shot of a full swing type is hit. When the first golf shot of the full swing type is hit, a first shot indicator 274A corresponding to a full swing shot type is displayed in the graphical technique representation 270. In the example depicted, the first shot indicator 274A includes a circle with the word "Full" in the middle to indicate that the shot type is a "Full": shot type. The position of the first shot indicator 274A (e.g., the center of the circle) corresponds to an attack angle and shaft lean of the first golf shot of the full swing type.

Figure 13C:
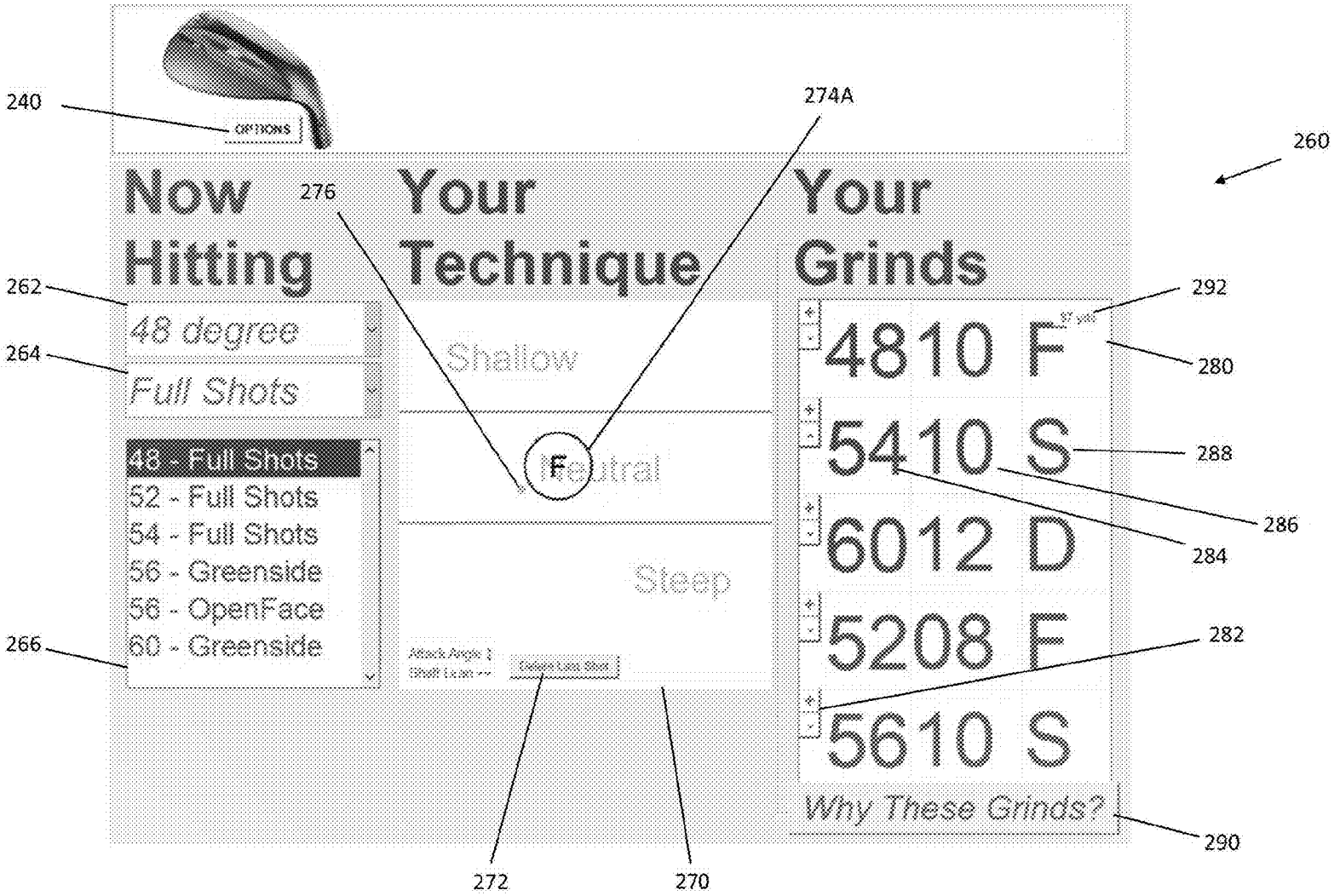

FIG. 13C depicts the golf shot analysis segment 260 after a second golf shot of the full swing type is hit. When the second golf shot of the full swing type with the same golf club is hit, the size and position of the first shot indicator 274A is updated. For example, a diameter of the circle included in the first shot indicator 274A is reduced, the text inside the circle included in the first shot indicator 274A is changed to "F" (short for "Full"), and the position of the center of the circle is shifted to point on the graphical technique representation 270 corresponding to an average attack angle of the first and second golf shots of the full swing type and to an average shaft lean of the first and second golf shots of the full swing type.

As shown in FIG. 13C, the graphical technique representation 270 may include a current shot indicator 276 that indicates the swing analytics of the most recent golf shot received by the computing device 800. Accordingly, in FIG. 13C, the current shot indicator 276 is positioned at the attack angle and shaft lean of the second golf shot of the full swing type. The current shot indicator 276 may include any suitable graphic, image, symbol, etc. In FIG. 13C, the current shot indicator 276 is illustrated as a dot or filled circle. The current shot indicator 276 helps a user of the computing device 800 determine whether their most recent golf shot is an outlier that, for example, significantly diverges from the earlier golf shots, and thus, should be deleted to avoid unduly affecting the graphical technique representation 270 and the fitting recommendation.

In some examples, the golf shot analysis segment 260 includes a delete shot button 272 configured to, upon the computing device 800 receiving a selection thereof, to cause the computing device 800 to update the graphical technique representation (including the shot indicators 274) without consideration of the swing analytics of the most recent shot, and/or to update the fitting recommendation without consideration of the swing analytics of the most recent shot. This may be achieved by the computing device 800 deleting information stored in the computing device 800 relating to the swing analytics of the most recent shot. For example, if the delete shot button 272 was selected after the second golf shot of the full swing type was hit, as shown in FIG. 13C, the graphical technique representation 270 may be updated based on only the swing analytics of the first golf shot of the full swing type, as shown in FIG. 13B.

Figure 13D:
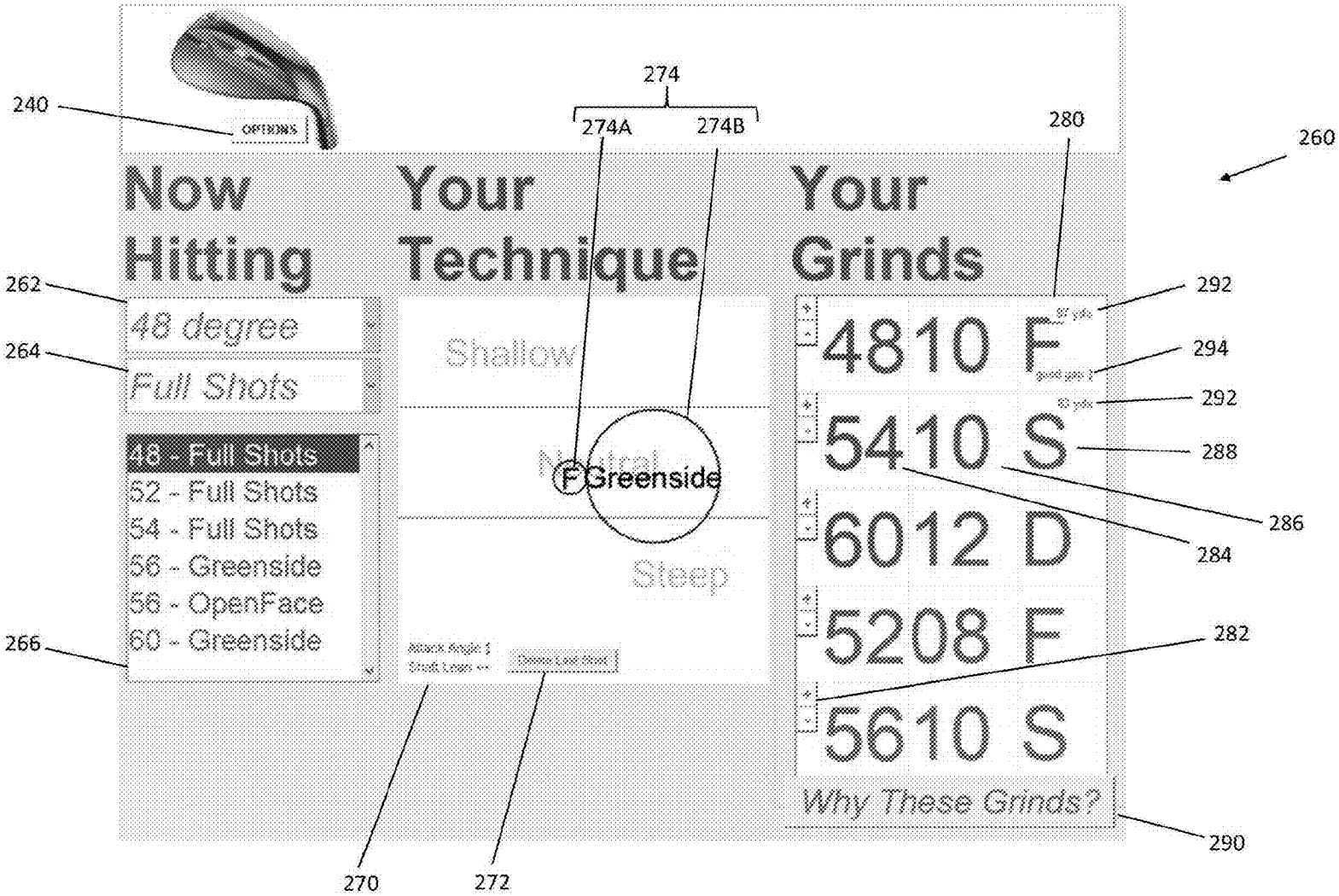

FIG. 13D depicts the golf shot analysis segment 260 after several golf shots of the full swing type have been hit and after a first golf shot of a greenside type has been hit as a most recent golf shot having swing analytics received by the computing device 800. After the first golf shot of the greenside type is hit, a second shot indicator 274B is depicted in the graphical technique representation 270. The second shot indicator 274B includes a circle and the text, "Greenside", in the middle of the circle. A position of the center of the circle of the second shot indicator 274B corresponds to the attack angle and shaft lean of the first golf shot of the greenside type.

Figure 13E:
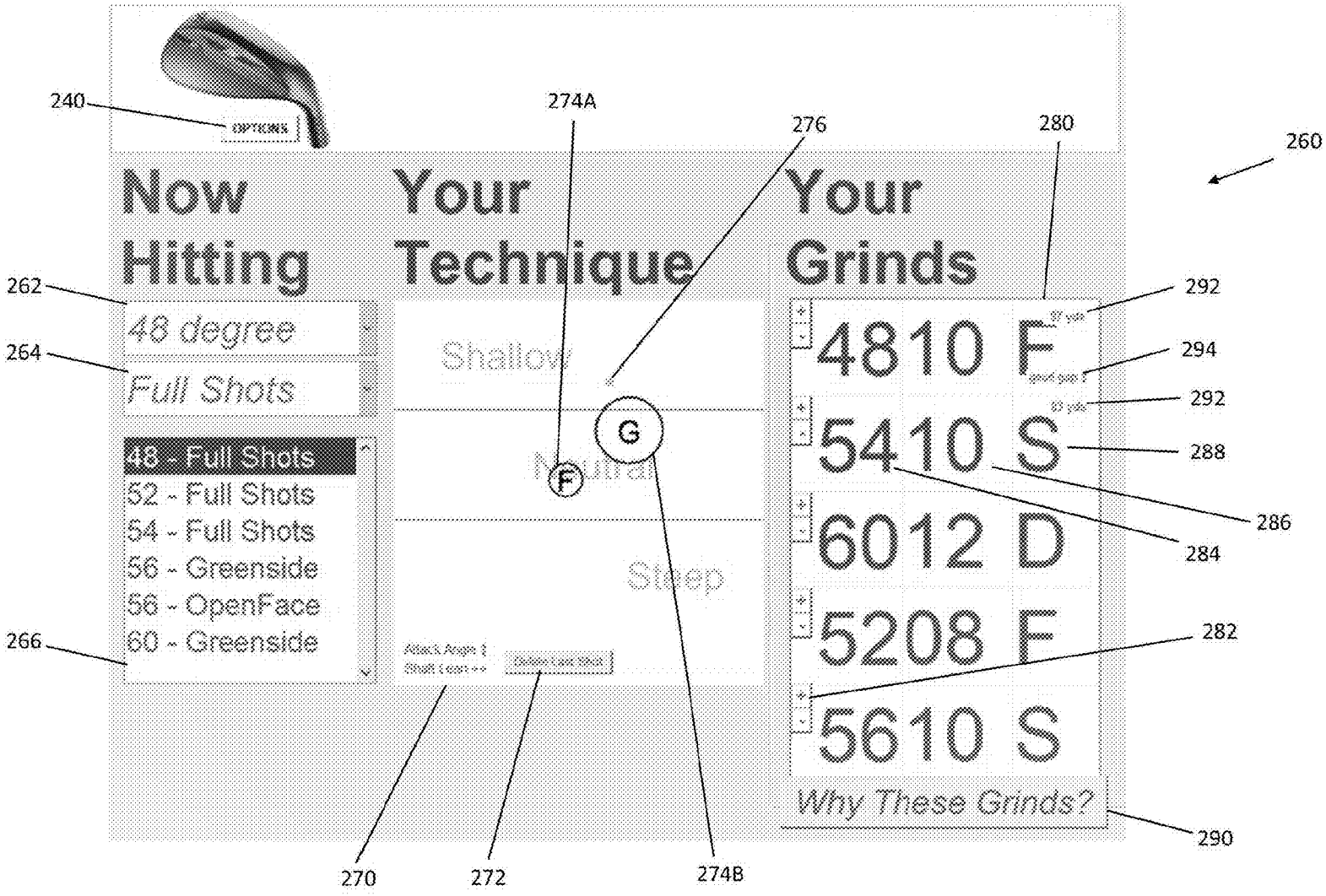

FIG. 13E depicts the golf shot analysis segment 260 after a second golf shot of the greenside type is hit. When the second golf shot of the greenside type is hit, the second shot indicator 274B is updated so that a diameter of the circle is reduced, the text inside the circle is changed to "G" (short for "Greenside"), and the position of the center of the circle is shifted to a point on the graphical technique representation 270 corresponding to an average attack angle of the first and second golf shots of the greenside type and to an average shaft lean of the first and second golf shots of the greenside type.

The graphical technique representation 270 is useful for, among other reasons, a player hitting the golf shots to understand their golf technique (e.g., swing analytics) for different types of shots, for different lofts, and/or for different types of shots of the same loft.

The fitting recommendation representation 280 includes one or more lofts 284, and each of the lofts 284 includes a corresponding fitting recommendation including a recommended bounce 286 and/or grind 288 for the loft 284. The computing device 800 generates one or more fitting recommendations for a corresponding loft based at least in part on the player input data and/or the swing analytics of one or more golf shots measured by the launch monitor 840 and received by the computing device 800. In some examples, the computing device 800 may generate the fitting recommendations further based at least in part on ball flight characteristics of the golf shots.

In some examples, the fitting recommendations corresponding to a loft is based at least in part on the swing analytics of all of the golf shots measured by the launch monitor 840. In other examples, the fitting recommendation corresponding to the loft is based at least in part on the swing analytics of a subset of all of the golf shots, for example, all golf shots hit with a golf club having the corresponding loft. The fitting recommendations corresponding to the loft may be based on all of the swing analytics of one or more golf shots, such as both attack angle and shaft lean, or the fitting recommendation may be based on only some of the swing analytics of the one or more golf shots, such as only attack angle or only shaft lean.

In some examples, the lofts 284 included in the fitting recommendation representation 280 are the same as the lofts included in the golf shot selection menu 266 and/or in the golf shot prompt 220. As shown in FIGS. 13A-13E, the lofts included in the fitting recommendation representation 280 include, from top to bottom, lofts of 48 degrees, 54 degrees, 60 degrees, 52 degrees, and 56 degrees.

In FIG. 13A, a fitting recommendation including a bounce of 10 degrees and an F-grind is provided for the loft of 48 degrees, even though swing analytics have not been received by the computing device 800 for any golf shots. This is because, in this example, the generation of the fitting recommendation for the 48 degree loft is not based on swing analytics. For example, the generation of the fitting recommendation for the 48 degree loft may be based only on player input data, or only one possible fitting recommendation may be available for a 48 degree loft. In FIG. 13A, fitting recommendations for the remaining lofts of 54 degrees, 60 degrees, 52 degrees, and 56 degrees are not provided because, in this example, the generation of the fitting recommendations corresponding to these lofts depends at least in part on swing analytics of one or more golf shots.

In FIG. 13B, after the first golf shot of the full swing type is hit, a recommendation is generated for each of the remaining lofts of 54 degrees, 60 degrees, 52 degrees, and 56 degrees in the fitting recommendation representation 280. As shown in FIG. 13B, the fitting recommendation for the 54 degree loft is a 10 degree bounce and an S-grind, the fitting recommendation for the 60 degree loft is a 12 degree bounce and a D-grind, the fitting recommendation for the 52 degree loft is an 8 degree bounce and an F-grind, and the fitting recommendation for the 56 degree loft is a 10 degree bounce and an S-grind.

In some examples, as explained in more detail below with reference to FIG. 14, the computing device 800 generates a fitting recommendation after receiving a plurality of swing analytics of a plurality of golf shots, for example, after receiving swing analytics for a threshold number of golf club shots. In some examples, the computing device 800 receives swing analytics for a plurality of golf shots and updates the fitting recommendation after receiving the swing analytics of each of the plurality of golf shots.

The golf shot analysis segment 260 may include one or more carry distance representations 292 representing a carry distance of the golf shots measured by the launch monitor 840. In some examples, a single carry distance representation 292 may be included that represents, for example, a carry distance of the most recent golf shot or an average carry distance of all golf shots, and the carry distance representation 292 may be updated each time the computing device 800 receives ball flight characteristics of a new golf shot. In some other examples, a plurality of carry distance representations 292 corresponding to each of the lofts 284 of the fitting recommendation representation 280 are included and represent, for example, the carry distance of the most recent golf shot hit with a golf club having the corresponding loft 284 or the average carry distance of golf shots hit with golf clubs having the corresponding loft 284. In this example, as shown in FIGS. 13B-13E, the golf shot analysis segment 260 includes a plurality of carry distance representations 292 corresponding to the plurality of lofts 284 of the fitting recommendation representation 280.

The golf shot analysis segment 260 may include one or more gapping quality representations 294 representing whether a gapping (e.g., an average carry distance difference between two or more golf clubs of different lofts) is good or bad. The gap quality representation 294 may include text, for example, "good gap", to indicate that a gapping between two or more lofts is good, and may include text, for example, "bad gap", to indicate that the gapping is poor. The "good gap" text may be used, for example, when an average carry distance difference between golf clubs of two lofts is less than a threshold value, and the "bad gap" text may be used, for example, when the average carry distance difference is greater than the threshold value or outside of a range threshold (e.g., the carry difference is too small or too large). For example, as shown in FIGS. 13D and 13E, a gap quality representation 294 including the "good gap" text is provided after golf shots are hit with golf clubs having a 48 degree loft and a 54 degree loft. In some examples, a single gapping quality representation 294 may be provided that is based on, for example, average carry distances corresponding to each of the lofts 284. In some other examples, a gapping quality representation 294 may be provided for each two adjacent lofts among the lofts 284. The determinations for the gapping quality may also result in different loft recommendations. For instance, the series of recommended lofts are updated in the fitting recommendation representation 280. For example, if a gap between two lofts was too large, one or more of those lofts may be updated such that the difference in loft values becomes less.

In some examples, the golf shot analysis segment 260 includes a selectable options element 240. In response to the computing device 800 receiving a selection of the options element 240, one or more controllable options may be displayed in the golf shot analysis segment 260. FIGS. 13A-13E show the selectable options button 240 as provided at a top portion of the golf shot analysis segment 260 before a selection thereof is received by the computing device 800.

FIG. 14 depicts the top portion of the golf shot analysis segment of FIGS. 13A-13E after a selection of the options button 240 has been received by the computing device 800. The displayed options include a selectable estimate option 241, a selectable show shot types option 242, a selectable show shot table option 243, a selectable minimize option 244, a controllable conditions shot threshold option 245, a controllable shot threshold option 246, a selectable last shot option 247, a selectable save option 248, a selectable player input data option 249, a selectable carry/gapping option 250, and a controllable fitting type option 251.

Upon receiving a selection of the estimate option 241 by the computing device 800, if the launch monitor 840 is unable to measure all of the swing analytics for a golf shot, then the computing device 800 may use an estimated value of the missing swing analytics of the golf shot. The estimated value may, for example, be based on the swing analytics that were measured for the golf shot and/or hierarchical data stored in the computing device 800.

For example, the computing device 800 may use attack angle and shaft lean to update the graphical technique representation 270 and generate or update the fitting recommendation. If the launch monitor 840 measures one of the attack angle and shaft lean of a golf shot but is unable to measure (e.g., due to error or inability to measure) the other one of the attack angle and shaft lean of the golf shot, then the computing device 800 may use an estimated value of the other one of the attack angle and shaft lean.

If the computing device 800 does not receive a selection of the estimate option 241, or receives a deselection of the estimate option 241, then the computing device 800, upon receiving an incomplete portion of swing analytics for a golf shot from the launch monitor 840, may either use the incomplete portion of the swing analytics or discard the incomplete portion of the swing analytics and indicate on the golf shot analysis segment 260 that no measurement was received.

Upon receiving a selection of the show shot type option 242 by the computing device 800, the golf shot control menus 224 (see FIG. 12) may be displayed in the golf shot analysis segment 260, for example, in the fitting recommendation representation 280 of the golf shot analysis segment 260 next to corresponding ones of the lofts 284 to allow the golf shot control representations 224 to be updated as described above with reference to FIG. 12. Upon receiving a deselection of the show shot type option 242 by the computing device 800, display of the golf shot control representations 224 may cease.

Upon receiving a selection of the show shot table option 243 by the computing device 800, a shot type table including information, such as the swing analytics and/or ball flight characteristics of each of the golf shots measured by the launch monitor 840 and received by the computing device 800, may be displayed in the golf shot analysis segment 260. The shot type table may be controllable or adjustable, for example, to allow the computing device 800 to receiving instructions via the table to delete the information relating to the golf shots. Upon receiving a deselection of the show shot table option 243, display of the shot type table may cease.

When selected, the selectable minimize option 244 causes at least a portion of, or all of, the golf shot analysis segment 260 to be automatically minimized when a shot is hit. The controllable conditions shot threshold option 245 allows for a number of shots to be collected for a certain condition, such as a greenside condition.

The shot number threshold option 246 is controllable to allow the computing device 800 to receive instructions via the shot number threshold option 246 of the number of golf shots, swing analytics of which are to be received by the computing device 800, before the computing device 800 generates an initial fitting recommendation. As shown in FIG. 14, the number of golf shots in the shot number threshold option 246 is set to 1, and as shown in FIGS. 13A and 13B, the fitting recommendation representation 280 provides a fitting recommendation for each of the lofts 284 after receiving swing analytics for one golf shot (i.e., the first golf shot of the full swing type). If the number of golf shots in the shot number threshold option 246 were instead set to 3, then the fitting recommendation representation 280 would not provide a fitting recommendation for all of the lofts 284 until the computing device 800 had received swing analytics for at least three golf shots.

Upon receiving selection of the last shot option 247 by the computing device 800, the graphical technique representation 270 will include the current shot indicator 276 and, upon receiving a deselection of the last shot option 247, the graphical technique representation will cease to include the current shot indicator 276.

Upon receiving selection of the save option 248 by the computing device 800, settings of the options are saved.

Upon receiving selection of the player input data option 249 by the computing device 800, at least one or more of the input fields of the first user interface 100 may be displayed and rendered controllable as described above with reference to FIG. 10. This allows a user of the computing device 800 to update or enter the player input data at any time, for example, before or after hitting one or more golf shots.

Upon receiving selection of the carry/gapping option 250 by the computing device 800, the carry distance representation 292 and/or the gapping quality representation 294 may be displayed as described herein. Upon receiving deselection of the carry/gapping option 250 by the computing device 800, display of the carry distance representation 292 and/or the gapping quality representation 294 may cease.

The controllable fitting type option 251 allows for selection of how many shots (e.g., total shots) are to be collected or analyzed during the fitting process. In the example depicted, 18 shots are selected. The controllable fitting type option 251 may provide for selecting a larger or smaller number of shots to be collected or analyzed to complete a fitting session.

In some examples, the golf shot analysis segment 260 includes a selectable user interface element 290. Upon receiving selection of the user interface element 290 by the computing device 800, a third user interface 300 is displayed, as shown in FIG. 15.

Referring to FIG. 15, the computing device 800 may generate, for each of the lofts 284, one or more fitting recommendations, each including a bounce angle and a grind. The computing device 800 may rank the one or more fitting recommendations in order of most recommended to least recommended, and display the most recommending fitting recommendation for each of the lofts 284 in the fitting recommendation representation 280. The third user interface 300 provides additional details about the one or more fitting recommendations of each of the lofts 284.

The third user interface 300 includes a first column 310, a second column 320, a third column 330, and a fourth column 340. The first column 310 includes each of the lofts 284 of the fitting recommendation representation 280, and may also include the most recommended fitting recommendation for each of the lofts 284. The second column 320 includes an explanation regarding why a certain fitting recommendation among the one or more fitting recommendations of the corresponding loft was selected as the most recommended fitting recommendation.

The third column 330 may include all of the fitting recommendations generated for each of the lofts 284, which may be separated into groups of fitting recommendations corresponding to the same loft 284. For example, as shown in FIG. 15, the third column 330 includes a plurality of groups 332, each group 332 including one or more fitting recommendations generated for the same loft 284. One of the groups 332 corresponding to the 48 degree loft includes a first fitting recommendation including a 10 degree bounce and an F-grind. Another one of the groups 332 corresponding to the 54 degree bounce includes two fitting recommendations: a first fitting recommendation including a 10 degree bounce and an S-grind, and a second fitting recommendation including a 12 degree bounce and a D-grind. Another one of the groups 332 corresponding to the 60 degree loft includes three fitting recommendations: a first fitting recommendation including a 12 degree bounce and a D-grind, a second fitting recommendation including an 8 degree bounce and an M-grind, and a third fitting recommendation including a 10 degree bounce and an S-grind. Another one of the groups 332 corresponding to the 52 degree loft includes a first fitting recommendation including an 8 degree bounce and an F-grind. Another one of the groups 332 corresponding to the 56 degree loft includes three fitting recommendations: a first fitting recommendation including a 10 degree bounce and an S-grind, a second fitting recommendation including an 8 degree bounce and an M-grind, and a third fitting recommendation including a 12 degree bounce and a D-grind. Each of the groups 332 may be separated from adjacent groups 332 by one or more rows (e.g., blank rows).

The fourth row 340 includes, for each fitting recommendation of each group 332, a corresponding rank indicator, such as a percent match 342 (defined as a percentage value out of 100%), to indicate how highly each fitting recommendation of the corresponding group 332 is recommended. For example, of the group 332 corresponding to the 60 degree loft, the first fitting recommendation (i.e., 12 degree bounce and D-grind), the second fitting recommendation (i.e., 8 degree bounce and M-grind), and the third fitting recommendation (i.e., 10 degree bounce and S-grind) respectively have a percent match 342 of 70%, 24%, and 6%.

Although information included in the third user interface 300 described above according to an example of the present disclosure is illustrated and described as being organized into columns, rows, groups, etc. this is provided as a non-limiting example, and the information included in the third user interface 300 may be organized in any suitable manner.

Figure 16A:
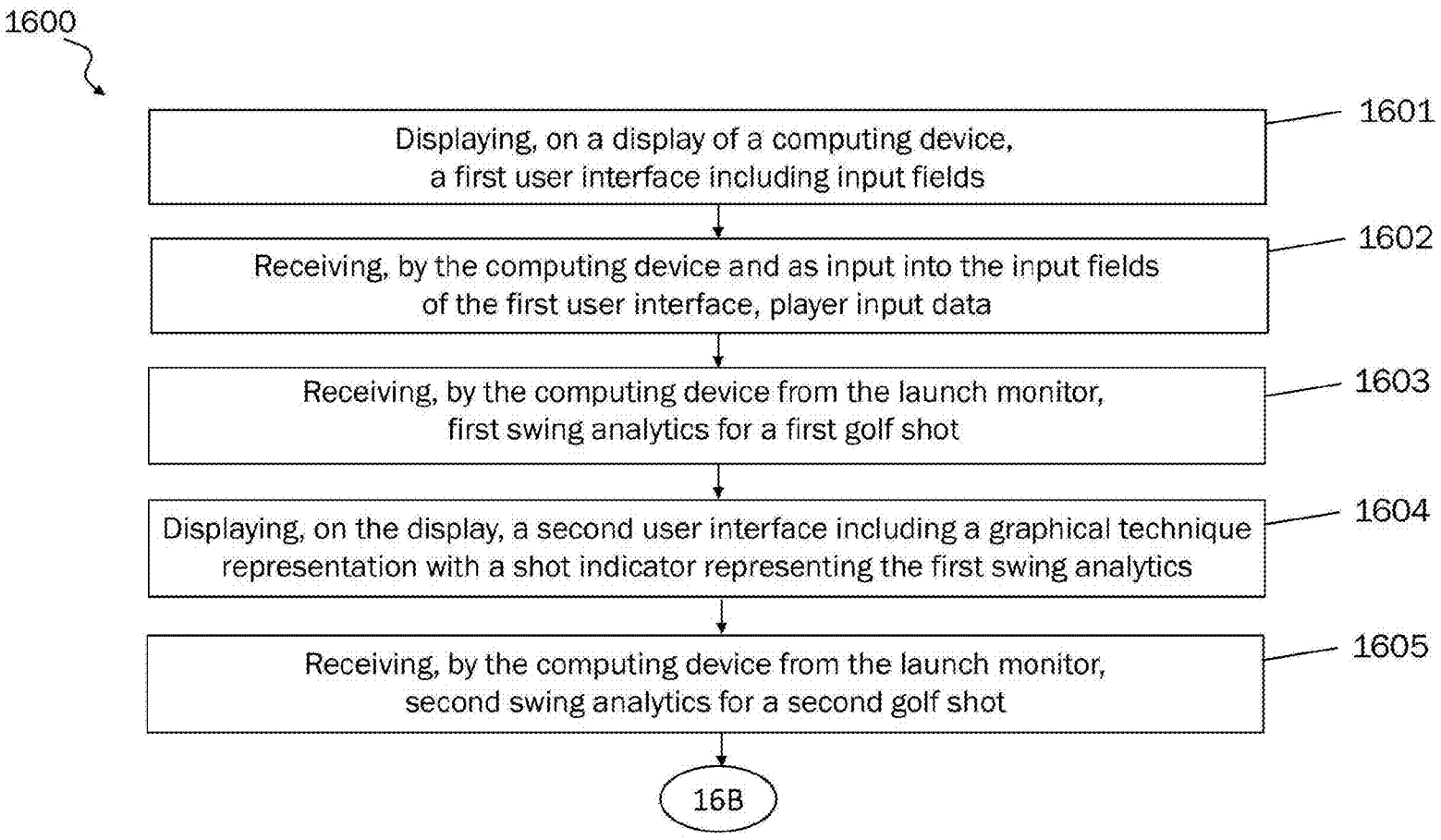
FIGS. 16A and 16B depict an example method for generating a fitting recommendation for a golf club.
Figure 16B:
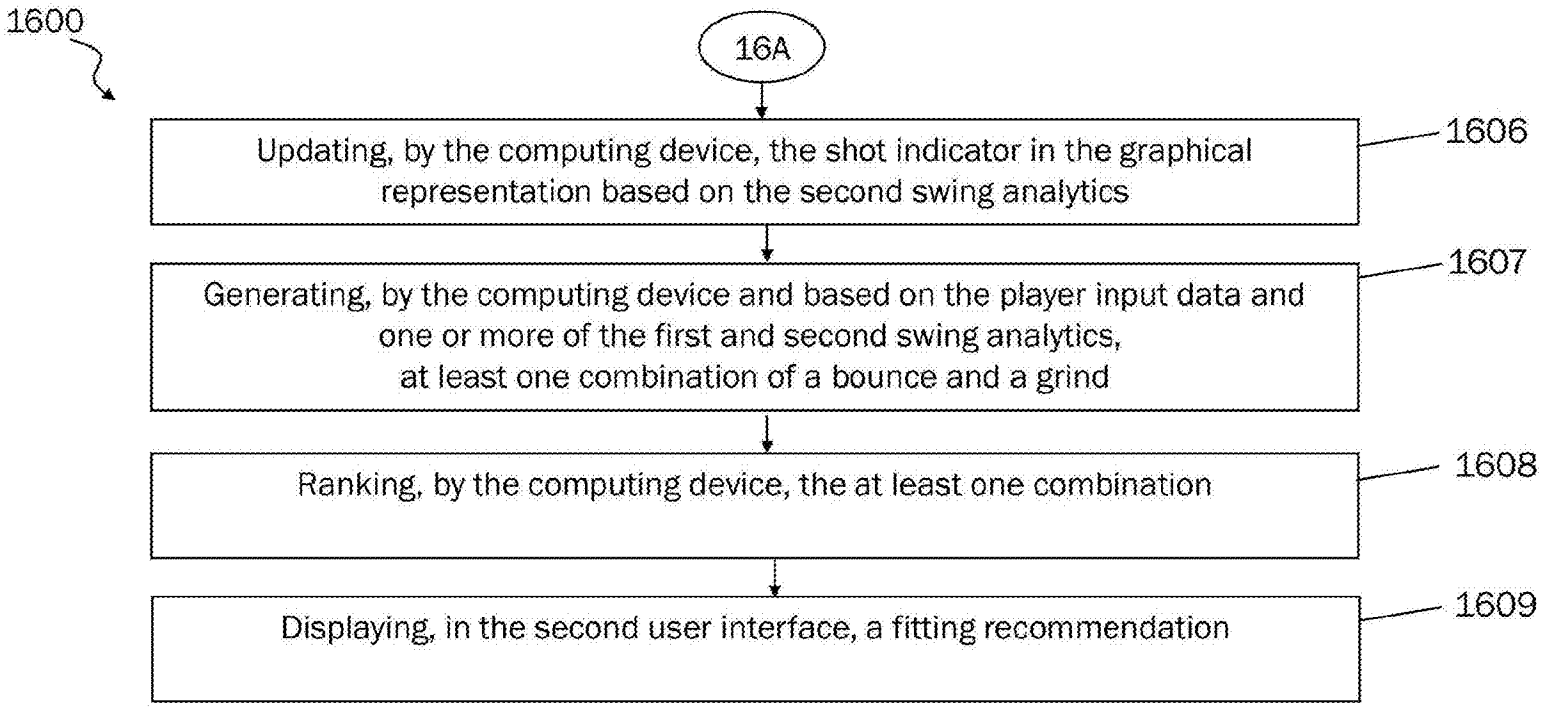

FIGS. 16A and 16B depict a method 1600 of generating a fitting recommendation according to an example. During operation 1601, the first user interface 100 including input fields (e.g., first to sixth input fields 101-106) is displayed on the display 820 of the computing device 800. During operation 1602, the computing device 800 receives as input into the input fields of the first user interface, player input data. During operation 1603, the computing device 800 receives from the launch monitor 840, first swing analytics for a first golf shot. For example, the computing device 800 may receive at least attack angle and/or shaft lean for the first golf shot. During operation 1604, the computing device 800 displays, on the display 820, the second user interface 200 including the graphical technique representation 270 with the shot indicator 274 representing the first swing analytics. During operation 1605, the computing device 800 receives from the launch monitor 840 second swing analytics for a second golf shot. For example, the computing device 800 may receive at least attack angle and/or shaft lean for the second golf shot. In some examples, the first and second golf shots are of the same type, and in other examples, the first and second golf shots are respectively of a first shot type and of a second shot type different from the first shot type.

During operation 1606, the computing device 800 updates the shot indicator 274 based on the second swing analytics. During operation 1607, the computing device 800 generates, based on the player input data and/or one or more of the first and second swing analytics, at least one fitting recommendation. The fitting recommendation(s) may include a corresponding bounce and/or grind for a golf club having a loft. For example, the computing device 800 may generate three combinations of bounce and grind for a golf club having a 60 degree loft. During operation 1608, the computing device 800 ranks the at least one fitting recommendation based on the player input data and/or one or both of the first and second swing analytics. During operation 1609, the computing device 800 displays, in the second user interface 200, a most recommended one of the at least one fitting recommendations for the golf club. For example, the computing device 800 may display in the fitting recommendation representation 280 a fitting recommendation including a recommended bounce 286 and a recommended grind 288 for the golf club having the 60 degree loft.

Figure 17:
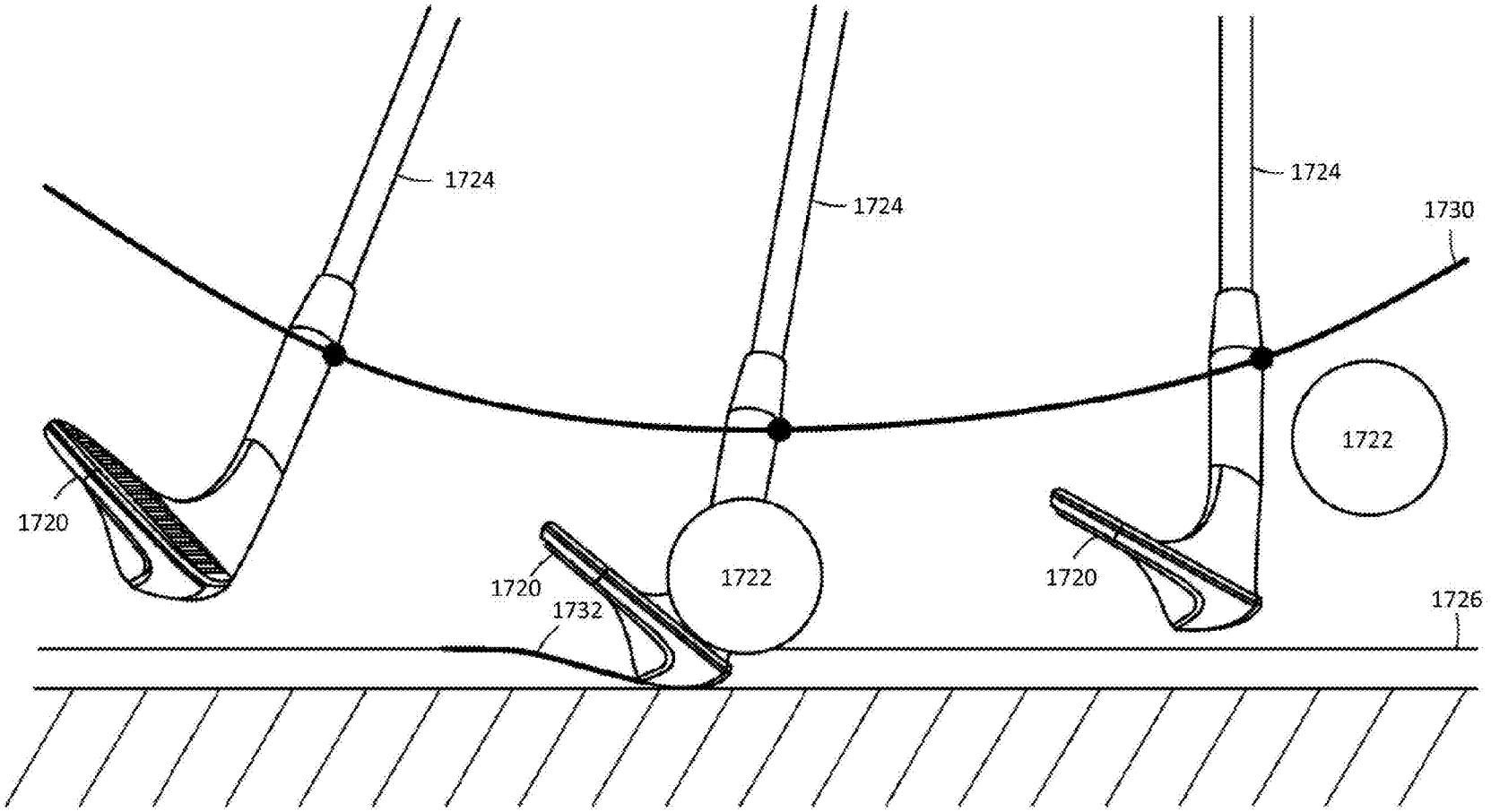
FIG. 17 depicts a simulated view of images captured by a launch monitor illustrating the impact of a golf swing.
Figure 18:
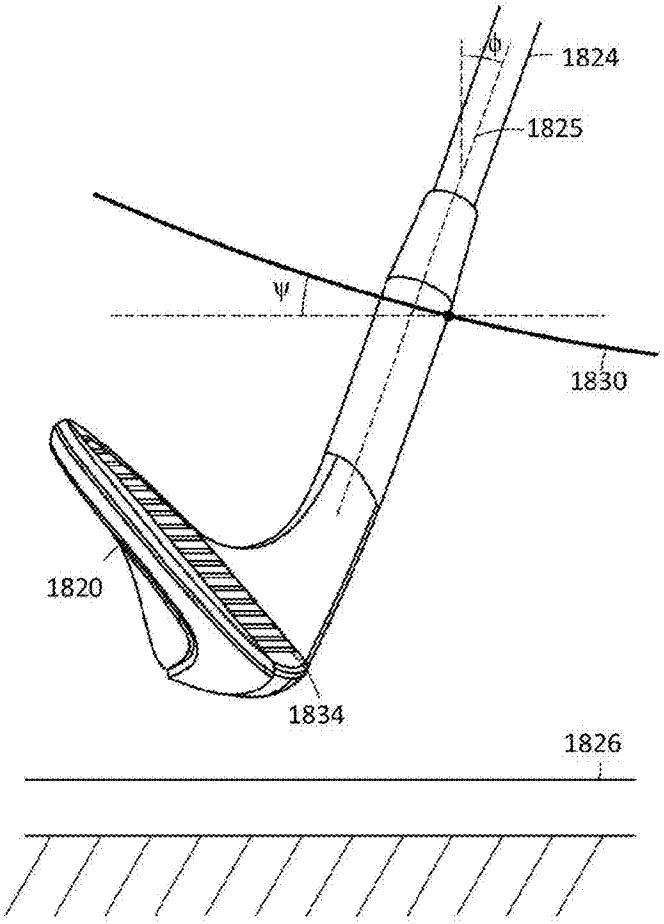
FIG. 18 depicts an enlarged view of an image captured by a launch monitor illustrating a golf club before impact with a golf ball.
Figure 19:
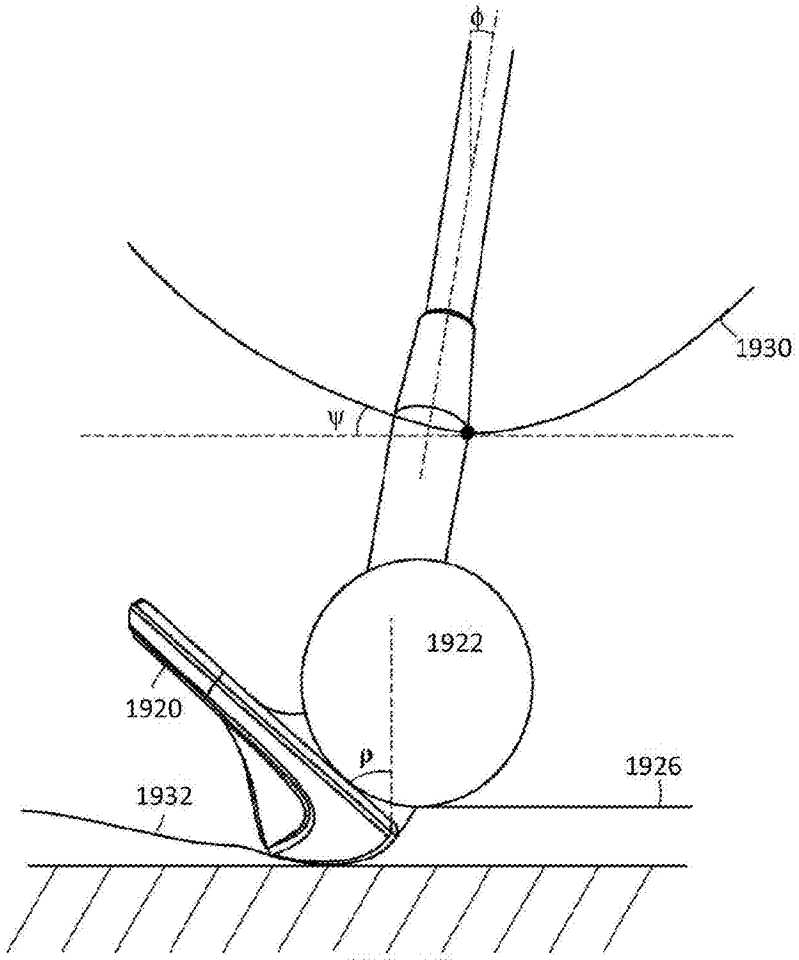
FIG. 19 depicts an enlarged view of an image captured by a launch monitor illustrating a golf club right as it impacts the golf ball.
Figure 20:
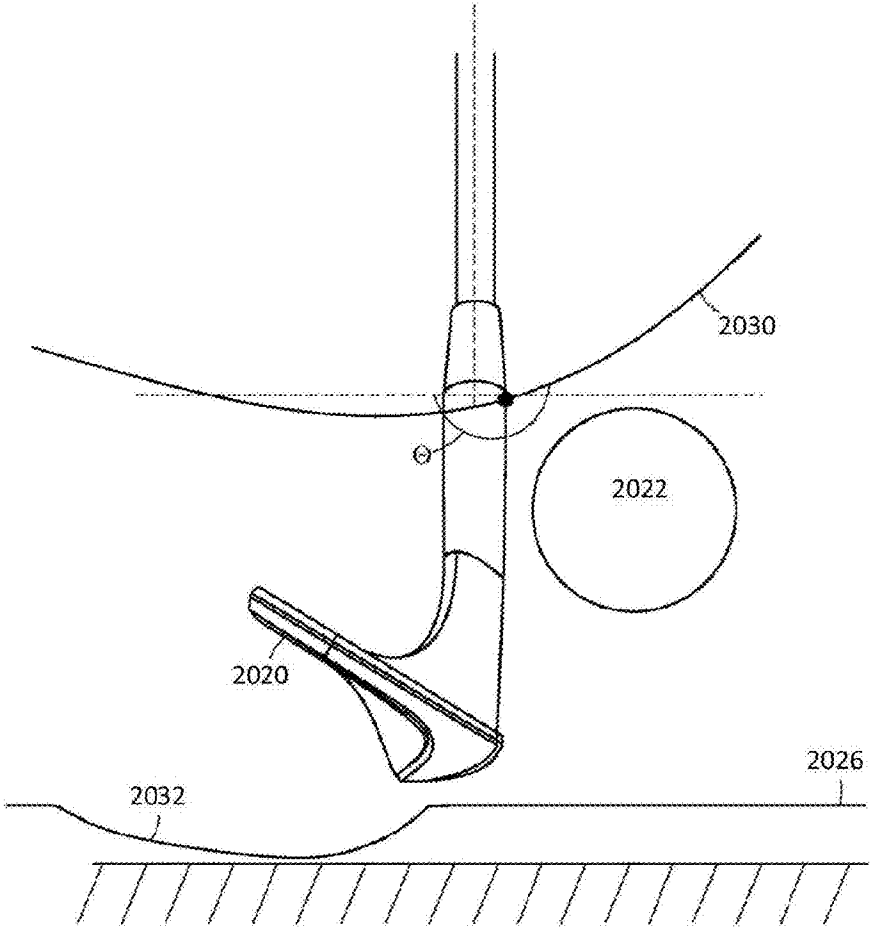
FIG. 20 depicts an enlarged view of an image captured by a launch monitor illustrating a golf club right after it impacts the golf ball.

Some additional discussion of example swing analytics, such as attack angle and shaft lean, is provided below with reference to FIGS. 17-20. FIG. 17 depicts a simulated view of images captured by a launch monitor illustrating the impact of a golf swing. FIG. 18 depicts an enlarged view of an image captured by the launch monitor illustrating a golf club before impact with a golf ball. FIG. 19 depicts an enlarged view of an image captured by a launch monitor illustrating a golf club right as it impacts a golf ball. FIG. 20 depicts an enlarged view of an image captured by a launch monitor illustrating a golf club right after it impacts the golf ball.

FIG. 17 shows a schematic of an overview of the different conditions that a golf club head 1720 goes through during a golf swing. Although the launch monitor usually focuses on individual frames, this overview shown in FIG. 17 provides some initial context to what an iron type golf club head 1720 looks like when it interacts with the ground on an actual golf shot. It can be seen that on the left side of FIG. 17, golf club head 1720 is approaching the golf ball 1722 from a steep angle with a significant amount of shaft lean. During impact, which is depicted by the figure in the middle of the page, the golf club head 1720 may engage the ground plane 1726 by hitting down on the golf ball 1722 and going beneath the ground plane 1726. This type of ball striking motion may generally leave a divot 1732 on the ground. When the fitting is being performed indoors, artificial turf may be used in which a permanent divot may not be left in the artificial turf. Instead, the artificial turf may temporally depress or compress upon impact by the golf club head 1720. Finally, on the right side of FIG. 17, the golf club head 1720 has completed the golf swing and the golf ball 1722 has left the striking face portion of the golf club head 1720. It is at this point, where the shaft 1724 may generally be substantially vertical. In order to provide a better illustration of the individual scenarios, FIGS. 18, 19, and 20 have been provided here with enlarged views of the golf club heads 1720.

FIG. 18 shows an enlarged view of a golf club head 1820 right before it impacts a golf ball. FIG. 18 shows an angle of attack w and shaft lean angle $\phi$. In this enlarged view of the golf club head 1820, before the golf club head 1820 contacts the golf ball, the golf club head 1820 stands above the ground plane 1826, coming in at an angle of attack $\psi$ that follows the swing path 1830 of the golf club head 1820. The angle of attack w of each individual golfer may differ from each other depending on their particular golf swing, but may generally be between about 0 degrees to about −15 degrees, but could also be any other number depending on the golfer's golf swing. It is worthwhile to note here that the angle $\psi$ here is negative, which is indicative of a downward angle of motion relative to a horizontal ground plane.

In addition to the angle of attack, FIG. 18 also shows the shaft lean angle $\phi$ as the amount of forward shaft lean the golfer demonstrates before contacting a golf ball. Most golfers that are hitting down on a golf ball will have a shaft lean angle $\phi$ of between about 0 degrees to about 20 degrees, but that number could differ depending on the particular golfer's swing to even being a negative number.

FIG. 18 of the accompanying drawings also allows another potential swing analytic referred to a face angle to target line, or simply known as face angle to some in the industry. The face angle refers to the angle of the golf club head 1820 as it relates to the target line, which in this illustration of FIG. 18, is pointed to the right. Although not specifically identified by any Greek symbols, the launch monitor is capable of capturing this by focusing on the angle of the scorelines relative to either the ground plane or the shaft axis 1825.

FIG. 19 depicts an enlarged view of a golf club head 1920 as it impacts a golf ball 1922 (e.g., at a point of maximum compression). In this enlarged view of the golf club head 1920, we can see that when the golf club head 1920 contacts the golf ball 1922, it goes beneath the ground plane 1926, creating a divot 1932 in the ground. In some examples, the divot 1932 may occur slightly before impact with a golf ball 1922. Because of this interaction with the ground 1926, the launch monitor may be able to adjust its location and shift the focus of the launch monitor to an alternate location that doesn't contain the divot 1932. As discussed above, in indoor fittings where artificial turf is used, the divot 1932 may not be present or may be temporary as the artificial turf compresses upon impact with the golf club head 1920. In this frame of the golf swing captured in FIG. 19, it can be seen that the angle of attack $\psi$, may still be in a downward motion following swing path 1930. This angle of attack $\psi$, depending on the golfer's swing, may generally be between about 0 degrees to about −15 degrees. The shaft lean angle $\phi$ may also change depending on the golfer, but may generally be between about 0 degrees to 20 degrees.

In addition to the above, FIG. 19 also shows another potential swing analytic referred to as dynamic loft $\rho$. Dynamic loft $\rho$ generally relates to the loft of the golf club head 1920 relative to a vertical plane. This dynamic loft $\rho$, which occurs during a golf swing, is generally different from the actual static loft of the golf club head 1920 because dynamic loft $\rho$ includes other variables such as shaft lean angle $\phi$, swing path 1930 amongst numerous other variables. In this image captured in FIG. 19, the static loft of the golf club head 1920 may be about 60 degrees, but the dynamic loft $\rho$ may be less due to the forward shaft lean angle $\phi$, yielding a dynamic loft $\rho$ of about 45 degrees.

FIG. 20 depicts an enlarged view of a golf club head 2020 after it has impacted the golf ball 2022. In this enlarged view of the golf club head 2020, after the impact with the golf ball 2022, the golf club head 2020 may leave a divot 2032 on the ground and begin travelling in an upward direction. In this frame of the golf swing captured in FIG. 20, the angle of attack $\Theta$ is a positive number to represent that the golf club head is heading in an ascending path, more specifically between about 10 degrees and 20 degrees. A positive path generally mean that the golf club head is traveling along a swing path 2030 that is now in an upward motion. Finally, the shaft lean angle in this embodiment is generally 0 degrees at some point during the moments after the impact.

The launch monitor may also be capable of capturing golf ball 2022 characteristics, such as the golf ball 2022 launch angle and the golf ball 2022 spin.

Systems and methods for generating a fitting recommendation for a golf club will now be described with reference to FIGS. 8 and 21-34. In some examples, the fitting recommendation may be for a metalwood golf club (e.g., a driver-type golf club, a fairway-wood-type golf club, or a hybrid-type golf club). The systems for generating the fitting recommendation may include, and the methods for generating the fitting recommendation may be performed using, for example, the system illustrated and described with reference to FIG. 8. The systems and methods described herein for generating the fitting recommendation may be used indoors or outdoors.

Figure 21:
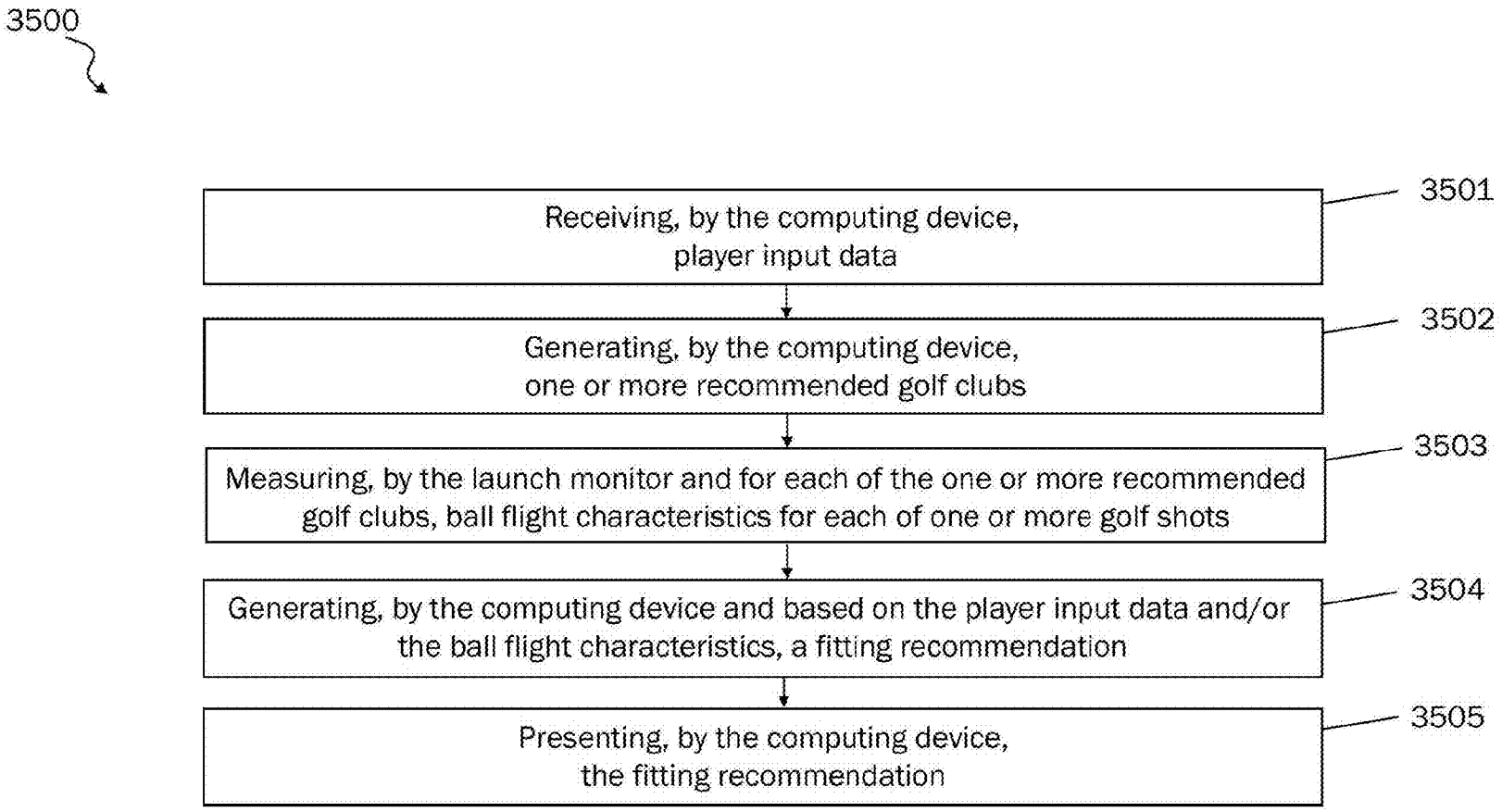
FIG. 21 depicts an example method for generating a fitting recommendation for a golf club.

FIG. 21 depicts operations of a computer-implemented fitting method 3500 for generating a fitting recommendation for a golf club according to an example. The fitting method 3500 may be performed using the system illustrated and described with reference to FIG. 8. The fitting recommendation generated during the fitting method 3500 may include a shaft fitting recommendation and/or a golf club head fitting recommendation. In some examples, the fitting recommendation may be provided as a single recommendation including both the shaft fitting recommendation and the head fitting recommendation. In some other examples, the shaft fitting recommendation and the head fitting recommendation may be separately generated and provided. In some other examples, only the shaft fitting recommendation or the head fitting recommendation is generated and provided.

The shaft fitting recommendation may include one or more shaft related features, for example, shaft weight, shaft length, shaft flex, shaft kick point, and/or shaft torque. For example, the shaft fitting recommendation may include shaft weight and shaft length. The weight and the length of a shaft may each affect the feel of a player's golf swing, the flight characteristics of a struck golf ball, and the player's overall performance. For example, increasing the shaft length may increase golf ball total distance but may decrease the player's accuracy, and increasing the shaft weight may decrease the golf ball total distance but may increase the player's accuracy.

Shaft flex may refer to the amount that the shaft bends during a golf swing, which may affect the golf ball total distance, direction of the golf ball being hit, golf ball trajectory, and/or carry distance. A more flexible shaft may result in better performance for players who have a slower swing, while a stiffer shaft may result in better performance for players who have a faster swing. As one differentiating scale, shaft flex generally may be categorized into the following five types, which are ordered according to increasing stiffness: ladies, senior, regular, stiff, and extra stiff.

The shaft kick point may refer to an area along the shaft that bends the most during a golf swing. A shaft with a mid kick point has the area near the center of the shaft's length, a shaft with a low kick point has the area closer to the golf club head (e.g., between the center of the shaft's length and the golf club head), and a shaft with a high kick point has the area closer to the golf club's grip (e.g., between the center of the shaft's length and an end of the shaft distal to the golf club head). The shaft's kick point can affect the feel of a player's golf swing and the trajectory of the golf ball being hit.

Shaft torque may refer to the shaft's resistance to twisting during a golf swing. A shaft with a low torque may resist twisting more than a shaft with a high torque. For example, a low torque shaft may twist 3 degrees or less along a lengthwise axis of the shaft during a golf shot, while a high torque shaft may twist 5 degrees or more along the lengthwise axis of the shaft during the golf shot. The shaft's torque can affect the player's performance. A low torque generally provides better performance for players with a fast golf swing, while a high torque shaft generally provides better performance for players with a slow golf swing.

The golf club head fitting recommendation may include a golf club head model, loft, hosel setting, and/or one or more adjustable weight options compatible with the head model. The golf club head model may be selected from one or more models from each of one or more manufacturers. For example, the golf club head model may be selected from a group of golf club head models of the same club type (e.g., different models of drivers). The club head models may be from the same manufacturer or from different manufacturers. As an example, with respect to drivers, the different club head models may include the TSi1 head model, TSR2 head model, TSR3 head model, and TSR4 head model available from TITLEIST. However, the present disclosure is not limited thereto, and the group of golf club head models may include head models from additional or alternative manufacturers besides TITLEIST. The golf club head model may affect the player's performance in view of the player's skill level. For example, some golf club head models (e.g., the a TSR4 model) are better suited for a highly skilled or professional player having a low handicap and who regularly hits golf balls near a sweet spot or area on the golf club head's striking face with little variation. Such club head models may be referred to as low-forgiveness models. Other golf club head models (e.g., the TSi1 golf club head model) are better suited for a low skilled or novice player having a high handicap and who hits golf balls with a large variability across the golf club head's striking face. Such club head models may be referred to as high-forgiveness models.

The loft of the golf club head's striking face may affect various ball flight characteristics, including, for example, launch angle and golf ball trajectory which may ultimately affect golf ball total distance, golf ball carry distance, and golf ball direction. Some club head models also include adjustable settings, such as adjustable hosel settings and/or adjustable weight settings. The hosel settings may include settings to selectively control the loft of the golf club head and/or to selectively control the lie of the golf club head. For example, the hosel settings may include the settings available from TITLEIST's SUREFIT Hosel (SUREFIT—a registered trademark of Acushnet Company). The selected hosel setting may affect various ball flight characteristics and the player's overall performance by affecting the loft and lie of the golf club head.

The one or more adjustable weight options may depend on which golf club head model is selected in the head fitting recommendation and may include one or more adjustable weight options to control the center of gravity (CG) of the golf club head along a toe-heel direction, one or more adjustable weight options to control the CG of the golf club head along a depth direction normal (e.g., perpendicular) to the striking face of the golf club head, and/or one or more adjustable weight options to control the CG of the golf club head along a height direction perpendicular to both of the toe-heel direction and the depth direction. In some examples, the one or more adjustable weight options include various weights configured to interchangeably engage with the golf club head and to selectively control the total weight of the golf club head. The one or more adjustable weight options can affect various ball flight characteristics, such as, for example, golf ball total distance, golf ball direction, golf ball trajectory, and golf ball spin.

At operation 3501 of method 3500, player input data may be received, for example, by the computing device 800. The player input data may include, for example, information about whether the player is right handed or left handed; whether the player has his or her current driver with them; the manufacturer of the player's own golf club (e.g., the player's own driver); the length of the player's own shaft of the player's own golf club; the weight of the player's own shaft; the flex of the player's own shaft; the loft of the player's own golf club head of the player's own golf club; the player's handicap; the player's trajectory when hitting a golf ball with his or her own golf club (e.g., a low, medium, or high trajectory); the player's tempo when hitting a golf ball with his or her own golf club (e.g., whether the player's tempo is smooth, average, or quick); the player's average golf ball total distance when hitting with his or her own golf club; the player's accuracy when hitting from the tee with his or her own golf club; the player's preferred golf club head model and/or shape; the player's preference regarding whether to maximize golf ball carry distance or golf ball total distance; the player's preference regarding the importance of accuracy; and/or the player's preference regarding the importance of distance. In some examples, the player input data may include information about the player's fairway conditions (e.g., average fairway conditions encountered by the player or fairway conditions of a particular course) and/or the player's rough conditions (e.g., average rough conditions encountered by the player or rough conditions of a particular course). The player input data is not limited to combinations of the above-listed items of information, and additional or alternative information may also be included in the player input data.

At operation 3502, one or more recommended golf clubs may be generated, for example, by the computing device 800. The operation 3502 may occur after operation 3501, and generating the one or more recommended golf clubs may be based on the player input data. For instance, a first golf club including a golf club head and a shaft may be recommended at operation 3502. In some examples where the player has his or her current golf club with them, the initial recommendation or the first golf club recommendation may be the player's current golf club.

Throughout performance of the method 3500, at least some or all of the one or more recommended golf clubs may have different shafts but the same golf club head. To generate a shaft fitting recommendation, various different shafts may be tested from among the one or more recommended golf clubs while the golf club head of the tested golf clubs is kept constant. In some other examples, at least some or all of the one or more recommended golf clubs may have different golf club heads but the same shaft. For example, to generate a head fitting recommendation, various different heads may be tested from among the one or more recommended golf clubs while the shaft of the test golf clubs is kept constant.

At operation 3503, for each of the one or more recommended golf clubs, one or more golf shots may be taken, and ball flight characteristics for each of the one or more golf shots may be measured, for example, by the launch monitor 840. For instance, golf shots are taken with the first golf club recommendation, and the ball flight characteristics of the golf shots taken with the first golf club recommendation are measured by the launch monitor 840. The ball flight characteristics may then be received by the computing device 800 (e.g., from the launch monitor 840).

Different golf clubs (e.g., golf clubs having different shafts or golf club heads) may be recommended at the outset based on the player input data and/or serially recommended based on the player input data and the ball flight characteristics. For instance, one or more golf shots may be hit with the first recommended golf club including a first shaft and a first head and the ball flight characteristics may be measured. The ball flight characteristics may include, for example, golf ball total distance, golf ball carry distance, golf ball lateral distance, golf ball speed, golf ball launch angle, golf ball spin, and/or golf ball smash factor. Based on the ball flight characteristics of the golf shots with the first golf club and/or the player input data, a second golf club may be recommended that has a second shaft (that is different from the first shaft) and/or a second head (that is different from the first head).

One or more golf shots may be hit with the second recommended golf club and the ball flight characteristics may be recorded. Based on the ball flight characteristics of the golf shots with the second golf club and/or the player input data, a third golf club may be recommended that has a third shaft (that is different from the first and/or second shafts) and/or a third head (that is different from the first and/or second heads). Golf shots may then be hit with the third recommended golf club head and the ball flight characteristics may be recorded. This process may continue until there is little difference in ball flight characteristics between consecutive recommended golf clubs, there is a decrease in the quality of the ball flight characteristics between the current recommended golf club and the prior recommended golf club, and/or a maximum shot count is reached. Additional details and examples of recommending golf clubs through the fitting process are discussed further below with reference to the various example user interfaces that may be used by the present technology.

At operation 3504, a fitting recommendation is be generated (e.g., by the computing device 800) based on the player input data and/or the ball flight characteristics of the one or more golf shots for each of the one or more recommended golf clubs. In some examples, generating the fitting recommendation may include defining one or more potential fitting recommendations respectively corresponding to the one or more recommended golf clubs for which golf shots have been taken and ball flight characteristics have been measured, and ranking the one or more potential fitting recommendations based on the player input data and/or the ball flight characteristics. Each potential fitting recommendation may include at least some features of the corresponding golf club (e.g., at least some shaft related features of the shaft of the corresponding golf club and/or at least some head related features of the head of the corresponding golf club). The generating the fitting recommendation may include defining the fitting recommendation to be the highest ranked potential fitting recommendation or defining the fitting recommendation to include at least some of the plurality of potential fitting recommendations according to the ranking. As discussed further below, the ranking of the recommended golf clubs may be based on distances and accuracies of the ball flight characteristics, which each may be further be modified or based on the player input data.

At operation 3505, the fitting recommendation may be presented, for example, by the computing device 800 (e.g., displayed on the display 820). For example, the highest ranked potential fitting recommendation may be displayed on the display 820 as the fitting recommendation, or at least some of the plurality of potential fitting recommendations may be displayed on the display 820 according to their ranks (e.g., listed according to their ranks).

The method 3500 described with reference to FIG. 21 is a non-limiting example, and the present disclosure is not limited thereto. For example, although operation 3501 is depicted as occurring before operations 3502 and 3503, the present disclosure is not limited thereto, and the chronological order of these operations may be changed in some examples. For example, in some examples, the one or more recommended golf clubs may be generated, and the one or more golf shots with each of the one or more recommended golf clubs may be taken and ball flight characteristics measured, prior to the player input data being received. Also, although operations 3504 and 3505 are depicted as separate operations, these operations may occur concurrently or simultaneously, for example, as a single operation.

Additional details about systems and methods (e.g., methods of using the systems) for generating fitting recommendations will be described with reference to the first and second user interfaces illustrated and described with reference to FIGS. 22-34.

Figure 22:
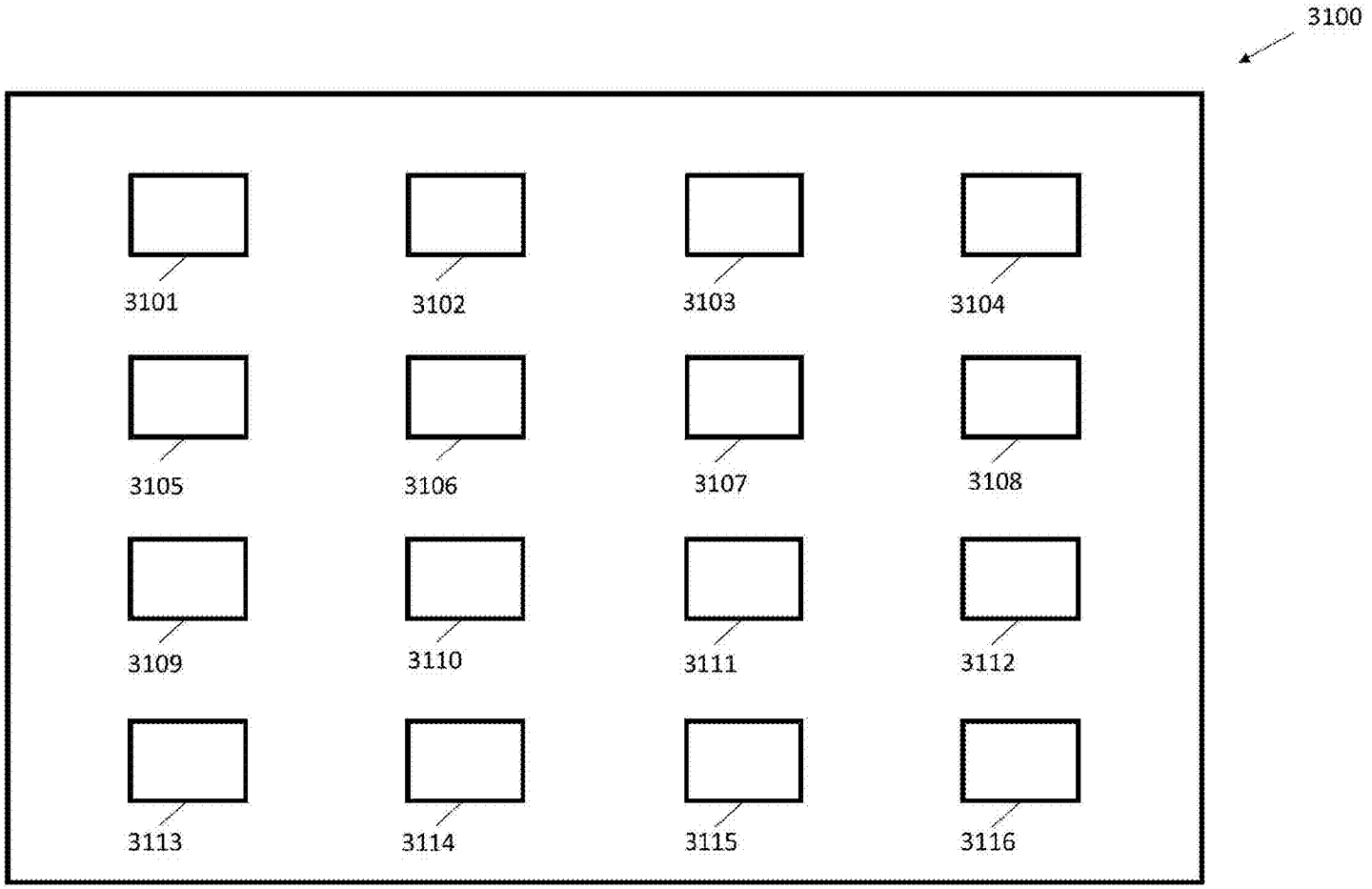
FIG. 22 depicts a first user interface according to an example.
Figure 23:
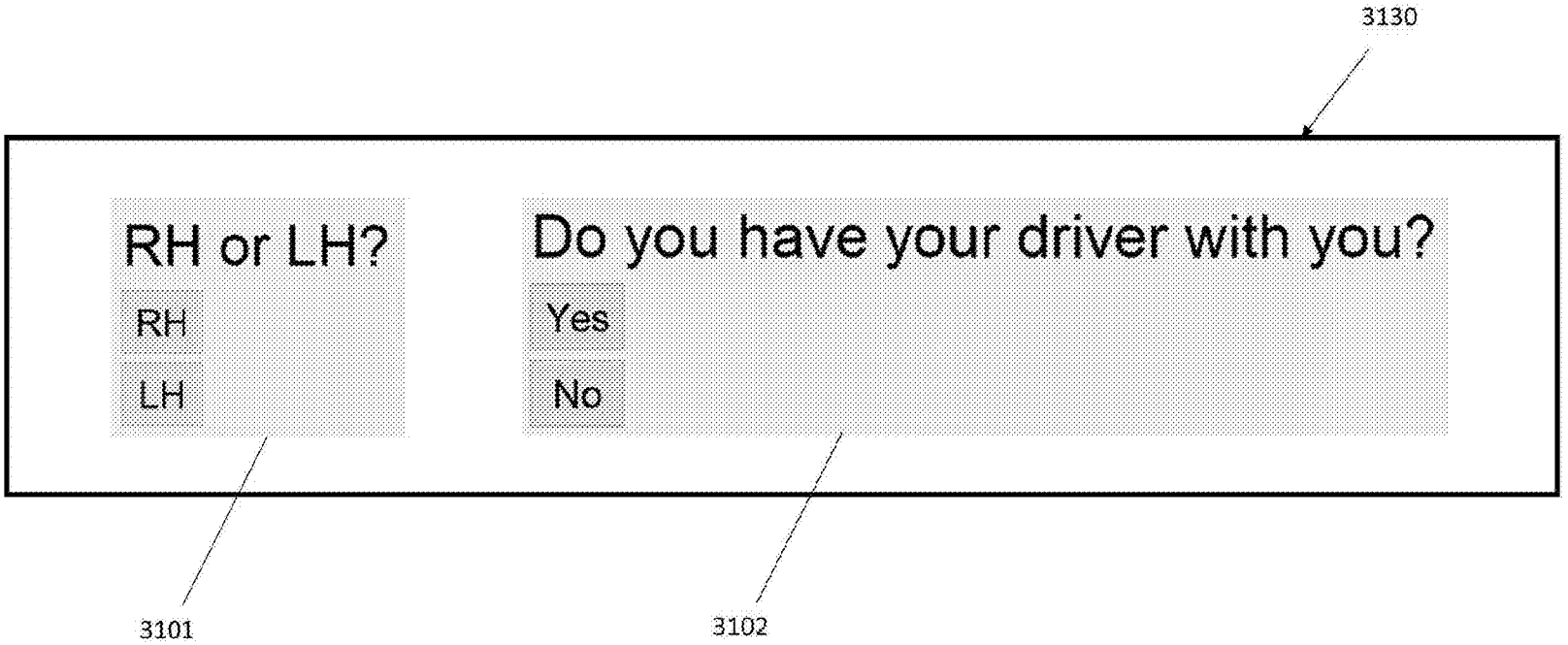
FIG. 23 depicts some input fields of the first user interface of FIG. 22 according to an example.
Figure 24:
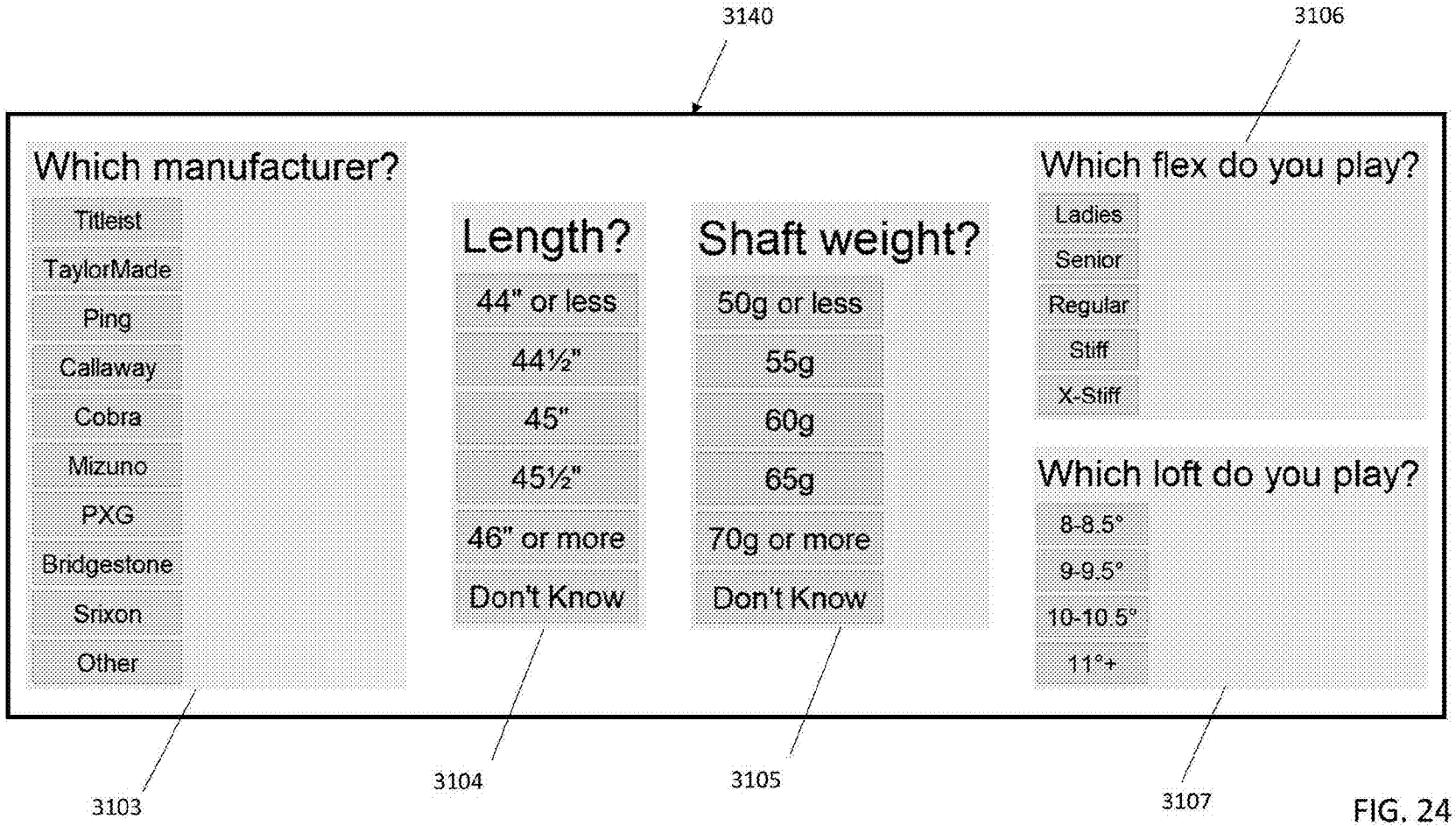
FIG. 24 depicts some other input fields of the first user interface of FIG. 22 according to an example.
Figure 25:
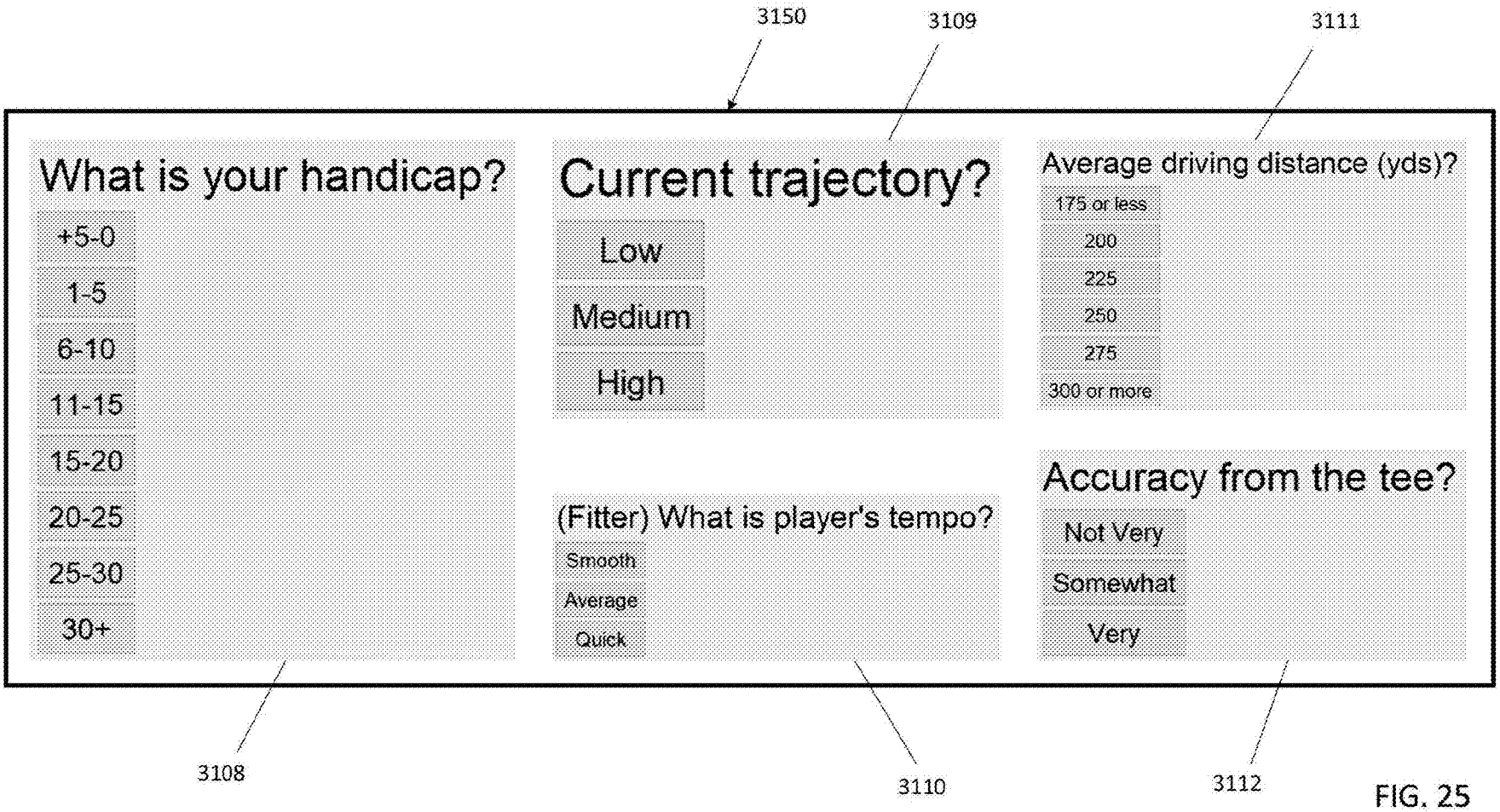
FIG. 25 depicts some other input fields of the first user interface of FIG. 22 according to an example.
Figure 26:
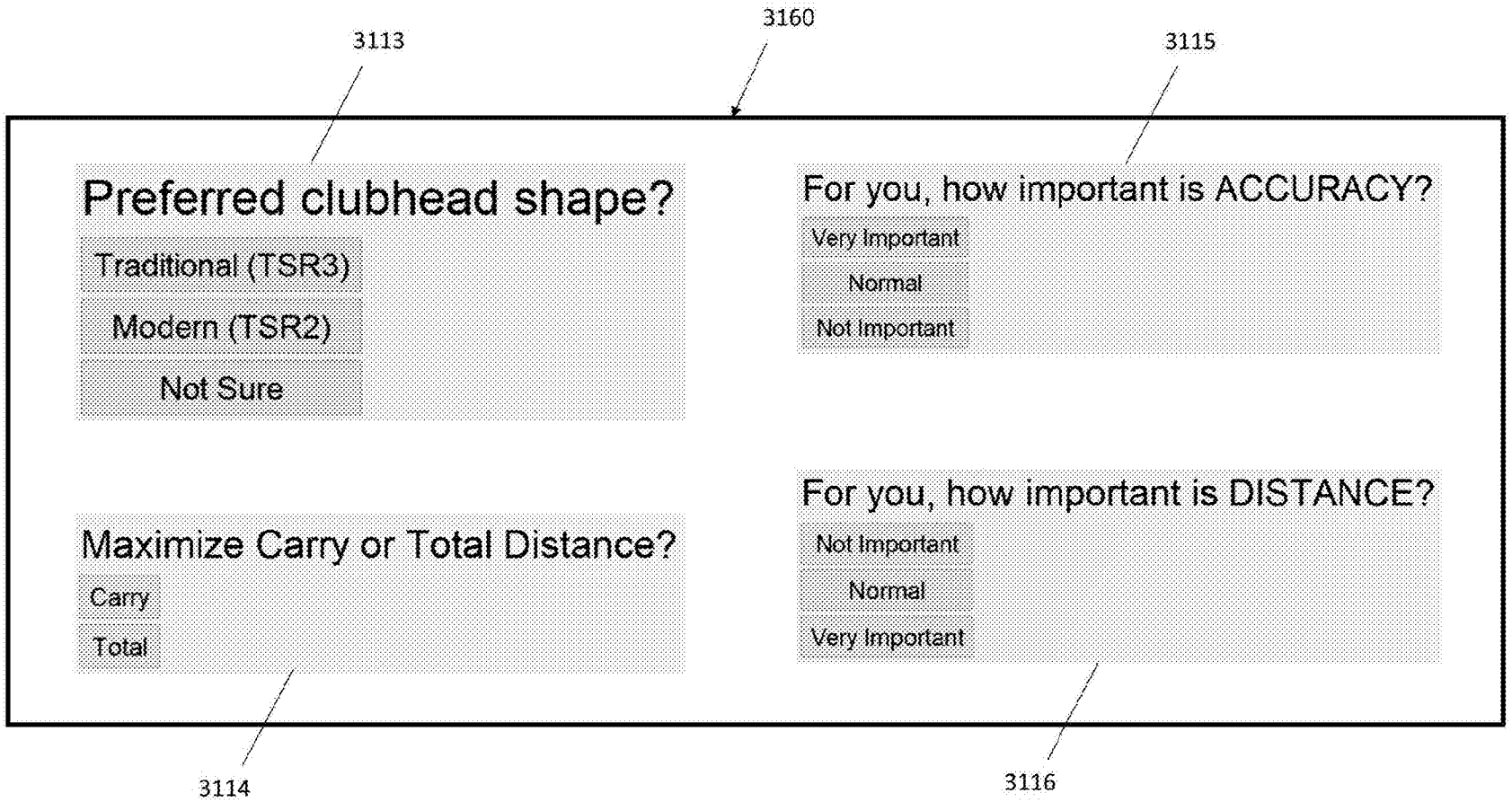
FIG. 26 depicts some other input fields of the first user interface of FIG. 22 according to an example.
Figure 27:
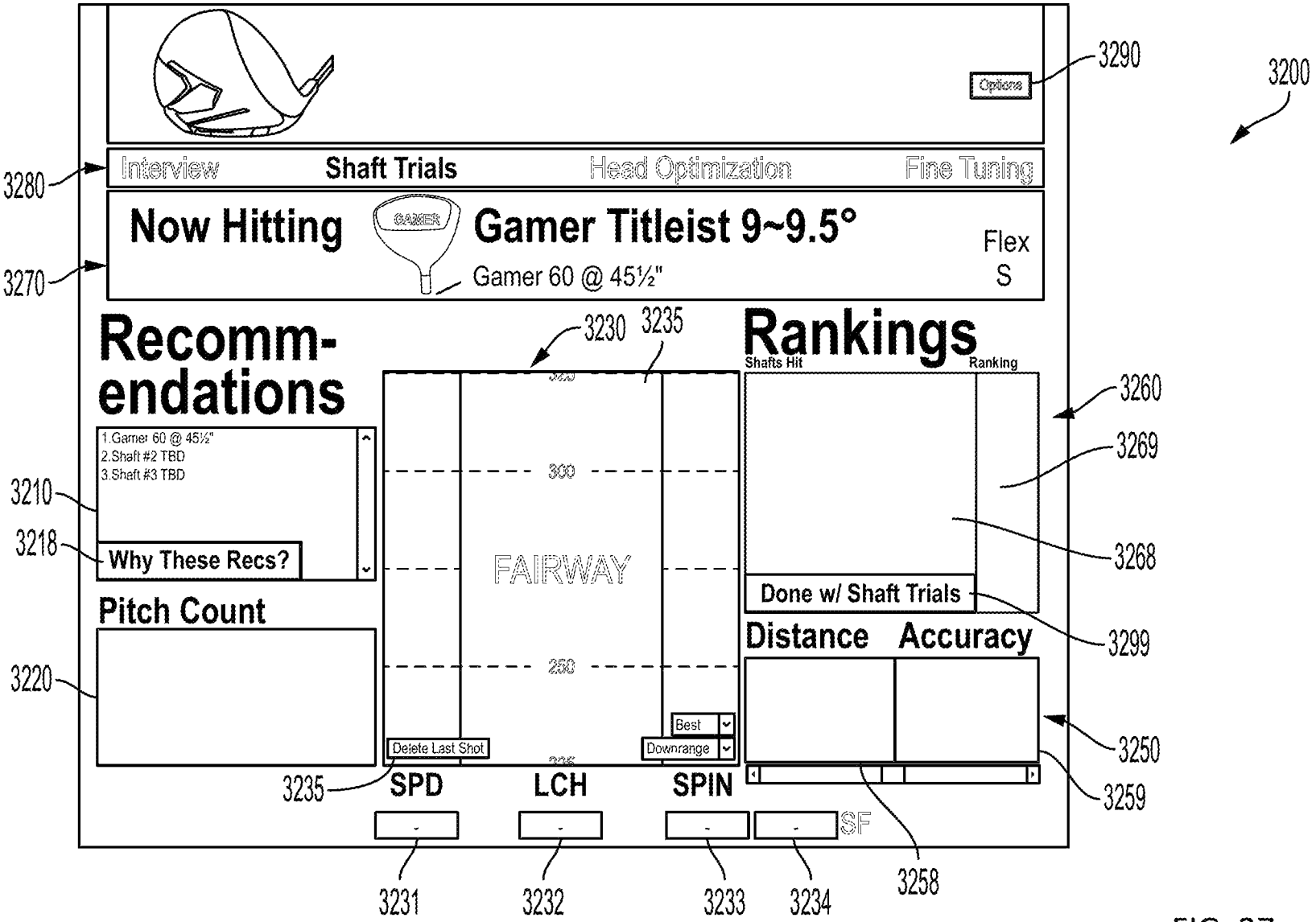
FIG. 27 depicts a second user interface during a Shaft Fitting Recommendation stage and according to an example.
Figure 28:
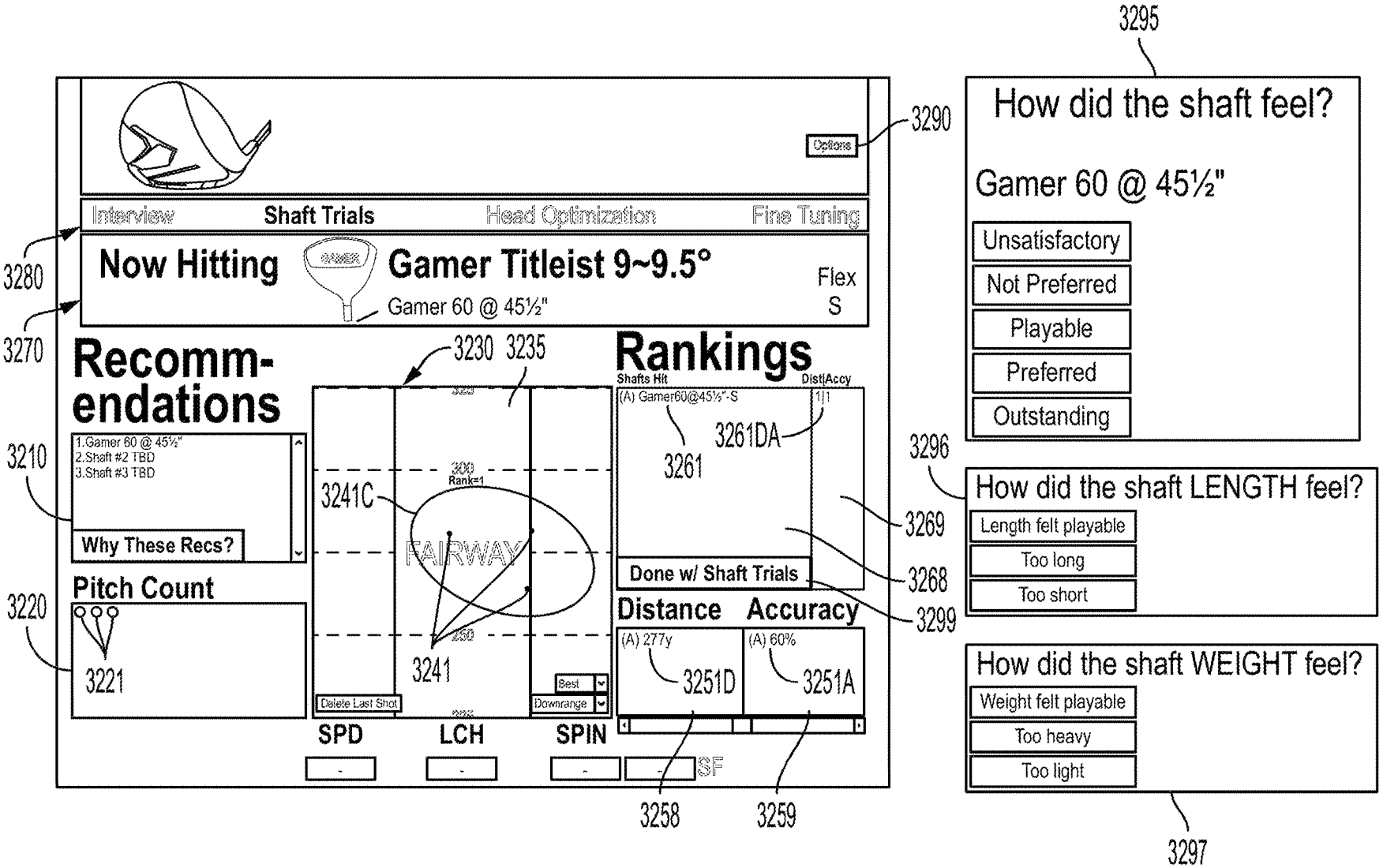
FIG. 28 depicts the second user interface of FIG. 27 during the Shaft Fitting Recommendation stage.
Figure 29:
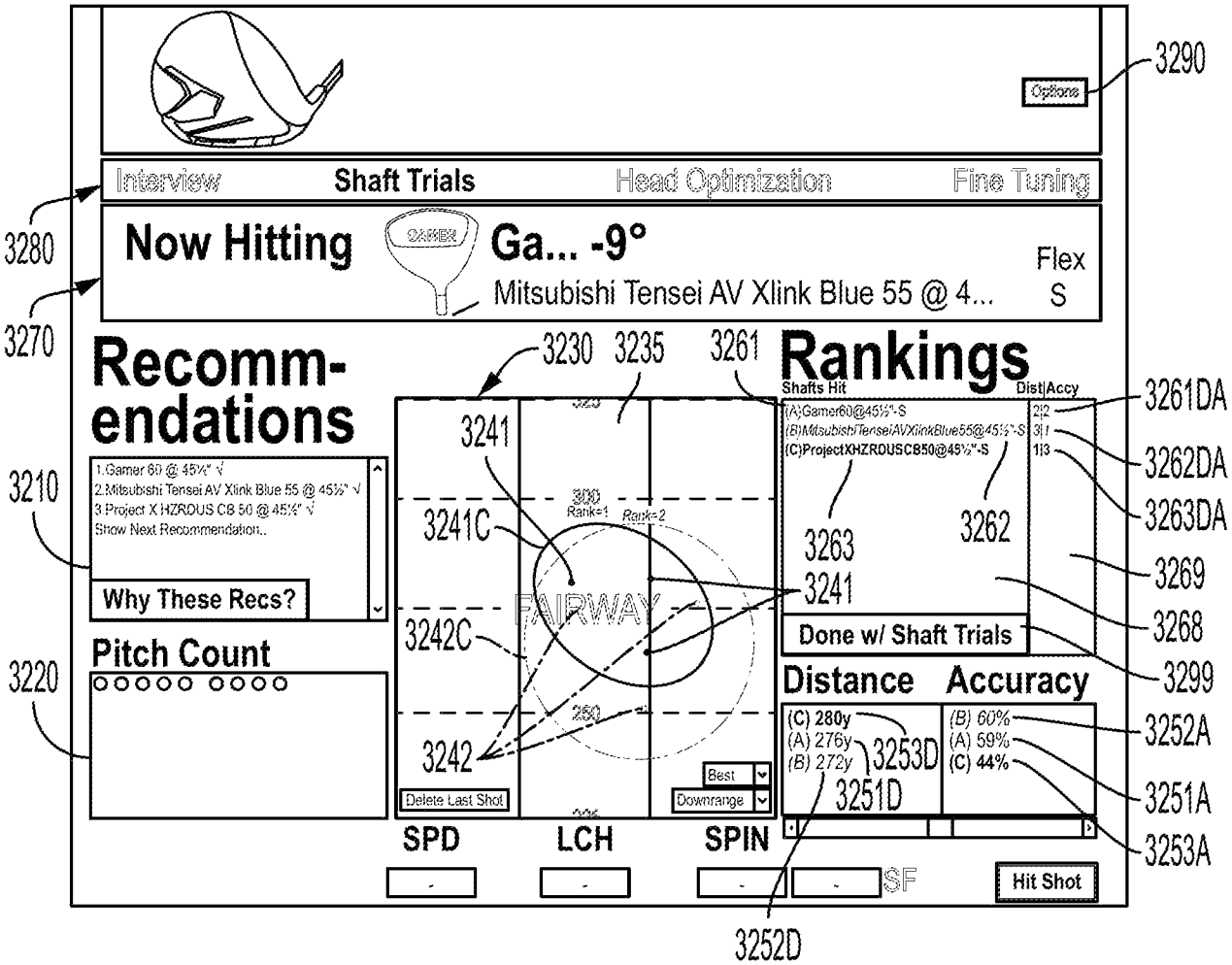
FIG. 29 depicts the second user interface of FIG. 27 during the Shaft Fitting Recommendation stage.
Figure 30:
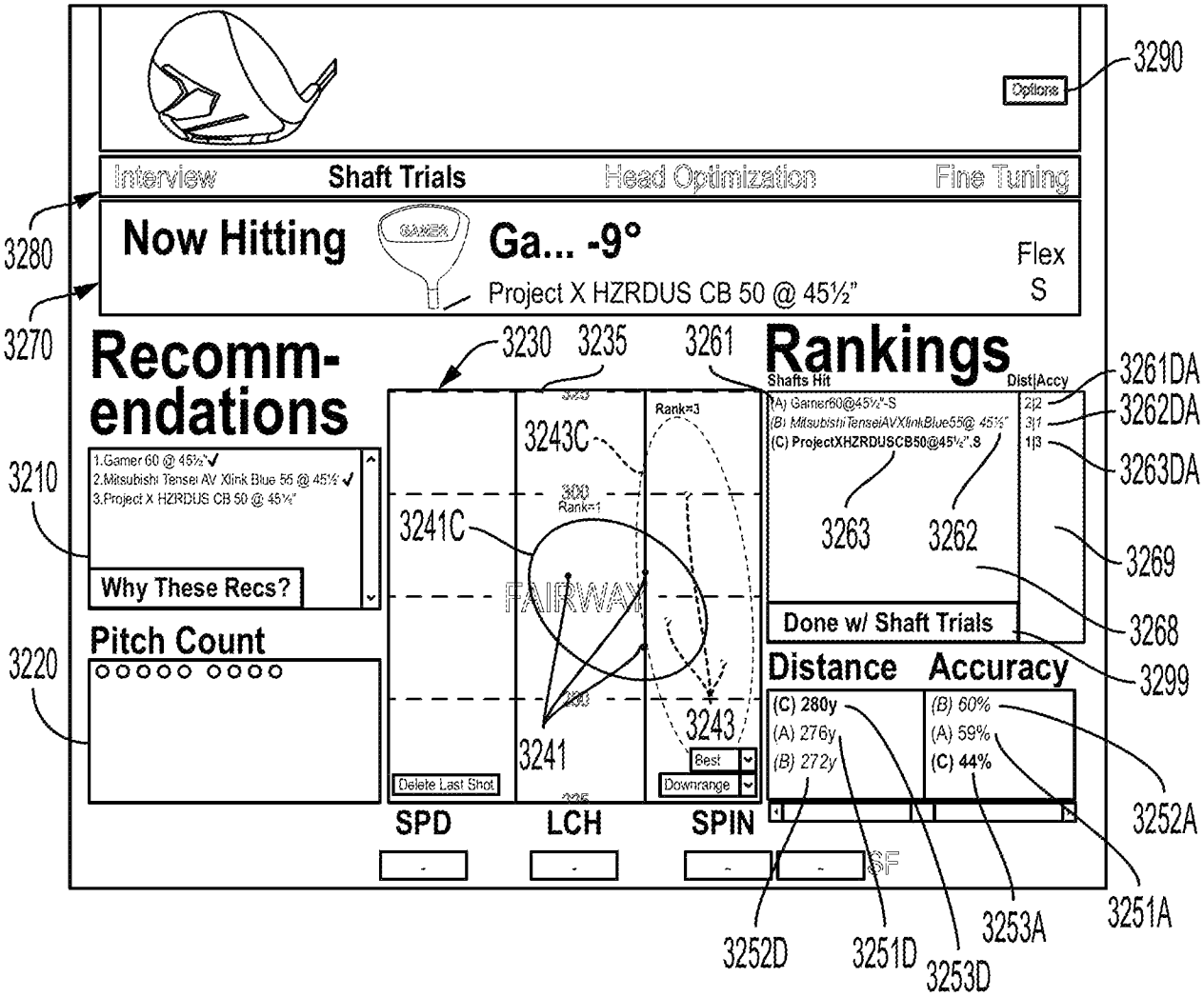
FIG. 30 depicts the second user interface of FIG. 27 during the Shaft Fitting Recommendation stage.
Figure 31:
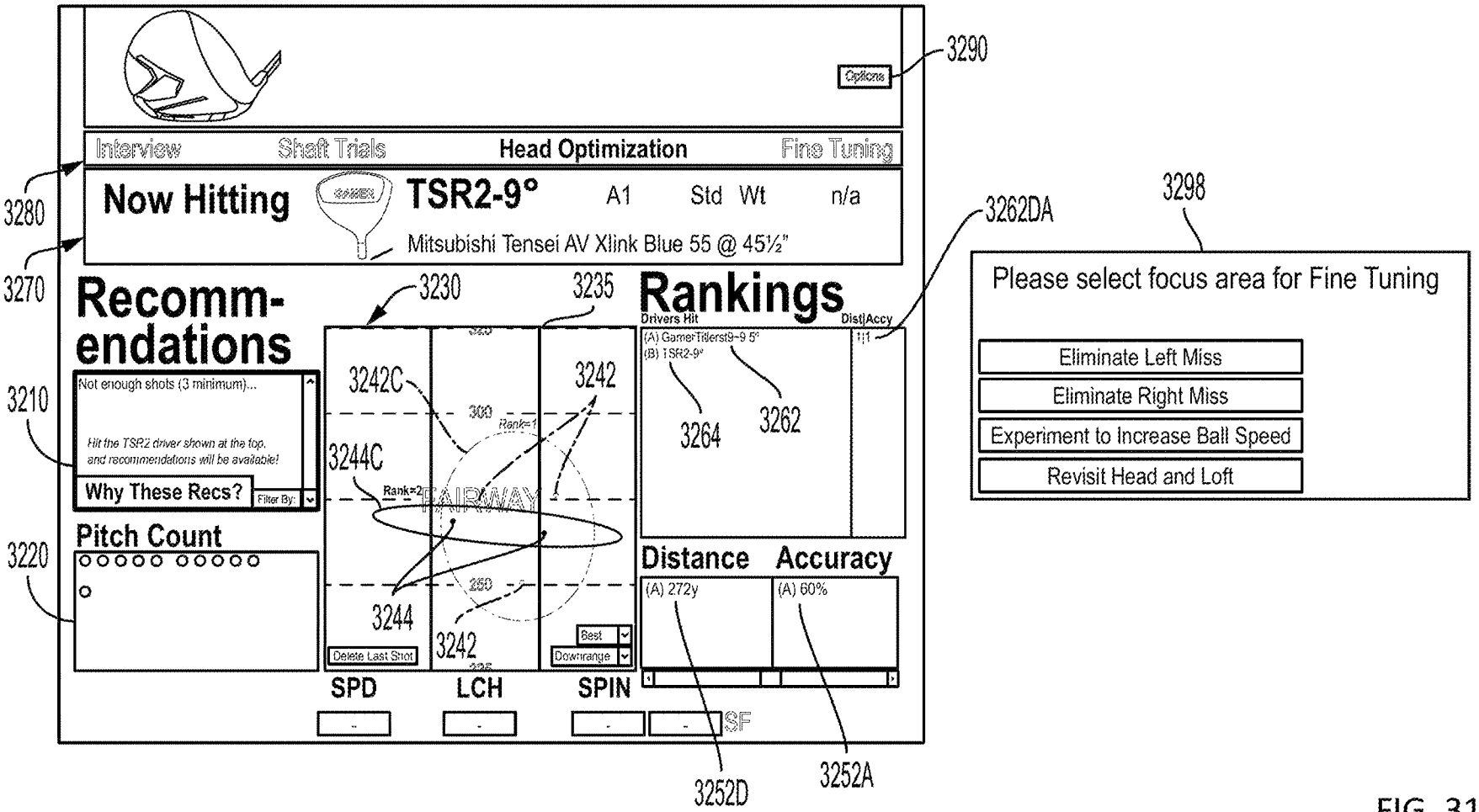
FIG. 31 depicts the second user interface of FIG. 27 during a Head Fitting Recommendation stage and according to an example.
Figure 32:
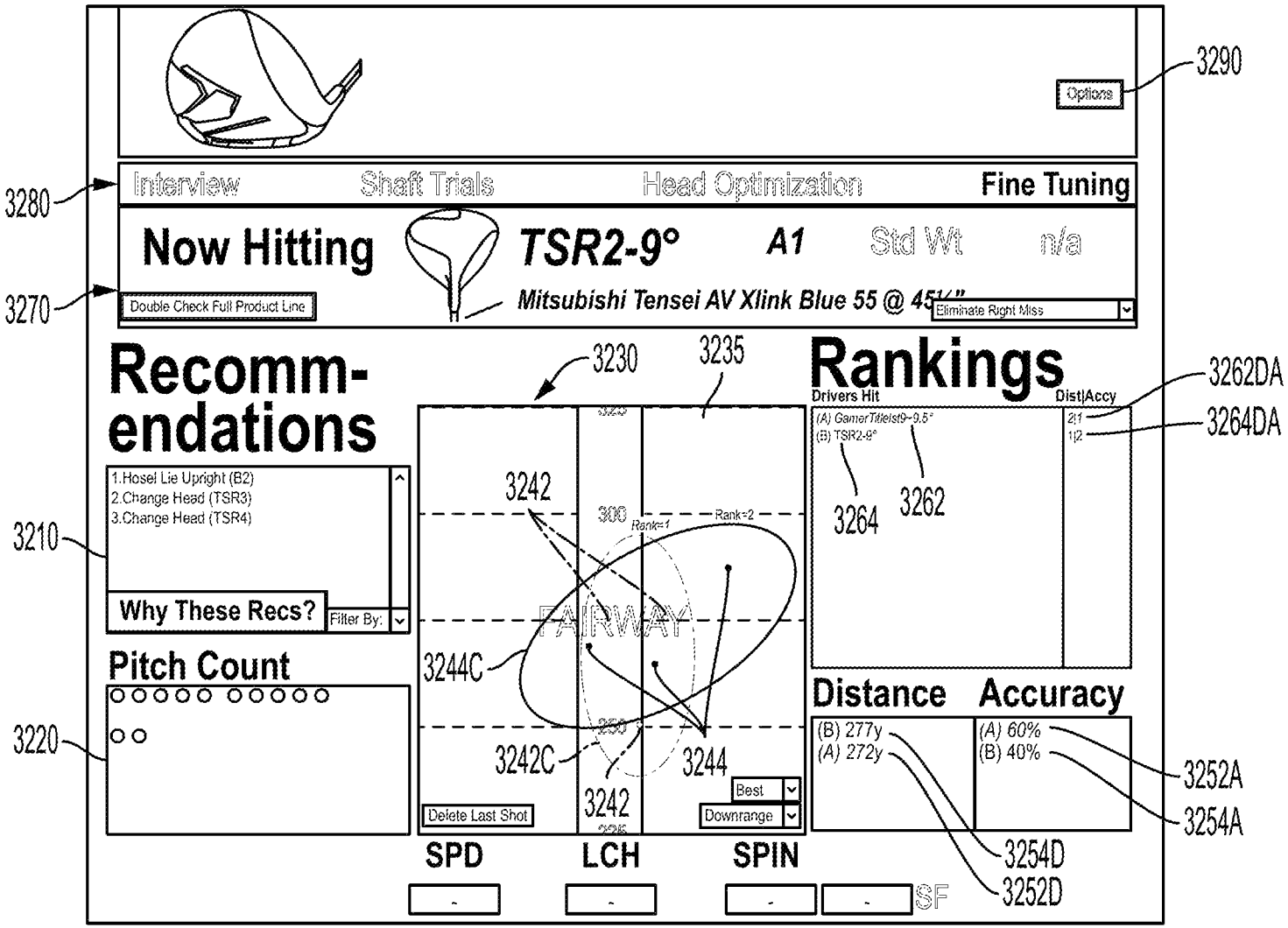
FIG. 32 depicts the second user interface of FIG. 27 during a Fine Tuning stage and according to an example.
Figure 33:
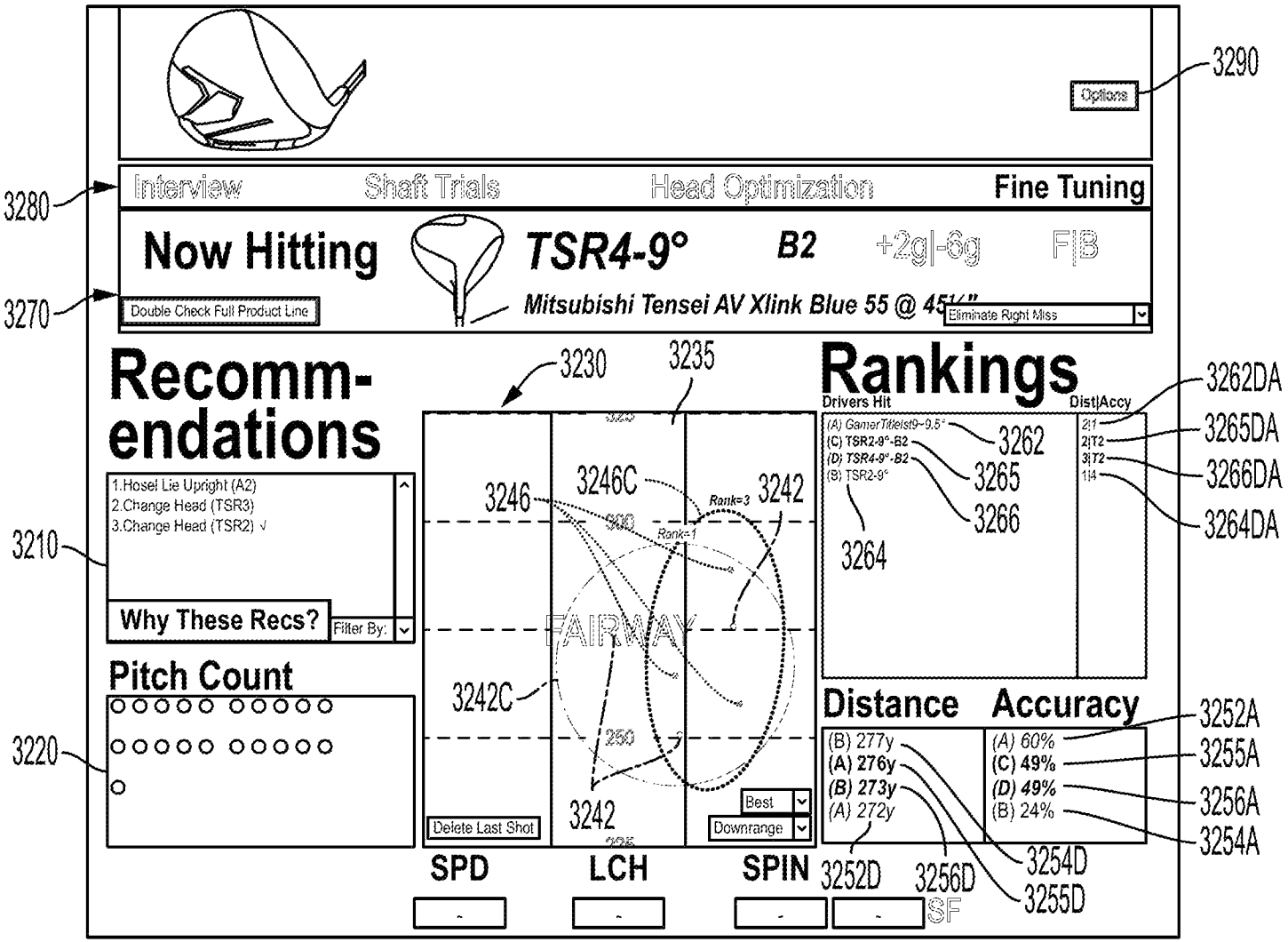
FIG. 33 depicts the second user interface of FIG. 27 during the Fine Tuning stage.
Figure 34:
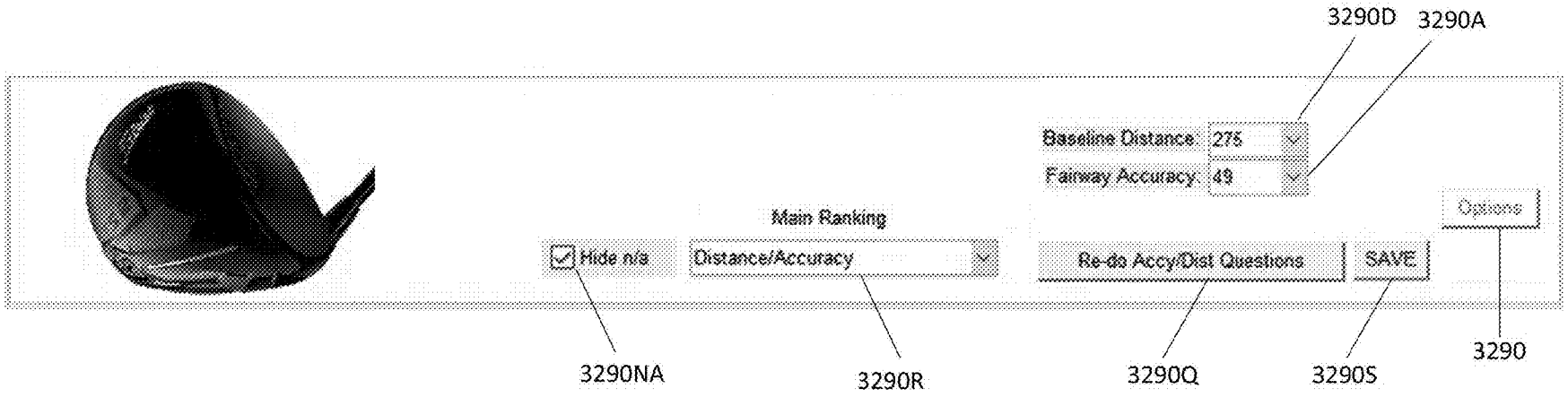
FIG. 34 depicts a top portion of the second user interface of FIG. 27 when a plurality of options are displayed.

FIG. 22 depicts a first user interface 3100 according to an example. FIG. 23 depicts some input fields of the first user interface 3100 of FIG. 22 according to an example. FIG. 24 depicts some other input fields of the first user interface 3100 of FIG. 22 according to an example. FIG. 25 depicts some other input fields of the first user interface 3100 of FIG. 22 according to an example. FIG. 26 depicts some other input fields of the first user interface 3100 of FIG. 22 according to an example. FIG. 27 depicts a second user interface 3200 during a Shaft Fitting Recommendation stage and according to an example. FIG. 28 depicts the second user interface 3200 of FIG. 27 during the Shaft Fitting Recommendation stage. FIG. 29 depicts the second user interface 3200 of FIG. 27 during the Shaft Fitting Recommendation stage. FIG. 30 depicts the second user interface 3200 of FIG. 27 during the Shaft Fitting Recommendation stage. FIG. 31 depicts the second user interface 3200 of FIG. 27 during a Head Fitting Recommendation stage and according to an example. FIG. 32 depicts the second user interface 3200 of FIG. 27 during a Fine Tuning stage and according to an example. FIG. 33 depicts the second user interface 3200 of FIG. 27 during the Fine Tuning stage. FIG. 34 depicts a top portion of the second user interface 3200 of FIG. 27 when a plurality of options are displayed. As described herein, controllable features of the first and second user interfaces 3100 and 3200 may be controlled by any suitable means, such as input devices including a keyboard, a mouse, a pen, a sound input device, and/or a touch input device (e.g., touchscreen), etc. The controllable features of the first and second user interfaces 3100 and 3200 may be controlled, for example, by a player (e.g., a golfer) or a professional fitter using the system to obtain a fitting recommendation for the player.

Referring to FIGS. 22-26, the first user interface 3100 may be used to receive, by the computing device 800, player input data. The first user interface 3100 may include one or more input fields, and the computing device 800 may be configured to receive the player input data as input into the one or more input fields of the first user interface 3100. The input fields may include a first input field 3101 for receiving information about whether a player is right handed or left handed; a second input field 3102 for receiving information about whether the player has his or her own golf club (e.g., his or her own driver golf club) with them; a third input field 3103 for receiving information about the manufacturer of the player's own golf club; a fourth input field 3104 for receiving information about the length of the player's own golf club shaft of the player's own golf club; a fifth input field 3105 for receiving information about the weight of the player's own golf club shaft; a sixth input field 3106 for receiving information about the flex of the player's own golf club shaft; a seventh input field 3107 for receiving information about the loft of the player's own golf club head of the player's own golf club; an eighth input field 3108 for receiving information about the player's handicap; a ninth input field 3109 for receiving information about the player's trajectory when hitting a golf ball with his or her own golf club (e.g., a low, medium, or high trajectory of a golf ball hit with the player's own driver); a tenth input field 3110 for receiving information about what the player's golf swing tempo when hitting a golf ball with his or her own golf club (e.g., whether the player's tempo is smooth, average, or quick); an eleventh input field 3111 for receiving information about what the player's average golf ball total distance when hitting a golf ball with his or her own golf club; a twelfth input field 3112 for receiving information about the player's accuracy (e.g., the player's perception or characterization of his or her own accuracy) when hitting a golf ball from the tee with his or her own golf club; a thirteenth input field 3113 for receiving information about the player's preferred golf club head model; a fourteenth input field 3114 for receiving information about the player's preference regarding whether to maximize golf ball carry distance or golf ball total distance; a fifteenth input field 3115 for receiving information about the player's preference regarding how important accuracy is to the player; and/or a sixteenth input field 3116 for receiving information about the player's preference regarding how important distance is to the player. In some examples, the first user interface 3100 may include an input field for receiving information about the player's fairway conditions (e.g., average fairway conditions encountered by the player or fairway conditions of a particular course) and/or an input field for receiving information about the player's rough conditions (e.g., average rough conditions encountered by the player or rough conditions of a particular course).

One or more of the input fields 3101-3116 may include different selectable values for the player or fitter to provide the player input data, as shown in the example first user interface 3100. For example, for the first input field 3101, a selection of any of RH (for if the player is right handed) or LH (for if the player is left handed) results in the corresponding player input data being received and stored by the system. In some examples, one or more of the input fields 3101-3116 may include an input box that can receive freeform text or numbers to provide the player input data.

In some examples, the computing device 800 is configured to cause all of the input fields 3101-3116 of the first user interface 3100 to be displayed concurrently. In some other examples, the computing device 800 is configured to cause the input fields 3101-3116 of the first user interface 3100 to be sequentially displayed in any order. For example, the computing device 800 may be configured to display the first input field 3101, to display the second input field 3102 in response to receiving information via the first input field 3101, to display the third input field 3103 in response to receiving information via the second input field 3102, etc. In some other examples, the computing device 800 is configured to cause groups of input fields from the input fields 3101-3116 to be sequentially displayed on the display 820, wherein, when a group of input fields is displayed, all of the input fields of the group are concurrently displayed. For example, referring to FIGS. 23-26, the first user interface 3100 may be configured to display a first group 3130 of input fields to ask initial questions and that includes, for example, the first and second input fields 3101 and 3102; a second group 3140 of input fields to receive information about the player's current golf club and that includes, for example, the third through seventh input fields 3103-3107; a third group 3150 of input fields to receive information about the player's performance and that includes, for example, the eighth to twelfth input fields 3108-3112; and a fourth group 3160 of input fields to receive information about the player's preferences (e.g., preferences of golf club and/or aspects of performance to be improved) and that includes, for example, the thirteenth to sixteenth input fields 3113-3116.

In some examples, the first user interface 3100 is configured to allow selection of one or more of the input fields 3101-3116 to be displayed on the display 820. For example, the first user interface 3100 may display a plurality of selectable tabs corresponding to the input fields 3101-3116 of the first user interface 3100, and the first user interface 3100 may be configured, upon the computing device 800 receiving selection of one of the selectable tabs, to display the input field corresponding to the selected tab. Accordingly, a person (e.g., player or fitter) entering the player input data may select and enter input into the input fields of the first user interface 3100 in any desired order, and the person may be able to return to an input field that previously received input and input new information into that input field.

Referring to FIG. 27, the second user interface 3200 may include a golf club selection menu 3210, a shot or pitch count representation 3220, a golf shot graphical representation 3230, a distance-accuracy representation 3250, a fitting recommendation representation 3260, a selected golf club representation 3270, a fitting stage representation 3280, and a selectable options element 3290.

The fitting stage representation 3280 may represent one or more stages of a fitting method, and the second user interface 3200 may change as the fitting method progresses through the stages. For example, the fitting method may include an interview stage (hereinafter "Interview" stage, which is represented in the fitting stage representation 3280 by the word "Interview"), a shaft fitting recommendation stage (herein "Shaft Fitting Recommendation" stage, which is represented in the fitting stage representation 3280 by the words "Shaft Trials"), a head fitting recommendation stage (herein "Head Fitting Recommendation" stage, which is represented in the fitting stage representation 3280 by the words "Head Optimization"), and a fine tuning head recommendation stage (herein "Fine Tuning" stage, which is represented in the fitting stage representation 3280 by the words "Fine Tuning"). The Shaft Fitting Recommendation stage may be a stage for generating a shaft fitting recommendation including one or more shaft related features (e.g., shaft weight, shaft length, shaft flex, shaft kick point, and/or shaft torque). Each of the Head Fitting Recommendation stage and the Fine Tuning stage may be for generating a head fitting recommendation including one or more head related features (e.g., head model, loft, hosel settings, and/or one or more adjustable weight options compatible with the head model). The Head Fitting Recommendation stage may be for generating a first head fitting recommendation including at least one head related feature, and the Fine Tuning stage may be for generating a second head fitting recommendation including at least the head related features of the first head fitting recommendation and one or more additional head related features. For example, the first head fitting recommendation may include head model and loft, and the second head fitting recommendation may include head model, loft, and one or both of hosel setting and one or more adjustable weight options.

In some examples, the current stage of the fitting method may be indicated by the corresponding words in the fitting stage representation 3280 being portrayed in an emphasized manner (such as a bold font) while the word(s) corresponding to the other stages are portrayed in the fitting stage representation 3280 without such emphasizing (e.g., without the bold font). For example, FIGS. 27-30 show the second user interface 3200 during the Shaft Fitting Recommendation stage, FIG. 31 shows the second user interface 3200 during the Head Fitting Recommendation stage, and FIGS. 32-33 show the second user interface 3200 during the Fine Tuning stage. However, the present disclosure is not limited thereto. The stages of the fitting method may be represented through other manners, such as by other words, letters, numbers, symbols, etc., and the fitting stage representation 3280 may indicate the current stage through other manners. For example, the fitting stage representation 3280 may indicate the current stage by illustrating words associated with the current stage and not illustrating the word(s) associated with the other stages. In some examples, the fitting stage representation 3280 may include selectable tabs respectively associated with the stages of the fitting method, and the second user interface 3200 may be configured, upon the computing device 800 receiving selection of one of the selectable tabs respectively associated with the stages of the fitting method, to present the second user interface 3200 in accordance with the stage of the selected tab. Accordingly, a person may control the order of the stages of the fitting method in some examples.

The first user interface 3100 may be displayed during the Interview stage. In some other examples, the first user interface 3100 is integral with the second user interface 3200 and is illustrated as a part of the second user interface 3200 during the Interview stage.

In some examples, the golf club selection menu 3210, the shot or pitch count representation 3220, the golf shot graphical representation 3230, the distance-accuracy representation 3250, and the fitting recommendation representation 3260 are displayed in each of the Shaft Fitting Recommendation stage, the Head Fitting Recommendation stage, and the Fine Tuning Recommendation Stage.

During each of the Shaft Fitting Recommendation stage, the Head Fitting Recommendation Stage, and the Fine Tuning Recommendation Stage, the computing device 800 may be configured to generate one or more recommended golf clubs for potentially improving a player's performance and to display the one or more recommended golf clubs in the golf club selection menu 3210. In some examples, the computing device 800 is configured to display only some features of the one or more recommended golf clubs in the golf club selection menu 3210. For example, the computing device 800 may be configured to display only shaft related features of the one or more recommended golf clubs in the golf club selection menu 3210 during the Shaft Fitting Recommendation stage, and the computing device 800 may be configured to display only head related features of the one or more recommended golf clubs during each of the Head Fitting Recommendation stage and the Fine Tuning stage. The computing device 800 may be configured to rank the one or more recommended golf clubs based on how much they are expected to improve the player's performance, and to display the one or more recommended golf clubs in the golf club selection menu 3210 according to their ranking. For example, during the Shaft Fitting Recommendation stage, the computing device 800 may be configured to generate one or more recommended shafts respectively corresponding to one or more recommended golf clubs, to rank the one or more recommended shafts, and to display the one or more recommended shafts in the golf club selection menu 3210 according to their ranking. During each of the Head Fitting Recommendation stage and the Fine Tuning Recommendation stage, the computing device 800 may be configured to generate one or more recommended heads respectively corresponding to one or more recommended heads, to rank the one or more recommended heads, and to display the one or more recommended heads on the golf club selection menu 3210 according to their ranking.

The computing device 800 may be configured to receive selection of a golf club from among the one or more recommended golf clubs and display information about the selected golf club on the selected golf club representation 3270. For example, the selected golf club representation 3270 may include both shaft related features and head related features of the selected golf club. The player may then take one or more golf shots with the selected golf club, and the launch monitor 840 may be configured to measure or capture ball flight characteristics of the one or more golf shots. The launch monitor 840 may be configured to transmit information about the ball flight characteristics to the computing device 800. The computing device 800 may be configured to associate ball flight characteristics measured by the launch monitor 840 and received by the computing device 800 with the selected golf club. The player or fitter may select one, some, or all of the one or more recommended golf clubs and take one or more golf shots with each selected golf club, and the computing device 800 may be configured to receive ball flight characteristics for golf shots with each of the selected golf clubs.

The computing device 800 may be configured, in response receiving the ball flight characteristics (e.g., from the launch monitor 840), to represent (or be able to represent) at least some of the captured ball flight characteristics on the golf shot graphical representation 3230. The computing device 800 may be configured, in response to receiving, ball flight characteristics for a set number (e.g., 1, 2, 3, 4, or 5) of golf shots from a selected golf club from among the one or more recommended golf clubs, to generate a computed distance associated with the selected golf club and display the computed distance on the distance-accuracy representation 3250 (e.g., on a computed distance representation 3258 of the distance-accuracy representation 3250), and to generate a computed accuracy associated with the selected golf club and display the computed accuracy on the distance-accuracy representation 3250 (e.g., on a computed accuracy representation 3259 of the distance-accuracy representation 3250). The computed distance associated with a golf club may be generated based on at least some of the ball flight characteristics for the one or more golf shots taken with the golf club and, in some examples, also on the player input data. The computed accuracy associated with a golf club may be generated based on at least some of the ball flight characteristics for the one or more golf shots taken with the golf club and, in some examples, also on the player input data.

The computing device 800 may be configured to generate a fitting recommendation and to represent the fitting recommendation on the fitting recommendation representation 3260. The fitting recommendation may be generated based on the ball flight characteristics received by the computing device 800 and also on the player input data received by the computing device 800. For example, the fitting recommendation may be generated by generating a plurality of potential fitting recommendations respectively corresponding to at least some (e.g., all) golf clubs for which ball flight characteristics for one or more golf shots have been received by the computing device 800 (e.g., for which ball flight characteristics for at least the set number of golf shots have been received by the computing device 800), ranking the plurality of potential fitting recommendations, and setting the fitting recommendation to be the highest ranked potential fitting recommendation or setting the fitting recommendation to be at least some of the plurality of potential fitting recommendations according to their ranking. Each of the plurality of potential fitting recommendations may include at least some features of the corresponding golf club. For example, during the Shaft Fitting Recommendation stage, each potential fitting recommendation may include one or more shaft related features of the corresponding golf club. During each of the Head Fitting Recommendation stage and the Fine Tuning stage, each of the plurality of potential fitting recommendations may include one or more head related features.

Additional details of the Shaft Fitting Recommendation stage will be provided with reference to FIGS. 27-30.

During the Shaft Fitting Recommendation stage, one or more recommended shafts respectively included in one or more recommended golf clubs may be generated and displayed on the golf club selection menu 3210 may be selectable. The computing device 800 may be configured, in response to receiving a selection of the one or more recommended shafts, to display at least some information (e.g., one or more shaft related features and one or more head related features) about the selected golf club including the selected shaft on the selected golf club representation 3270, and to associate ball flight characteristics captured (e.g., subsequently captured) by the launch monitor 840 with the selected golf club. For example, in FIGS. 27-30, the selected golf club representation 3270 may display, during the Shaft Fitting Recommendation stage, the shaft weight, shaft length, shaft flex, head model, and head loft of the selected golf club. The information displayed in the selected golf club representation 3270 can provide confirmation to the player about which golf club he or she should be taking golf shots. The player may then take one or more golf shots with the selected golf club, and ball flight characteristics of the one or more golf shots may be captured by the launch monitor 840 and received by the computing device 800 (e.g., from the launch monitor 840).

The computing device 800 may be configured to generate the one or more recommended shafts based on the player input data and/or ball flight characteristics of one or more golf shots taken during the Shaft Fitting Recommendation stage. The computing device 800 may be configured to update (e.g., re-generate) the one or more recommended golf clubs in response to receiving ball flight characteristics of one or more golf shots (e.g., a set number of golf shots, such as 1, 2, 3, 4, or 5 golf shots) taken with a selected shaft from among the one or more recommended shafts.

In some examples, the computing device 800 may generate the one or more recommended shafts based on the player input data, including, for example, whether the player has his or her own driver with them (e.g., information received via the second input field 3102); the manufacturer of the player's own golf club (e.g., information received via the third input field 3103); the length of the player's own golf club shaft (e.g., information received via the fourth input field 3104); the weight of the player's own golf club shaft (e.g., information received via the fifth input field 3105); the flex of the player's own golf club shaft (e.g., information received via the sixth input field 3106); what the player's handicap is (e.g., information received via the eighth input field 3108); what the player's golf swing tempo is when hitting a golf ball with his or her own golf club (e.g., information received via the tenth input field 3110); the player's preference regarding how important accuracy is (e.g., information received via the fifteenth input field 3115); and/or the player's preference regarding how important distance is (e.g., information received via the sixteenth input field 3116).

If the player has his or her own golf club with them, the computing device 800 may be configured to include the player's own shaft (e.g., the player's own golf club) in the one or more recommended shafts. If the player does not have his or her own golf club with them, the computing device 800 may be configured to generate recommended shafts based on (e.g., similar to, or the same as) the player's own shaft. The information about the manufacturer of the player's current golf club may affect whether the computing device 800 is configured to include the player's own shaft in the one or more recommended shafts. For example, if the head of the player's current golf club is of a manufacturer that is incompatible with available shafts (e.g., in accordance with an inventory database), then the one or more recommended shafts may not include the player's own shaft even if the player has his or her current golf club with them. However, if the head of the player's current golf club is of a manufacturer that can be used with available shafts, then the one or more recommended shafts may be generated to include the player's own shaft. The length of the player's own shaft may cause the lengths of the one or more recommended shafts to be closer to the length of the player's shaft. The weight of the player's own shaft may cause the weights of the one or more recommended shafts to be closer to the weight of the player's shaft. The flex of the player's own shaft may cause the flexes of the one or more recommended shafts to be closer to the flex of the player's own shaft. The player's golf swing tempo may affect the flexes of the one or more recommended shafts. For example, a stiffer shaft may be better suited for a player with a faster tempo, and a more flexible shaft may be better suited for a player with a slower tempo. How important distance and accuracy is to the player may also affect the lengths and the weights of the one or more recommended shafts. For example, a greater length and a smaller weight can increase distance and decrease accuracy, while a shorter length and a greater weight can reduce distance and increase accuracy. However, these are just examples of what types of player input data the computing device 800 may be configured to base its generation of the one or more recommended shafts on, and how the computing device 800 may use these types of player input data to generate the one or more recommended shafts. However, the present disclosure is not limited thereto, and other examples are within the scope of the present disclosure.

In some examples, the computing device 800 generates one or more recommended initial shafts based on the player input data (e.g., without being based on ball flight characteristics). The computing device 800 may then, in response to receiving ball flight characteristics of one or more golf shots taken with a selected shaft (e.g., with a selected golf club including the selected shaft) from the one or more recommended initial shafts, update the one or more recommended shafts based on both the player input data and the ball flight characteristics of the one or more golf shots taken with the selected shaft. In some examples, the computing device 800 may be configured to recommend the player's own golf club (e.g., the player's own driver or other metalwood) or a golf club including the shaft of the player's own golf club in response to receiving player input data (e.g., data received via the second input field 3102) about whether the player has his or her driver with them and player input data (e.g., data received via at least some of the third through seventh input fields 3103-3107) about the player's driver. Ball flight characteristics from golf shots taken with the player's own golf club (or a golf club including the shaft of the player's own driver) may provide a good starting point from which to recommend other shafts. If the player input data received by the computing device 800 indicates that the player does not have his or her own driver with them, or if the player input data received by the computing device 800 indicates that the player's own driver is of a manufacturer whose head is incompatible with shafts available for the player to test (e.g., shafts indicated in an inventory database of shafts available for the player to use), then the computing device 800 may generate one or more recommended initial shafts that do not include the shaft of the player's own golf club. However, the one or more recommended initial shafts may be based on player input data about the player's own golf club (e.g., player input data received from the third to seventh input fields 3103-3107), for example, so that the one or more recommended initial shafts have one or more shaft features (e.g., similar shaft weight, similar shaft length, similar shaft flex, similar shaft kick point, and/or similar shaft torque) similar to corresponding one or more shaft features of the player's own golf club.

FIG. 27 shows the second user interface 3200 before any golf shots have been taken during the Shaft Fitting Recommendation stage. In FIG. 27, the computing device 800 has generated one recommended golf club that is the player's own golf club (identified as "1. Gamer 60@45½" in the golf club selection menu 3210 and represented with additional details on the selected golf club representation 3270). In the selected golf club representation 3270, the shaft weight is 60 grams and is represented by "60", the shaft length is 45.5 inches and is represented by "45½", the shaft flex is stiff and is represented under the word "Flex" by the letter "S", the model of the golf club head is represented by the words "Gamer Titleist", and the loft is 9-9.5 degrees and is identified by the text "9~9.5°". Similar features of other selected golf club heads may be shown in the selected golf club representation 3270 in a similar or same manner as they are shown in FIG. 27. The computing device 800 generates, in response to receiving the ball flight characteristics of three golf shots taken with the player's own golf club, and based on the player input data and the ball flight characteristics of the three golf shots taken with the player's own golf club, two additional recommended shafts as shown in the golf club selection menu 3210 in FIGS. 29-30. These two additional shafts are identified in the golf club selection menu 3210 as "2. Mitsubishi Tensei AV Xlink Blue 55@45½" (which is shown on the selected golf club representation 3270 in FIG. 29) and "3. Project X HZRDUS CB 50@45½" (which is shown on the selected golf club representation 3270 in FIG. 30). The former has a shaft weight of 55 grams and a shaft length of 45.5 degrees, and the latter has a shaft weight of 50 grams and a shaft length of 45.5 degrees.

In some examples, in response to the computing device 800 receiving ball flight characteristics for a set number of golf shots (e.g., 1, 2, 3, 4, or 5 golf shots) with a selected shaft, the computing device 800 may display on the display 820 one or more feedback input fields configured to receive feedback information about the selected shaft, for example, feedback information about how the selected shaft felt to the player while taking the set number of golf shots with the selected golf club (e.g., with the selected golf club including the selected shaft). With reference to FIG. 28, the computing device 800 may be configured to display on the display 820 a first feedback input field 3295 to receive information about how the selected shaft felt overall; a second feedback input field 3296 to receive information about how the length of the selected shaft felt; and/or a third feedback input field 3297 to receive information about how the weight of the selected shaft felt. The feedback input fields may be configured to receive information, for example, by receiving a selection from among a plurality of selectable elements respectively associated with different information about the selected shaft, by receiving information (e.g., freeform text) inputted into a field, etc. In some examples, the computing device 800 is configured to update the one or more recommended shafts based on the information received via the feedback input fields (e.g., in combination with the player input data received by the computing device during the Interview stage and/or the ball flight characteristics of the set number of golf shots taken with the selected shaft).

In some examples, the computing device 800 may generate the one or more recommended shafts based on an inventory database (e.g., a shaft inventory database). The inventory database may, for example, include information relating to which shafts are available for the player to use (e.g., available at the location at which the fitting method is being provided) during the fitting method, and the computing device 800 may generate the one or more recommended shafts based on a restriction that the one or more recommended shafts must be shafts that are included in the inventory database. In some other examples, the computing device 800 generates the one or more recommended shafts without being based on a shaft inventory database.

The computing device 800 may be configured to rank the one or more recommended shafts based on the player input data, the ball flight characteristics of the one or more golf shots taken with the selected golf clubs during the Shaft Fitting Recommendation stage, and/or the feedback information received by the computing device 800 after the set number of golf shots have been taken with each selected golf club. The computing device 800 may be configured to rank the one or more shafts displayed on the golf club selection menu 3210 according to (e.g., based on a calculation for) how well they are estimated to improve the player's performance (e.g., how well they are expected to improve one or more ball flight characteristics, such as total distance and/or accuracy).

The golf club selection menu 3210 may include a selection explanation element 3218. The computing device 800 may be configured, upon receiving a selection of the selection explanation element 3218, to display on the display 820 additional details about the one or more recommended shafts. For example, the computing device 800 may be configured to display an explanation user interface including the additional details about the one or more recommended shafts, for example, an explanation as to why the one or more recommended shafts were recommended and information relating to the ranking of the one or more shafts.

In some examples, the computing device 800 may be configured to generate the one or more recommended golf clubs during the Shaft Fitting Recommendation stage such that the one or more recommended golf clubs all have the same golf club head but different shafts. This can allow for the affects of the different shafts to be analyzed (e.g., by the computing device 800) without being influenced by changes in the golf club head. However, the present disclosure is not limited thereto. In some examples, the computing device 800 may generate at least some one the one or more recommended shafts during the Shaft Fitting Recommendation stage to have different golf club heads.

The computing device 800 may be configured, in response to receiving (e.g., from the launch monitor 840) ball flight characteristics for a golf shot, to represent at least some of the ball flight characteristics on the golf shot graphical representation 3230. For example, the golf shot graphical representation may include a golf ball speed representation 3231 to represent (e.g., via display of a numerical value or by another manner) the speed of the golf ball hit during the golf shot after impact; a golf ball launch angle representation 3232 to represent (e.g., via display of a numerical value or by another manner) the launch angle of the golf ball hit during the golf shot; a golf ball spin representation 3233 to represent (e.g., via display of a numerical value or by another manner) the spin of the golf ball hit during the golf shot; a smash factor representation 3234 to represent (e.g., via display of a numerical value or by another manner) the smash factor of the golf shot (e.g., the amount of energy transferred to the golf ball during the golf shot, for example, calculated as the ratio of golf ball speed to club head speed); and/or a golf ball position representation 3235. The golf ball position representation 3235 may include a fairway chart having a first axis corresponding to the golf ball's distance (e.g., longitudinal distance), which may be carry distance or total distance depending on settings, along a first direction and a second axis corresponding to the golf ball's lateral distance (e.g., a distance away from a center line along a second direction perpendicular to the first direction). In the depicted example, the golf ball position representation 3235 includes a fairway chart having the first axis along a vertical (i.e., up-down) direction and having the second axis along a horizontal (i.e., left-right) direction. The first axis may therefore represent how far down the fairway the golf ball goes after the golf shot, and the second axis may represent how far the golf ball strays to the left or right from the tee.

The computing device 800 may be configured to display an indicator (e.g., a symbol, a dot, a circle, a square, etc.) on the fairway chart at a position along the first axis corresponding to the golf ball's distance and at a position along the second axis corresponding to the golf ball's lateral distance. The indicator may therefore visually indicate the position along the fairway where the golf ball landed after the golf shot. In some examples, such as in the depicted example, the fairway chart may include one or more lines (e.g., two lines) generally extending along the first direction parallel to the first axis (e.g., two straight lines extending parallel along the first direction) to indicate boundaries between the fairway and the rough. The fairway may be a virtual fairway that does not directly correspond to the physical environment where the golf balls are being hit, such as an indoor environment where golf balls are being hit into a net or screen.

The computing device 800 may be configured to display golf shots made with a same golf club with the same, or similar, indicators, and to display a circumscription line around (e.g., surrounding) the golf shots made with the same golf club. For example, in FIG. 28, three golf shots with a first golf club 3261 are represented by three first golf shot indicators 3241, which are circumscribed by a first golf shot circumscription line 3241C. In FIG. 29, three golf shots with a second golf club 3262 are represented by three second golf shot indicators 3242, which are circumscribed by a second golf shot circumscription line 3242C. In FIG. 30, three golf shots with a third golf club 3263 are represented by three third golf shot indicators 3243, which are circumscribed by a third golf shot circumscription line 3243C.

The computing device 800 may be configured to selectively represent golf shots (e.g., selectively display golf shot indicators) on the fairway chart. For example, the computing device 800 may be configured to selectively display groups of golf shots respectively corresponding to the golf clubs used to take the groups of golf shots. By displaying some of the golf shots while not displaying other golf shots, the fairway chart may be easier to read compared to if all of the golf shots are displayed. In some examples, the computing device 800 may be configured to display on the fairway chart the golf shots taken with the golf club having the highest rank in the fitting recommendation representation 3260 and one other group of golf shots taken with one other golf club. The other group of golf shots may be (e.g., by default) the group of golf shots associated with the golf club currently being used to hit golf shots. However, the second user interface 3200 may be controllable to allow (e.g., by selecting one of the shafts in the fitting recommendation representation 3260) to switch the other group of golf shots from the group of golf shots associated with the golf club currently (or most recently) used to hit golf shots to another group of golf shots associated with another golf club. For example, in each of FIGS. 29 and 30, a total of nine golf shots have been taken (three with the first golf club 3261, three with the second golf club 3262, and three with the third golf club 3263) as indicated by the pitch count representation 3220. While the three golf shots taken with the third golf club 3263 may have been hit last among the nine golf shots and are displayed in the fairway chart in FIG. 30, FIG. 29 shows the fairway chart after the nine shots have been taken and in response to the second user interface 3200 being controlled (e.g., by selection of the second golf club 3262 in the fitting recommendation representation 3260) to show the golf shots taken with the second golf club 3262.

In some examples, the second user interface 3200 includes a selectable delete last shot element 3235, and the computing device 800 is configured, in response to receiving selection of the delete last shot element 3235, to delete the most recently received ball flight characteristics. This can allow the player or the fitter to delete a golf shot that is so unusual, inaccurate, or not representative of the player's ability that it would be desirable to delete the ball flight characteristics for that golf shot and re-do the deleted golf shot.

For each golf club for which golf shots have been taken and corresponding ball flight characteristics have been received by the computing device 800, the computing device 800 may be configured to generate a computed distance and a computed accuracy. The computing device 800 may be configured to display the computed distance and the computed accuracy on the distance-accuracy representation 3250. For example, the distance-accuracy representation 3250 may include a computed distance representation 3258 and a computed accuracy representation 3259, and the computing device 800 may be configured to display (e.g., via a numerical value, such as a distance value in yards, or via another manner) the computed distance on the computed distance representation 3258 and to display (e.g., via a numerical value, such as a percentage value, or via another manner) the computed accuracy on the computed accuracy representation 3259. In the depicted example, as shown in FIGS. 29-30, a first computed distance 3251D and a first computed accuracy 3251A corresponding to the first golf club 3261 are displayed in the distance-accuracy representation 3250, a second computed distance 3252D and a second computed accuracy 3252A corresponding to the second golf club 3262 are displayed in the distance-accuracy representation 3250, and a third computed distance 3253D and a third computed accuracy 3253A corresponding to the third golf club 3263 are displayed in the distance-accuracy representation 3250.

In some examples, a golf club shown in the fitting recommendation representation 3260, the computed distance value associated with the golf club, and the computed accuracy value associated with the golf club may all be represented in a manner to indicate that the computed distance and the computed accuracy are associated with the golf club. For example, in the depicted example, the first golf club 3161, the first computed distance 3251D, and the first computed accuracy 3251A are each represented with together with the letter (A) to indicate that the first computed distance 3251D and the first computed accuracy 3251A are associated with the first golf club 3261 in the fitting recommendation representation 3260. Similarly, the second golf club 3162, the second computed distance 3252D, and the second computed accuracy 3252A are each represented together with the letter (B), and the third golf club 3163, the third computed distance 3253D, and the third computed accuracy 3253A are each represented together with the letter (C). However, this is just an example, and other manners of indicating an association between a golf club, a computed distance, and a computed accuracy are within the scope of the present disclosure.

In some examples, one or both of the computed distance and the computed accuracy associated with a golf club may be generated based on both the ball flight characteristics of the golf shots taken with the golf club and the player input data. In some other examples, one or both of the computed distance and the computed accuracy may be generated based on the ball flight characteristics (e.g., golf ball total distance and/or lateral golf ball distance) of the golf shots taken with the golf club (e.g., without being based on the player input data).

One or both of the computed distance and the computed accuracy may be based on the player input data, including, for example, the player's handicap. The player's handicap may affect, for example, an algorithm used to generate the computed distance and/or an algorithm used to generate the computed accuracy. For example, the computing device 800 may be configured, in response to the player's handicap being high, to generate the computed distance for a golf club using a first distance algorithm that gives more weight to ball flight characteristics (e.g., golf ball total distance) of a golf shot having a greatest golf ball distance from among the golf shots taken with the golf club than the other golf shots taken with the golf club, and/or to generate the computed accuracy for the golf club using a first accuracy algorithm that gives more weight to ball flight characteristics (e.g., golf ball lateral distance) of a golf shot landing nearest to a center of the fairway on the fairway chart from among the golf shots taken with the golf club. The computed device 800 may be configured, in response to the player's handicap being low, to generate the computed distance for a golf club using a second distance algorithm that weighs the ball flight characteristics of the golf shots taken with the golf club more equally than the first distance algorithm does, and/or to generate the computed accuracy for the golf club using a second accuracy algorithm that weights the ball flight characteristics of the golf shots taken with the golf club more equally than the first accuracy algorithm does.

The computed distance and/or the computed accuracy may be affected by other player input data, such as, for example, the player's average golf ball distance (e.g., golf ball total distance and/or golf ball carry distance) when hitting with his or her own golf club; the player's accuracy when hitting from the tee with his or her own golf club; the player's preference regarding whether to maximize golf ball carry distance or golf ball total distance; the player's preference regarding how important accuracy is; and/or the player's preference regarding how important distance is (e.g., how important distance is to the player relative to how important accuracy is to the player). The computed distance and/or the computed accuracy may be affected by various other ball flight characteristics of golf shots taken during the fitting method (e.g., during the current stage of the fitting method) other than golf ball distance and golf ball lateral distance, for example, ball speed, launch angle, ball spin, and smash factor. In some examples, the computed distance and/or the computed accuracy, during the Shaft Fitting Recommendation stage, may be based on the feedback information about the shafts of the golf clubs used to take golf shots during the Shaft Fitting Recommendation stage.

The computing device 800 may be configured to rank the shafts with which golf shots have been taken and corresponding ball flight characteristics have been received by the computing device 800. For example, the computing device 800 may be configured to generate a plurality of potential shaft fitting recommendations respectively corresponding to the shafts with which golf shots have been taken and corresponding ball flight characteristics have been received by the computing device, and to rank the plurality of potential shaft fitting recommendations. Each potential shaft fitting recommendation may include one or more shaft related features (e.g., shaft weight, shaft length, shaft flex, shaft kick point, and/or shaft torque) of the corresponding shaft. The computing device 800 may be configured to define the shaft fitting recommendation as the highest ranked shaft (or highest ranked shaft fitting recommendation), or as the plurality of shafts (or the plurality of shaft fitting recommendations) according together with their rankings.

In some examples, the computing device 800 may be configured to rank the shafts (or potential shaft fitting recommendations) based on the ball flight characteristics of the golf shots taken with the shafts and/or the player input data. The player input data that the computing device 800 may base its ranking of the shafts on may include, for example, the player's handicap; the player's average golf ball total distance when hitting with his or her own golf club; the player's accuracy when hitting from the tee with his or her own golf club; the player's preference regarding whether to maximize golf ball carry distance or golf ball total distance; the player's preference regarding how important accuracy is; and/or the player's preference regarding how important distance is.

For example, the computing device 800 may be configured to rank the shafts based at least in part on the computed distances and computed accuracies of the shafts, which may be based on the player's handicap as described herein. In some examples, the computing device 800 generates a baseline golf ball total distance based on the information about the player's average golf ball total distance when hitting with his or her own golf club and/or on the player's handicap, and the computing device 800 ranks the shafts based on how the respective computed distances of the shafts differ from the baseline golf ball total distance. The computing device 800 may generate a baseline accuracy based on the player's accuracy when hitting from the tee with his or her own golf club and/or on the player's handicap, and the computing device 800 may rank the shafts based on how the respective computed accuracies of the shafts differ from the baseline accuracy. The computing device 800, in ranking the shafts, may give more weight to computed distance than to computed accuracy, or vice versa, based on how important the player has indicated accuracy and distance are to the player. For example, if the player indicates that distance is more important than accuracy, then the computing device 800 may give more weight to computed distance than to computed accuracy when ranking the shafts.

The computing device 800 may be configured to display a ranking characterization for each shaft displayed in the fitting recommendation representation 3260. For example, the fitting recommendation representation 3260 may include a golf club column 3268 to display golf clubs (or shafts or heads) and a ranking characterization column 3269 to display the ranking characterization for each of the golf clubs displayed in the golf club column 3268. The ranking characterization may include information showing one or more aspects of how the golf clubs in the golf club column 3268 are comparable. In the depicted example, the ranking characterization includes information about how the computed distance and computed accuracy of the corresponding golf club respectively ranks against the computed distances and computed accuracies of the other golf clubs displayed in the golf club column 3268. For example, in the depicted example shown in FIG. 30, a first ranking characterization 3261DA is associated with the first golf club 3261 and indicates that the first computed distance 3251D ranks second and that the first computed accuracy 3251A ranks second, a second ranking characterization 3262DA is associated with the second golf club 3262 and indicates that the second computed distance 3252A ranks third and that the second computed distance 3252A ranks first, and a third ranking characterization 3263DA is associated with the third golf club 3263 and indicates that the third computed distance 3253D ranks first and that the third computed accuracy 3253A ranks third.

The second user interface 3200 may include a selectable shaft fitting recommendation completion element 3299. The computing device 800 may be configured to conclude the Shaft Fitting Recommendation stage upon receiving selection of the shaft fitting recommendation completion element 3299. In some examples, the computing device 800 may initiate the Head Fitting Recommendation stage in response to receiving selection of the shaft fitting recommendation completion element 3299. As explained above, the shafts displayed in the fitting recommendation representation 3260 may be selectable, and the computing device 800 may initiate the Head Fitting Recommendation stage with whichever of the shafts from the fitting recommendation representation 3260 is selected when the computing device 800 receives the selection of the shaft fitting recommendation completion element 3299. In some other examples, the computing device 800 may, in response to receiving the selection of the shaft fitting recommendation completion element 3299, display on the display 820 an input field to receive a selection of one of the shafts displayed in the fitting recommendation representation 3260.

During the Head Fitting Recommendation stage, a head fitting recommendation may be generated. The computing device 800 and the second user interface 3200 may function in at least some aspects in a manner similar to, or the same as, the manner in which the computing device and the second user interface 3200 may function during the Shaft Fitting Recommendation stage. In some examples, the computing device 800 is configured to perform the Head Fitting Recommendation stage after the Shaft Fitting Recommendation stage. In some other examples, the computing device 800 is configured to perform the Head Fitting Recommendation stage (e.g., both the Head Fitting Recommendation stage and the Fine Tuning stage) before the Shaft Fitting Recommendation stage.

During the Head Fitting Recommendation stage, the computing device 800 may generate one or more recommended golf clubs respectively including one or more recommended heads and display the one or more recommended heads in the golf club selection menu 3210. In some examples, such as the depicted example shown in FIG. 31, the computing device 800 may show an initial golf club in the selected golf club representation 3270 and prompt (e.g., display instructions for) a player to hit one or more golf shots with the initial golf club before generating one or more additional recommended heads and displaying them in the golf club selection menu 3210. The computing device 800 may be configured, upon receiving ball flight characteristics of the one or more golf shots taken with the initial recommended head, to generate the one or more additional recommended heads. In the depicted example, the initial golf club is a fourth golf club 3264 having the second shaft of the second golf club 3262 that was selected during the Shaft Fitting Recommendation stage, and a head having a TSR2 model, a 9 degree loft, an A1 hosel setting.

The one or more recommended heads may each include one or more head related features (e.g., a head model, loft, hosel setting, and/or one or more adjustable weight options compatible with the head model). For example, each of the one or more recommended heads may include a head model and a head loft. The computing device 800 may be configured to generate the one or more recommended heads based on the player input data and/or ball flight characteristics for golf shots taken during the fitting method (e.g., during the Head Fitting Recommendation stage and/or the Shaft Fitting Recommendation stage). For example, the ball flight characteristics taken with the golf club having the shaft that was ultimately selected at the end of the Shaft Fitting Recommendation stage may be used during the Head Fitting Recommendation stage. Such ball characteristics can provide a useful starting point for comparison purposes while the player tests new golf clubs having different heads during the Head Fitting Recommendation stage. For example, in the depicted example, the second shaft of the second golf club 3262 was ultimately selected during the Shaft Fitting Recommendation stage, and the ball flight characteristics of the golf shots taken with the second golf club 3262 are depicted as being included during the Head Fitting Recommendation stage in FIG. 31.

In some other examples, no ball flight characteristics captured during the Shaft Fitting Recommendation stage are used during the Head Fitting Recommendation stage, and the computing device 800 may be configured to generate the initial recommended head (or one or more initial recommended heads) based on the player input data (e.g., without being based on any ball flight characteristics measured during the Shaft Fitting Recommendation stage). The computing device 800 may be configured to update the one or more recommended heads displayed in the golf club selection menu 3210 in response to receiving ball flight characteristics of one or more golf shots (e.g., a set number of golf shots, such as 1, 2, 3, 4, or 5 golf shots) with the initial recommended head (or with a head from one or more initial recommended heads).

The computing device 800 may be configured to generate the one or more recommended heads based on the player input data, including, for example, information about whether the player is right handed or left handed; whether the player has his or her own driver with them; the manufacturer of the player's own golf club (e.g., the player's own driver or other metalwood); the loft of the player's own golf club head; what the player's handicap is; what the player's trajectory is when hitting a golf ball with his or her own golf club; the player's preferred golf club head model; the player's preference regarding whether to maximize golf ball carry distance or golf ball total distance; the player's preference regarding how important accuracy is; and/or the player's preference regarding how important distance is. However, the present disclosure is not limited thereto, and the generating of the one or more recommended heads may be based on other player input data.

Whether the player is right handed or left handed may affect which heads are available, for example, in an inventory database (e.g., a head inventory database including information on which heads are available to the player to use during the fitting method), and the computing device 800 may be configured to generate only recommended heads that are indicated to be available in the inventory database.

If the player has his or her own golf club with them, then the computing device 800 may include the player's own head in the one or more recommended heads (e.g., the prompted initial head or the one or more initial recommended heads). If the player does not have his or her own golf club with them, then the computing device 800 may generate recommended heads similar (e.g., similar in loft and/or similar head model) to the player's own golf club head.

If the shaft of the player's own golf club is of a manufacturer that is incompatible with heads available for the player to use (e.g., as indicated by the inventory database) during the Head Fitting Recommendation stage, then the computing device 800 may be configured to omit the player's own golf club head even if the player has his or her own golf club with them.

The computing device 800 may be configured to base the lofts of the one or more recommended heads based on the loft of the player's own golf club and the player's trajectory. For example, if the loft of the player's own golf club head is low and the player's trajectory is also low, then the computing device 800 may be configured to recommend heads having a higher loft than the player's own golf club head. However, if the loft of the player's own golf club head is low and the player's trajectory is medium or high, the computing device 800 may be configured to recommend heads having a similar loft as the loft of the player's own golf club head.

The computing device 800 may be configured to recommend heads similar to, or the same as, the player's preferred golf club head model. For example, if the player indicates that they prefer a TSR3 model golf club head, then the computing device 800 may be more likely to recommend the TSR3 model in its one or more recommended heads.

If the player prefers to maximize carry distance over total distance, then the computing device 800 may be configured to recommend higher lofts and/or club heads that produce higher spin rates. However, if the player prefers to maximize total distance over carry distance, then the computing device 800 may be configured to recommend lower lofts and/or club heads that produce lower spin rates. The importance of distance to the player may affect the lofts recommended by the computing device 800. For example, if the importance of distance is high to the player, then the computing device 800 may be configured to recommend lower lofts.

The importance of accuracy may affect the head models recommended by the computing device 800. For example, if the importance of accuracy is high to the player, the computing device may be configured to recommend models with a more forgiving striking face (e.g., the TSR2). The player's handicap may also affect the recommended models. For example, if the player has a high handicap, the computing device 800 may be configured to recommend models designed for novice and beginner players (e.g., high-forgiveness club heads), such as the TSR2 model or the TSi1 model. However, if the player has a low handicap, the computing device 800 may be configured to recommend models designed for advanced or professional players (e.g., low-forgiveness club heads), such as the TSR4 model. These are only examples of how the player input data may affect how the computing device 800 generates the one or more recommended models, and the present disclosure is not limited thereto.

In some examples, the computing device 800 may be configured to generate recommended golf clubs having different heads but that all have the same shaft, for example, the shaft that was ultimately selected during the Shaft Fitting Recommendation stage. This can allow the affects of different head related features to be analyzed (e.g., by the computing device 800) without distortion from different shafts. However, the present disclosure is not limited thereto. In some examples, the computing device 800 may be configured to generate recommended golf clubs having different heads and different shafts during the Head Fitting Recommendation stage.

The one or more recommended heads in the golf club selection menu 3210 may be selectable, and the computing device 800 may be configured to show a selected head from among the one or more recommended heads in the selected golf club representation 3270. The computing device 800 may be configured to associate ball flight characteristics captured by and received from the launch monitor 840 with the selected head (e.g., with the selected golf club including the selected head), and to represent at least some of the ball flight characteristics on the golf shot graphical representation 3230 during the Head Fitting Recommendation stage in a similar, or same, manner as described herein with respect to the Shaft Fitting Recommendation stage.

For each golf club head with which golf shots have been taken and ball flight characteristics have been received by the computing device 800, the computing device 800 may be configured to generate, and to display on the distance-accuracy representation 3250, a computed distance and a computed accuracy during the Head Fitting Recommendation stage in a similar, or same, manner as the computing device 800 is configured to generate computed distances and computed accuracies, respectively, during the Shaft Fitting Recommendation stage. The computing device 800 may be configured to generate and display the computed distance and computed accuracy for a golf club after a set number (e.g., 1, 2, 3, 4, or 5) of golf shots have been taken with the golf club and ball flight characteristics for the golf shots have been received by the computing device 800. For example, in the depicted example, the set number of shots is 3. Accordingly, as shown in FIG. 31, although two golf shots have been taken with the fourth golf club 3264, which are represented by the two fourth golf club shot indicators 3244 circumscribed by the fourth golf club shot circumscription line 3244C, a computed distance and computed accuracy for the fourth golf club 3264 has not been generated and displayed in the distance-accuracy representation 3250. In the depicted example, the computing device 800 may be configured to generate the computed distance and the computed accuracy for the fourth golf club 3264 in response to receiving ball flight characteristics for a third golf shot with the fourth golf club (see, e.g., FIG. 32).

The computing device 800 may be configured to rank the golf club heads with which golf shots have been taken and ball flight characteristics have been received by the computing device 800. For example, the computing device 800 may be configured to generate a plurality of potential head fitting recommendations, respectively corresponding to the golf clubs with which golf shots have been taken and ball flight characteristics have been received, and rank the plurality of potential head fitting recommendations. Each of the plurality of potential head fitting recommendations may include one or more head related features (e.g., head model, loft, hosel setting, and/or one or more adjustable with options) of the corresponding golf club. The computing device 800 may be configured to display the heads (or the potential head fitting recommendations) on the fitting recommendation representation 3260 according to their rank. The computing device 800 may be configured to rank the golf club heads (or the potential head fitting recommendations) based on the player input data and/or the ball flight characteristics received by the computing device 800 and used during the Head Fitting Recommendation stage.

The computing device 800 may base its ranking of the golf club heads on the player's handicap; the player's average golf ball total distance when hitting with his or her own golf club; the player's accuracy when hitting from the tee with his or her own golf club; the player's preference regarding whether to maximize golf ball carry distance or golf ball total distance; the player's preference regarding how important accuracy is; and/or the player's preference regarding how important distance during the Head Fitting Recommendation stage in any manner that the computing device 800 may base its ranking of the shafts using these player input data during the Shaft Fitting Recommendation stage. In some examples, the player input data that the computing device 800 may base its ranking of the golf club heads on may include the player's preferred club head shape or model. For example, the computing device 800 may be more likely to rank golf club heads having the player's preferred club head model or having a shape or model similar to the player's preferred club head model, higher than the other golf club heads.

In some examples, the computing device 800 may be configured to end the Head Fitting Recommendation stage in response to the computing device 800 determining that a change in the player's performance (e.g., a change in the player's computed distance and/or a change in the player's computed accuracy) between two tested golf clubs is less than a threshold value. In some examples, the computing device 800 is configured to end the Head Fitting Recommendation stage in response to the computing device 800 determining that the player's performance with one of the test golf clubs is within a threshold value or a threshold range based on (e.g., relative to) a theoretical best performance (e.g., a performance using a theoretical best performing head model and loft), for example, in response to the computing device 800 determining that the player's performance with one of the test golf clubs is greater than 95% optimized (e.g., within a range of 5% of the theoretical best performance), for example, based on a scale of 0% to 100%, for all the inventory in an inventory database (e.g., all the inventory on-site). In some other examples, the computing device 800 may be configured to end the Head Fitting Recommendation stage in response to the computing device 800 receiving selection of a selectable head fitting recommendation completion element in a similar or same manner as the computing device 800 may end the Shaft Fitting Recommendation stage in response to receiving selection of the shaft fitting recommendation completion element 3299.

In some examples, the computing device 800 may end the fitting method in response to ending the Head Fitting Recommendation stage, and the player may select a golf club head from among the golf club heads displayed in the fitting recommendation representation 3260. In some other examples, the computing device 800 may proceed to the Fine Tuning stage in response to the ending the Head Fitting Recommendation stage.

The computing device 800 and the second user interface 3200 may be configured to function in at least some aspects in a similar or same manner during the Fine Tuning stage as it is configured to do so during the Head Fitting Recommendation stage. The computing device 800 may be configured to provide another head fitting recommendation (e.g., a second head fitting recommendation) to potentially improve one or more aspects of the player's performance compared to the head fitting recommendation (e.g., a first head fitting recommendation) generated during the Head Fitting Recommendation stage. For example, in response to the Head Fitting Recommendation stage ending, the computing device 800 may be configured to generate a fine tuning focus input field 3298 to receive information about which one or more aspects of the player's performance to attempt to improve on during the Fine Tuning stage. For example, the one or more aspects of performance may be selected from reducing or eliminating a left miss, reducing or eliminating a right miss, improving golf ball speed or total golf ball distance, and testing additional combinations of head model and loft that were not tested during the Head Fitting Recommendation stage.

During the Fine Tuning stage, the computing device 800 may be configured to generate, and to display in the golf club selection menu 3210, one or more recommended fine tuned heads or recommended configurable head settings (e.g., adjustable hosel settings, adjustable weight options, etc.) based on the player input data and/or ball flight characteristics in any manner (e.g., a similar or same manner) as the computing device 800 may be configured to do during the Head Fitting Recommendation stage. The computing device 800 may be configured to generate the one or more recommended fine tuned heads or recommended configurable head settings also based on the one or more selected aspects of the players performance. The recommended fine tuned heads or recommended configurable head settings may include head related features (e.g., head model, head loft, hosel setting, and/or one or more adjustable weight options compatible with the head model). In some examples, the recommended fine tuned heads may include head features not included in the recommended heads during the Head Fitting Recommendation stage. For example, the recommended heads during the Head Fitting Recommendation stage may include head model and/or loft, and the recommended fine tuned heads or recommended configurable head settings may include head model, loft, hosel setting, and one or more adjustable weight options. In some other examples, the recommended fine tuned heads or recommended configurable head settings may include the same head features included in the recommended heads during the Head Fitting Recommendation stage.

In some examples, recommended configurable head settings may be provided during the Fine Tuning stage. For example, one or more recommended fine tuned heads, each having a same head model and/or a same head loft, but being different in at least one configurable head setting (e.g., being different in at least one of adjustable hosel settings or adjustable weight options), may be generated and displayed in the golf club selection menu 3210 during the Fine Tuning stage. The head model and/or head loft that may be the same across the one or more recommended fine tuned heads generated during the Fine Tuning stage may be the same head model and/or head loft, respectively, of a head or head fitting recommendation selected at the end of the Head Fitting Recommendation stage (e.g., selected from among a plurality of ranked heads or ranked head fitting recommendations displayed in the fitting recommendation representation 3260 during the Head Fitting Recommendation stage).

The one or more recommended fine tuned heads or recommended configurable head settings displayed in the golf club selection menu may be selectable. The computing device 800 may be configured to display a selected fine tuned head or a selected configurable head settings from among the one or more recommended fine tuned heads or recommended configurable head settings in the selected golf club representation 3270, to associate ball flight characteristics captured by the launch monitor 840 and received by the computing device 800 with the selected fine tuned head or selected configurable head settings, and to represent at least some of the ball flight characteristics of golf shots taken with the selected fine tuned head or selected configurable head settings in the golf shot graphical representation 3230. In some examples, at least some (e.g., all) of the ball flight characteristics from the Head Fitting Recommendation stage are also used during (e.g., carried over to) the Fine Tuning stage.

For each fine tuned head or configurable head settings with which one or more golf shots (e.g., a set number of golf shots, such as 1, 2, 3, 4, or 5 golf shots) has been taken and ball flight characteristics have been received by the computing device 800, the computing device 800 may be configured to generate a computed distance and a computed accuracy in any manner as the computing device 800 may be configured to generate computed distances and computed accuracies during the Head Fitting Recommendation stage.

The computing device 800 may be configured to rank at least some of the heads (e.g., the fine tuned heads or configurable head settings with or without the heads from the Head Fitting Recommendation stage) with which golf shots have been taken and ball flight characteristics have been received by the computing device 800 during the Fine Tuning stage in any manner that the computing device 800 may be configured to rank the heads during the Head Fitting Recommendation stage. In some examples, the computing device 800 may be configured to generate a plurality of potential fine tuned head fitting recommendations or potential configurable head settings recommendations respectively corresponding to the fine tuned heads or configurable head settings with which golf shots have been taken and ball flight characteristics have been received by the computing device 800, and to rank the plurality of fine tuned head fitting recommendations or configurable head settings recommendations. Each of the fine tuned head fitting recommendations or configurable head settings recommendations may include one or more head related features that the corresponding golf club (e.g., the golf club including the corresponding fine tuned head or configurable head settings) has. The computing device 800 may be configured to define the fine tuned head fitting recommendation or configurable head settings recommendation to be the highest ranked potential fine tuned head fitting recommendation or configurable head settings recommendation, or to be the plurality of fine tuned head fitting recommendations or configurable head settings recommendations together with their ranking.

In the depicted example shown in FIG. 33, at least three golf shots have been taken for each of the second golf club 3262, the fourth golf club 3264, a fifth golf club 3265 (including the shaft of the second golf club 3262 and a head having a TSR2 model, a 9 degree loft, and a B2 hosel setting based on the Titleist's Surefit Hosel), and a sixth golf club 3266 (including the shaft of the second golf club 3262 and a head having a TSR4 model, a 9 degree loft, and a B2 hosel setting based on the Titleist's Surefit Hosel). In FIG. 33, three sixth golf club shot indicators 3246 are shown in the fairway chart representing the three golf shots taken with the sixth golf club 3266, and the three six golf club shot indicators 3246 are circumscribed by a sixth golf club shot circumscription line 3246C. The distance-accuracy representation 3250 is depicted in FIG. 33 as including the second computed distance 3252D and the second computed accuracy 3252A associated with the second golf club 3262, a fourth computed distance 3254D and a fourth computed accuracy 3254A associated with the fourth golf club 3264, a fifth computed distance 3255D and a fifth computed accuracy 3255A associated with the fifth golf club 3265, and a sixth computed distance 3256D and a sixth computed accuracy 3256A associated with the sixth golf club 3266. The fitting recommendation representation 3260 in FIG. 33 is shown as displaying the second golf club head 3262 and its corresponding second ranking characterization 3262DA, the fourth golf club head 3264 and its corresponding fourth ranking characterization 3264DA, the fifth golf club head 3265 and its corresponding fifth ranking characterization 3265DA, and the sixth golf club head 3266 and its corresponding sixth ranking characterization 3266DA, based on their rankings (with higher ranked golf clubs being illustrated higher on the fitting recommendation representation 3260 and lower ranked golf clubs being illustrated lower on the fitting recommendation representation 3260).

Referring to FIG. 34, the second user interface 3200 may be configured (e.g., during each of the Shaft Fitting Recommendation stage, the Head Fitting Recommendation, and the Fine Tuning stage), to display (e.g., at a top of the second user interface 3200 or in a separate user interface) a plurality of options in response to receiving selection of the selectable options element 3290. The plurality of options may include a selectable hide unavailable options element 3290NA, a ranking characterization element 3290R, a baseline distance element 3290D, a baseline accuracy element 3290A, an interview questions element 3290Q, and a save element 3290S.

The computing device 800 may be configured to hide unavailable golf clubs (e.g., hide shafts in the golf club selection menu 3210 during the Stage Fitting Recommendation stage that are not included in an inventory database, and hide heads in the golf club selection menu 3210 during each of the Head Fitting Recommendation stage and the Fine Tuning stage that are not included in the inventory database) in response to the hide unavailable options element 3290NA being selected. The computing device 800 may be configured to display the unavailable golf clubs in response to the hide unavailable options element 3290NA being unselected.

The computing device 800 may be configured to selectively change the ranking characterization associated with the golf clubs in the fitting recommendation representation 3260 via the ranking characterization element 3290R. For example, the ranking characterization element 3290R may, in response to being selected, provide a drop-down menu of a plurality of selectable potential characterizations. The computing device 800 may be configured to change the ranking characterization in response to receiving a selection of one of the plurality of selectable potential characterizations. In the depicted example, the characterization of a golf club in the fitting recommendation representation 3260 is shown as a distance-accuracy representation that indicates how the computed distance of the golf club ranks among the computed distances of all the golf clubs in the fitting recommendation representation 3260 and how the computed accuracy of the golf club ranks among the computed accuracies of all the golf clubs in the fitting recommendation representation 3260. For example, as shown in FIG. 33, the second ranking characterization 3262DA of the second golf club head 3262 indicates that the second computed accuracy 3252A is ranked first (or highest) among the second, fourth, fifth, and sixth computed accuracies 3252A, 3254A, 3255A, and 3256A, and that the second computed distance 3252D is ranked fourth (or lowest) among the second, fourth, fifth, and sixth computed distances 3252D, 3254D, 3255D, and 3256D. In some examples, the plurality of selectable potential characterizations may include the distance-accuracy characterization, strokes gained per round (e.g., an estimated change in the number of strokes per round when using a golf club), strokes gained per drive (e.g., an estimated change in the number of strokes per drive when using the golf club), a scoring index, etc.

The baseline distance element 3290D may represent the baseline distance that the computing device 800 is configured to compare the computed distances to when ranking the golf clubs in the fitting recommendation representation 3260, and the baseline accuracy element 3290A may represent the baseline accuracy that the computing device 800 is configured to compare the computed accuracies to when ranking the golf clubs in the fitting recommendation representation 3260. The computing device 800 may be configured to allow the baseline distance and the baseline accuracy to be manually changed via the baseline distance element 3290D and the baseline accuracy element 3290A, respectively. For example, the baseline distance element 3290D and/or the baseline accuracy element 3290A may provide editable fields configured to receive freeform text in an input field, and the computing device 800 may be configured to update the baseline distance and the baseline accuracy in response to receiving the freeform text in the input field. In some other examples, the baseline distance element 3290D and/or the baseline accuracy element 3290A may be configured to provide drop-down menus upon being selected, and the drop-down menus may display a plurality of selectable values. The computing device 800 may be configured to update the baseline distance in response to receiving selection of one of the selectable values in the drop-down menu of the baseline distance element 3290D, and to update the baseline accuracy in response to receiving selection of one of the selectable values in the drop-down menu of the baseline accuracy element 3290A.

The computing device 800 may be configured, in response to receiving selection of the interview questions element 3290Q, to display one or more of the input fields for receiving the player input data (e.g., one or more of the first to sixteenth input fields 3101-3116) that was received during the Interview stage, and to receive new player input data therein. The computing device 800 may then update the one or more recommended golf clubs in the golf club selection menu 3210, the computed distances and computed accuracies, and/or the ranking of the golf clubs in response to the new player data input.

The computing device 800 may be configured to save changes made via the plurality of options in response to receiving selection of the selectable save button 3290S.

Although specific devices and features have been recited throughout the disclosure as performing specific functions, one of skill in the art will appreciate that these devices and features are provided for illustrative purposes, and other devices and features may be employed to perform the functionality disclosed herein without departing from the scope of the disclosure. This disclosure describes some embodiments of the present technology with reference to the accompanying drawings, in which only some of the possible embodiments were shown. Other aspects may, however, be embodied in many different forms and should not be construed as limited to the embodiments set forth herein. Rather, these embodiments were provided so that this disclosure was thorough and complete and fully conveyed the scope of the possible embodiments to those skilled in the art.

Further, as used herein and in the claims, the phrase "at least one of element A, element B, or element C" is intended to convey any of: element A, element B, element C, elements A and B, elements A and C, elements B and C, and elements A, B, and C. Further, one having skill in the art will understand the degree to which terms such as "about" or "substantially" convey in light of the measurement techniques utilized herein. To the extent such terms may not be clearly defined or understood by one having skill in the art, the term "about" shall mean plus or minus ten percent.

Although specific embodiments are described herein, the scope of the technology is not limited to those specific embodiments. Moreover, while different examples and embodiments may be described separately, such embodiments and examples may be combined with one another in implementing the technology described herein. One skilled in the art will recognize other embodiments or improvements that are within the scope and spirit of the present technology. Therefore, the specific structure, acts, or media are disclosed only as illustrative embodiments. The scope of the technology is defined by the following claims and any equivalents therein.

What is claimed is:

1. A system for generating a fitting recommendation for a metalwood golf club, the system comprising:

a launch monitor comprising one or more sensors configured to capture ball flight characteristics; and a computing device communicatively coupled to the launch monitor, the computing device comprising:

a processor, and memory storing instructions that, when executed by the processor, cause the system to perform operations comprising:

receiving, by the computing device, player input data indicating a performance characteristic or preference of a player, receiving, by the computing device from the launch monitor, first ball flight characteristics for a first golf shot;

generating, based on both the player input data and the first ball flight characteristics, a first computed distance and a first computed accuracy; and generating, based on the first computed distance and the first computed accuracy, the fitting recommendation comprising at least one of a golf club head model, a loft, a shaft weight, or a shaft length.

2. The system of claim 1, wherein the player input data comprises at least one of player's handicap, player's average golf ball distance, player's golf ball accuracy from tee, player's golf ball trajectory, player's swing tempo, player's preferred golf club head model, player's preference between maximizing golf ball carry distance or golf ball total distance, or player's preference between maximizing golf ball accuracy or maximizing golf ball distance.

3. The system of claim 2, further comprising a display, wherein the operations further comprise:

displaying, on the display, a first user interface comprising input fields;

receiving, as input into the input fields of the first user interface, the player input data;

receiving, by the computing device from the launch monitor and for each golf club of a plurality of golf clubs, ball flight characteristics for each golf shot of one or more golf shots taken with the golf club, wherein the ball flight characteristics comprise golf ball total distance and golf ball lateral distance;

generating, for each golf club of the plurality of golf clubs and based on the ball flight characteristics for each golf shot of the one or more golf shots taken with the golf club, a computed distance and a computed accuracy;

ranking a plurality of potential fitting recommendations respectively corresponding to the plurality of golf clubs, and displaying, via the display and on a fitting recommendation representation in a second user interface, the plurality of potential fitting recommendations according to their rankings;

ranking the computed distances respectively corresponding to the plurality of golf clubs, ranking the computed accuracies respectively corresponding to the plurality of golf clubs, displaying, via the display and on a distance-accuracy representation in the second user interface, the computed distances respectively corresponding to the plurality of golf clubs based on their rankings, and displaying, via the display and on the distance-accuracy representation in the second user interface, the computed accuracies based on their rankings;

displaying, via the display, on a golf shot graphical representation in the second user interface, and for each golf club of the plurality of golf clubs, the golf ball total distance and the golf ball lateral distance for each golf shot of the one or more golf shots taken with the golf club; and representing, on a pitch count user interface via the display, a number of golf shots that have been taken.

4. The system of claim 1, wherein the operations further comprise receiving, by the computing device from the launch monitor, ball flight characteristics for each of a plurality of golf shots taken with a first golf club comprising a first golf club head, wherein the plurality of golf shots include the first golf shot, wherein the generating the first computed distance is based on both the player input data and the ball flight characteristics for each of the plurality of golf shots, and wherein the ball flight characteristics for each of the plurality of golf shots comprises a lateral golf ball position and at least one of a golf ball total distance or a golf ball carry distance.

5. The system of claim 1, wherein the operations further comprise receiving, by the computing device from the launch monitor, ball flight characteristics for each of a plurality of golf shots taken with a first golf club comprising a first golf club head, wherein the plurality of golf shots include the first golf shot, wherein the generating the first computed accuracy is based on both the player input data and the ball flight characteristics for each of the plurality of golf shots, and wherein the ball flight characteristics for each of the plurality of golf shots comprises a lateral golf ball position and at least one of a golf ball total distance or a golf ball carry distance.

6. The system of claim 1, wherein the first golf shot is taken with a first golf club comprising a first golf club head, wherein the operations further comprise:

receiving, by the computing device from the launch monitor, second ball flight characteristics for a second golf shot taken with a second golf club comprising a second golf club head; and generating a second computed distance based on both the player input data and the second ball flight characteristics, and a second computed accuracy based on both the player input data and the second ball flight characteristics, wherein the generating the fitting recommendation is based on the first computed distance, the first computed accuracy, the second computed distance, and the second computed accuracy, and wherein the fitting recommendation comprises:

a golf club head model of the first golf club head and a golf club head loft of the first golf club head; or a golf club head model of the second golf club head and a golf club head loft of the second golf club head.

7. The system of claim 6, wherein the first golf club comprises a first shaft, and the second golf club comprises the first shaft.

8. The system of claim 1, wherein the first golf shot is taken with a first golf club comprising a first shaft, wherein the operations further comprise:

receiving, by the computing device from the launch monitor, second ball flight characteristics for a second golf shot taken with a second golf club comprising a second shaft; and generating a second computed distance based on the second ball flight characteristics, and a second computed accuracy based on both the player input data and the second ball flight characteristics, and wherein the generating the fitting recommendation is based on the first computed distance, the first computed accuracy, the second computed distance, and the second computed accuracy, and wherein the fitting recommendation comprises:

a shaft length of the first shaft and a shaft weight of the first shaft; or a shaft length of the second shaft and a shaft weight of the shaft.

9. The system of claim 8, wherein the first golf club comprises a first golf club head, and the second golf club comprises the first golf club head.

10. The system of claim 1, wherein the computing device is configured to generate a first plurality of potential golf clubs and to filter the first plurality of potential golf clubs by an inventory database to provide a second plurality of potential golf clubs, wherein the computing device is configured to receive selection of a golf club from among the second plurality of potential golf clubs, wherein the computing device is configured to associate the ball flight characteristics for the first golf shot with the golf club selected from among the second plurality of potential golf clubs, and wherein the fitting recommendation comprises at least one of a golf club head model, a loft, a shaft weight, or a shaft length of the golf club selected from among the second plurality of potential golf clubs.

11. A computer-implemented method for generating a golf club head fitting recommendation for a golf club, the method comprising:

receiving, by a computing device, player input data indicating a performance characteristic or preference of a player, receiving, by the computing device from a launch monitor communicatively coupled to the computing device, ball flight characteristics for each of a plurality of golf shots with a first golf club comprising a first golf club head; and generating, based on the player input data and the ball flight characteristics for each of the plurality of golf shots with the first golf club, the golf club head fitting recommendation comprising a golf club head model and a loft.

12. The method of claim 11, wherein the player input data comprises at least one of player's handicap, player's average golf ball distance, player's golf ball accuracy from tee, player's golf ball trajectory, player's swing tempo, player's preferred golf club head model, player's preference between maximizing golf ball carry distance or golf ball total distance, player's preference between maximizing golf ball accuracy or maximizing golf ball distance.

13. The method of claim 11, further comprising receiving, by the computer device from the launch monitor, ball flight characteristics for each of a plurality of golf shots with a second golf club comprising a second golf club head, wherein the generating the golf club head fitting recommendation is based on the player input data, the ball flight characteristics for each of the plurality of golf shots with the first golf club, and the ball flight characteristics for each of the plurality of golf shots with the second golf club.

14. The method of claim 11, wherein the first golf club head has a first golf club head model, a first loft, a first hosel setting, wherein the method further comprises:

receiving, by the computer device from the launch monitor, ball flight characteristics for each of a plurality of golf shots with a second golf club comprising a second golf club head having a second golf club head model, a second loft, and a second hosel setting, wherein at least one of the second golf club head model, the second loft, or the second hosel setting is different, respectively, from the first golf club head model, the first loft, or the first hosel setting; and generating, based on the player input data, the ball flight characteristics for each of the plurality of golf shots with the first golf club, and the ball flight characteristics for each of the plurality of golf shots with the second golf club, a fine tuned head recommendation comprising a golf club head model, a loft, and a hosel setting.

15. The method of claim 14, further comprising:

generating, based on the player input data and the ball flight characteristics for each of the plurality of golf shots with the first golf club, a first computed distance and a first computed accuracy; and generating, based on the player input data and the ball flight characteristics for each of the plurality of golf shots with the second golf club, a second computed distance and a second computed accuracy, wherein the generating the fine tuned head recommendation occurs after the golf club head fitting recommendation is generated, and is based on the first computed distance, the first computed accuracy, the second computed distance, and the second computed accuracy.

16. A computer-implemented method for generating a shaft fitting recommendation for a golf club, the method comprising:

receiving, by a computing device, player input data indicating a performance characteristic or preference of a player;

receiving, by the computing device from a launch monitor communicatively coupled to the computing device, ball flight characteristics for each of a plurality of golf shots with a first golf club comprising a first golf club shaft; and generating, based on the player input data and the ball flight characteristics for each of the plurality of golf shots with the first golf club, the shaft fitting recommendation comprising a shaft length and a shaft weight.

17. The method of claim 16, wherein the player input data comprises at least one of player's handicap, player's average golf ball distance, player's golf ball accuracy from tee, player's golf ball trajectory, player's swing tempo, player's preferred golf club head model, player's preference between maximizing golf ball carry distance or golf ball total distance, player's preference between maximizing golf ball accuracy or maximizing golf ball distance.

18. The method of claim 16, further comprising receiving, by the computer device from the launch monitor, ball flight characteristics for each of a plurality of golf shots with a second golf club comprising a second golf club shaft, wherein the generating the shaft fitting recommendation is based on the player input data, the ball flight characteristics for each of the plurality of golf shots with the first golf club, and the ball flight characteristics for each of the plurality of golf shots with the second golf club.

19. The method of claim 18, further comprising:

generating, based on the player input data and the plurality of golf shots with the first golf club shaft, a first computed distance and a first computed accuracy; and generating, based on the player input data and the plurality of golf shots with the second golf club shaft, a second computed distance and a second computed accuracy, wherein the generating the shaft fitting recommendation is based on the first computed distance, the first computed accuracy, the second computed distance, and the second computed accuracy.

20. The method of claim 16, further comprising:

receiving, by the computer device from the launch monitor, ball flight characteristics for each of a plurality of golf shots with a golf club comprising the first golf club shaft and a first golf club head; and generating, based on the player input data and the ball flight characteristics for each of the plurality of golf shots with the golf club comprising the first golf club shaft and the first golf club head, a golf club head recommendation comprising a golf club head model and a loft, wherein the generating the golf club head recommendation occurs after the generating the shaft fitting recommendation.

* * * * *